US012122584B2

(12) United States Patent
Hatje et al.

(10) Patent No.: US 12,122,584 B2
(45) Date of Patent: Oct. 22, 2024

(54) CONTAINER ASSEMBLIES WITH PAPER-BASED END CLOSURES

(71) Applicant: Sonoco Development, Inc., Hartsville, SC (US)

(72) Inventors: Dirk Hatje, Mannheim (DE); Veronique Sins, Grimbergen (BE)

( * ) Notice: Subject to any disclaimer, the term of this patent is extended or adjusted under 35 U.S.C. 154(b) by 182 days.

(21) Appl. No.: 17/459,259

(22) Filed: Aug. 27, 2021

(65) Prior Publication Data

US 2022/0063895 A1 Mar. 3, 2022

Related U.S. Application Data

(60) Provisional application No. 63/071,019, filed on Aug. 27, 2020.

(51) Int. Cl.
*B65D 81/20* (2006.01)
*B65D 43/02* (2006.01)

(52) U.S. Cl.
CPC ..... *B65D 81/2076* (2013.01); *B65D 43/02* (2013.01); *B65D 2543/00092* (2013.01);
(Continued)

(58) Field of Classification Search
CPC ..... B65D 81/2076; B65D 43/02; B65D 2543/00092; B65D 2543/00268; B65D 2543/00277; B65D 2543/00296; B65D 2543/00509; B65D 3/04; B65D 3/22; B65D 3/12; B65D 3/14; B65D 65/40;
(Continued)

(56) References Cited

U.S. PATENT DOCUMENTS 2,859,575 A 11/1958 Lehmann
3,060,652 A 10/1962 Eckman
(Continued)

FOREIGN PATENT DOCUMENTS

CN 101503121 A 8/2009
DE 2643489 A1 4/1977
(Continued)

OTHER PUBLICATIONS

International Search Report and Written Opinion for International application No. PCT/US2021/047880 dated Jan. 7, 2022; 12 pages.
(Continued)

*Primary Examiner* — Christopher R Demeree
(74) *Attorney, Agent, or Firm* — Nelson Mullins Riley & Scarborough LLP

(57) ABSTRACT

The present disclosure is directed to recyclable, composite container assemblies with improved characteristics resulting from a combination of raw materials, structural design, systems, and methods for sealing a paper-based closure to a paper-based container body. The container assemblies demonstrate superior performance and seal properties, such as very low oxygen transmission rates and high resistance to bulging and/or damage due to high pressure differentials. The disclosed container assemblies, manufactured at high speeds, have been optimized by increasing the shelf-life of food products stored therein, while minimizing any non-paper materials such that the container assemblies qualify as recyclable mono-material.

22 Claims, 42 Drawing Sheets

(52) U.S. Cl.
CPC ..... *B65D 2543/00268* (2013.01); *B65D 2543/00277* (2013.01); *B65D 2543/00296* (2013.01); *B65D 2543/00509* (2013.01)

(58) Field of Classification Search
CPC ..... B29C 53/50; B29C 53/566; B32B 1/00; B32B 15/12; B32B 2307/7246; B32B 2307/7244; B32B 2307/7242
USPC ..... 229/4.5; 220/626; 156/69; 264/299; 428/34.2, 35.7, 36.6, 36.9
See application file for complete search history.

(56) References Cited

U.S. PATENT DOCUMENTS

| | | | | |
|---|---|---|---|---|
| 3,169,355 | A | 2/1965 | Hollaway et al. | |
| 4,071,598 | A | 1/1978 | Meadors | |
| 4,098,404 | A | 7/1978 | Rupert | |
| 4,149,574 | A | 4/1979 | Lehmann et al. | |
| 4,579,275 | A | 4/1986 | Peelman et al. | |
| 4,591,055 | A | 5/1986 | Corn | |
| 4,599,123 | A | 7/1986 | Christensson | |
| 4,640,733 | A | 2/1987 | Bogren | |
| 4,724,654 | A | 2/1988 | Dahlin et al. | |
| 4,736,572 | A | 4/1988 | Fang et al. | |
| 4,989,394 | A | 2/1991 | Berg et al. | |
| 5,339,595 | A | 8/1994 | Rouse et al. | |
| 5,720,593 | A | 2/1998 | Pleake | |
| 6,912,828 | B1 | 7/2005 | Yamay | |
| 9,555,910 | B2 | 1/2017 | Vaccari et al. | |
| 10,150,584 | B2 | 12/2018 | Schiavina | |
| 10,882,648 | B2 | 1/2021 | Sireix | |
| 11,572,205 | B2 | 2/2023 | Horz | |
| 2002/0185402 | A1 | 12/2002 | Boatwright | |
| 2003/0131568 | A1 | 7/2003 | Rossi et al. | |
| 2003/0215587 | A1 | 11/2003 | Fatica et al. | |
| 2013/0092312 | A1* | 4/2013 | Cassoni | B31B 50/64 493/162 |
| 2013/0092697 | A1 | 4/2013 | Guzzi et al. | |
| 2014/0260086 | A1 | 9/2014 | Schiavina et al. | |
| 2019/0016487 | A1 | 1/2019 | Capitani | |
| 2019/0031379 | A1 | 1/2019 | Palumbo | |
| 2019/0055040 | A1 | 2/2019 | Capitani | |
| 2019/0152631 | A1 | 5/2019 | Sireix | |
| 2020/0009819 | A1* | 1/2020 | Cassoni | B31B 50/64 |
| 2020/0189791 | A1* | 6/2020 | Dregger | B32B 7/12 |
| 2023/0058059 | A1 | 2/2023 | Hagelqvist | |

FOREIGN PATENT DOCUMENTS

| | | | |
|---|---|---|---|
| DE | 3524926 | A1 | 1/1987 |
| EP | 0357276 | A1 | 3/1990 |
| EP | 1151937 | A1 | 11/2001 |
| EP | 1595802 | A2 | 11/2005 |
| EP | 1842776 | A2 | 10/2007 |
| EP | 2308758 | A1 | 4/2011 |
| EP | 2374730 | A1 | 10/2011 |
| EP | 3486186 | A1 | 5/2019 |
| GB | 1161022 | A | 8/1969 |
| GB | 1187302 | | 4/1970 |
| WO | 1997006063 | A1 | 2/1997 |
| WO | 0012387 | A1 | 3/2000 |
| WO | 2011146087 | A1 | 11/2011 |
| WO | 2013056205 | A2 | 4/2013 |

OTHER PUBLICATIONS

International Search Report and Written Opinion for International application No. PCT/US2021/047883 dated Dec. 14, 2021; 13 pages.
International Search Report and Written Opinion for International application No. PCT/US2021/047890 dated Dec. 7, 2021; 13 pages.
U. S. Non Final office action dated Jun. 30, 2023 in U.S. Appl. No. 17/459,238—20 pages.
U. S. Final office action dated Sep. 21, 2023 in U.S. Appl. No. 17/459,283—17 pages.
U. S. Non Final office action dated Jun. 30, 2023 in U.S. Appl. No. 17/459,283—18 pages.
Final Office Action issued in U.S. Appl. No. 17/459,283 on Apr. 22, 2024; 15 pages.
Non-Final office action in U.S. Appl. No. 17/459,283, Dated Jan. 17, 2024, 19 pages—[only new art cited herein].
Final office action in U.S. Appl. No. 17/459,238, dated Dec. 11, 2023, 22 pages.

* cited by examiner 61p
61b
61i
61o
61l
61bm
61bf 60i
66
60b
60bf
60bm
60t
60p
64

50c'
50b
50p
52
54
50bf
50bm
50t 61
611
63
66
64
610
8
60
205
62
50

CONTAINER ASSEMBLIES WITH PAPER-BASED END CLOSURES

CROSS-REFERENCE TO RELATED APPLICATIONS

This application claims priority to U.S. Provisional Patent Application No. 63/071,019, filed Aug. 27, 2020, entitled "CONTAINER ASSEMBLIES WITH PAPER-BASED END CLOSURES", wherein the foregoing is incorporated by reference in its entirety herein.

FIELD OF THE DISCLOSURE

The present disclosure relates generally to systems and methods for formation and sealing of composite container assemblies with paper-based or composite closures.

BACKGROUND OF THE DISCLOSURE

Rigid, paper-based, composite container assemblies are often used to package various products, such as snacks and other food items, for example. These container assemblies often comprise a rigid container body (e.g., cylindrical) manufactured with the top and bottom ends open. The composite container bodies may comprise rigid cans made from sheet material (e.g., spirally wound), such as cardboard and/or paperboard. Such container assemblies further include top and bottom end closures. While the bottom end closure (e.g., metal end) is usually permanently affixed (e.g., seamed) to a bottom rim of the container body, the top end closure is often designed to be easily removed by the consumer (e.g., a removable/replaceable overcap and/or a peelable membrane). Typically, the membrane is first sealed to the top rim. The container interior is then filled with the products through the open bottom end of the container body, and the metal closure is seamed onto the bottom rim of the container body.

The process described above, using metal bottom ends, interferes with the recyclability of the container assembly, as seaming the metal closure to the bottom of the container body makes it very difficult to separate the metal closure from the container assembly itself after use. Without the ability to separate the paper-based body of the container assembly from the metal bottom, the container assembly is unable to enter either the paper or metal recycling stream. This may result in unnecessary waste and negative environmental impacts. There exists a need for recyclable container assemblies in order to increase the sustainability of the end product.

One solution to the need for recyclability is to produce container assemblies with paper-based end closures rather than metal ends. However, the existing paper-based container assemblies and methods for affixing paper-based end closures to paper-based container bodies do not provide a container which has acceptable seal performance features. Through ingenuity and hard work, the inventors have developed container assemblies and methods for making such container assemblies with improved characteristics.

For example, the container assemblies resulting from the raw materials, methods, and/or unique tooling processes described herein have improved oxygen transmission rates (to less than about 0.05 $cm^3/m^2$/day, in some embodiments) and are able to withstand pressure differentials of greater than about 10 inHg in some embodiments—a marked improvement over known paper-based container assemblies.

SUMMARY OF THE DISCLOSURE

The present disclosure relates generally to sealed paper-based container assemblies and methods of making such container assemblies.

In some embodiments, the present disclosure is directed to container assemblies (e.g., cylindrical) sealed with paper-based bottom closures. In certain embodiments, the present disclosure relates to the resulting characteristics of the manufactured container assembly. The container assemblies have characteristics superior to any prior known paper-based bottom container assemblies, as described below.

In some embodiments, the present disclosure is directed to a paper-based container assembly having a top closure and a bottom closure (e.g., paper-based disc) sealed to a container body. The paper-based container assembly may have an oxygen transmission rate of about 0.05 $cm^3/m^2$/day or less and a water vapor transmission rate of about 0.05 $g/m^2$/day or less. The container body may comprise at least one sidewall defining a container interior. The container body may further comprise a top rim, circumscribing a top end of the sidewall, and a bottom peripheral edge, circumscribing a bottom end of the sidewall. The top closure may include a peelable membrane, a peelable barrier cap, a puncturable membrane, or a scored opening membrane sealed to the top rim or a recessed membrane sealed to the interior of the container body. The bottom closure may be recessed into the bottom end and may form a seal with an interior surface of the container body. The container body, peelable membrane, and bottom closure may each comprise a plurality of layers. The plurality of layers may include one or more barrier layers and one or more paper-based layers.

In certain embodiments, the water vapor transmission rate of the paper-based container assembly may be about 0.5 $g/m^2$/day or less. In certain embodiments, the water vapor transmission rate of the paper-based container assembly may be about 0.05 $g/m^2$/day or less. In certain embodiments, the one or more paper-based layers of the container body, peelable membrane, and bottom closure may comprise at least about 95% by mass of the paper-based container assembly.

In certain embodiments, the plurality of layers may include one or more ionomer layers, wherein the one or more ionomer layers of at least one of the container body and bottom closure are of the same grade and, when heated, form a seal between the bottom closure and the interior surface of the container body. In certain embodiments, the plurality of layers may include one or more ionomer layers, wherein the one or more ionomer layers of at least one of the container body and top closure are of the same grade and, when heated, form a seal between the top closure and the interior surface (i.e. rolled rim) of the container body.

In certain embodiments, at least one of the one or more ionomer layers may have a thickness within the range of about 2 to about 40 μm. In certain embodiments, the one or more barrier layers of at least one of the container body, peelable membrane, and bottom closure may comprise aluminum, a metalized polyethylene terephthalate (MPET) film, a metalized polybutylene terephthalate (MPBT) film, and/or an aluminum oxide (AlOx) coated polyethylene terephthalate (PET) film. In certain embodiments, at least one of the one or more barrier layers may have a thickness within the range of about 2 to about 40 μm. In certain embodiments, the one or more paper-based layers of the bottom closure may comprise a flexible board and have a thickness within the range of about 0.1 to about 0.6 mm. In certain embodiments, the plurality of layers may include one or more tie layers. In certain embodiments, the bottom closure may be recessed into the bottom end of the container body at a recessed distance within the range of about 0.2-2 cm and protrude less than the recessed distance at a pressure differential with the container interior of about 10 inHg (about 34 kPa). In certain embodiments, the seal between the interior surface of the container body and the bottom closure may be hermetic. In certain embodiments, the container assembly may be configured to store food products within the container interior. In certain embodiments, the container body may be cylindrical, have a height within the range of about 4-40 cm, and/or have an inner diameter within a range of about 4-20 cm.

While the container of the invention may be cylindrical, the invention should not be so limited. The container may have a square, rectangular, triangular, or irregular cross-section, in certain embodiments. The bottom closure of the invention may have a shape and configuration which correlates to the cross section of the container. Thus, for a cylindrical container, the bottom closure may be round or disc-shaped. However, a container with a square cross section may be fitted with a square bottom closure, for example.

In some embodiments, the present disclosure is directed to a paper-based container assembly having a top closure and a bottom closure (e.g., paper-based disc) sealed to a cylindrical container body. The paper-based container assembly may have an oxygen transmission rate of about 0.5 $cm^3/m^2$/day or less and a water vapor transmission rate of about 0.5 $g/m^2$/day or less. The cylindrical container body may comprise a sidewall defining a container interior. The cylindrical container body may further comprise a top rim, circumscribing a top end of the sidewall, and a bottom peripheral edge, circumscribing a bottom end of the sidewall. The top closure may be sealed to the top rim. The bottom closure may be recessed into the bottom end and may form a seal with an interior surface of the cylindrical container body. The cylindrical container body, top closure, and bottom closure may comprise a plurality of layers, including one or more paper-based layers. The one or more paper-based layers of the cylindrical container body, top closure, and bottom closure may comprise at least about 95% by mass of the paper-based container assembly.

In certain embodiments, the water vapor transmission rate of the paper-based container assembly may be about 0.15 $g/m^2$/day or less. In certain embodiments, the water vapor transmission rate of the paper-based container assembly may be about 0.05 $g/m^2$/day or less. In certain embodiments, the plurality of layers may include one or more ionomer layers, wherein the one or more ionomer layers of at least one of the cylindrical container body and the bottom closure are of the same grade and, when heated, form the seal between the bottom closure and the interior surface of the cylindrical container body. In certain embodiments, at least one of the one or more ionomer layers may have a thickness within the range of about 2 to about 40 μm. In certain embodiments, the plurality of layers may include one or more barrier layers. The one or more barrier layers of at least one of the cylindrical container body, top closure, and bottom closure may comprise aluminum, a metalized polyethylene terephthalate (MPET) film, a metalized polybutylene terephthalate (MPBT) film, and/or an aluminum oxide (AlOx) coated polyethylene terephthalate (PET) film. In certain embodiments, at least one of the one or more barrier layers may have a thickness within the range of about 5 to about 20 μm. In certain embodiments, the one or more paper-based layers of the bottom closure may comprise a flexible board and have a thickness within the range of about 0.1 to about 0.6 mm. In certain embodiments, the plurality of layers may include one or more tie layers. In certain embodiments, the bottom closure may be recessed into the bottom end of the cylindrical container body at a recessed distance within the range of about 0.2-2 cm and protrude less than the recessed distance at a pressure differential with the container interior of about 10 inHg (about 34 kPa). In certain embodiments, the seal between the interior surface of the cylindrical container body and the bottom closure may be hermetic. In certain embodiments, the container assembly may be configured to store food products within the container interior. In certain embodiments, the cylindrical container body may have a height within the range of about 4-40 cm and/or an inner diameter within a range of about 3-20 cm.

The accompanying drawings, which are incorporated in and constitute a part of this specification, illustrate one or more embodiments of the present disclosure and, together with the description, serve to explain the principles of the present disclosure.

BRIEF DESCRIPTION OF THE DRAWINGS

A full and enabling disclosure directed to one of ordinary skill in the art, is set forth in the specification, which makes reference to the appended drawings, in which.

Figure 1:
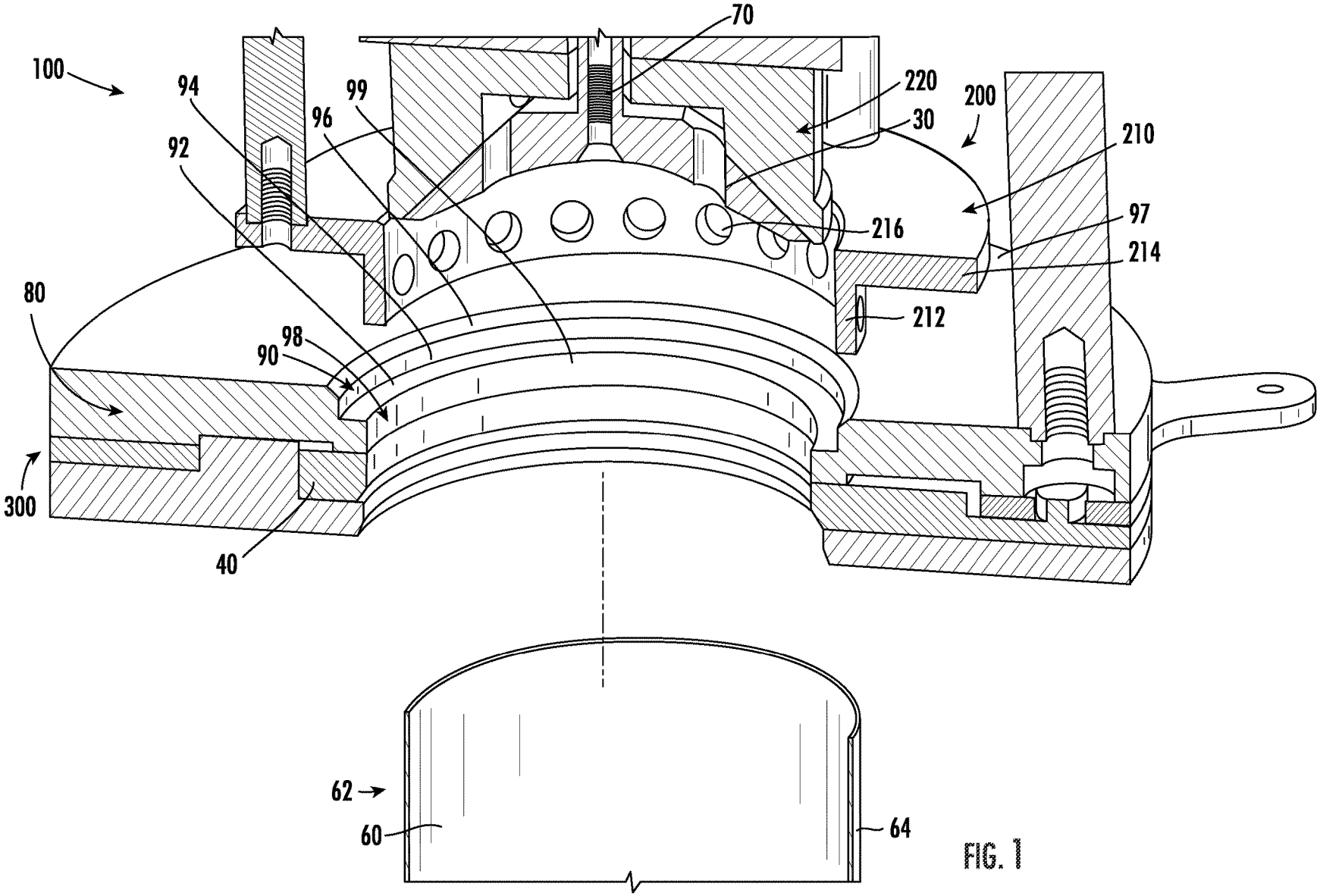
FIG. 1 illustrates a cross-section of an exemplary sealing system, in accordance with some embodiments of the present disclosure.

Repeated use of reference characters in the present specification and drawings is intended to represent the same or analogous features or elements of the present disclosure.

DETAILED DESCRIPTION

Reference will now be made in detail to embodiments of the present disclosure, one or more examples of which are illustrated in the accompanying drawings. Each example is provided by way of explanation of the present disclosure, not limitation of the present disclosure. In fact, it will be apparent to those skilled in the art that modifications and variations can be made in the present disclosure without departing from the scope or spirit thereof. For instance, features illustrated or described as part of one embodiment may be used on another embodiment to yield a still further embodiment. Thus, it is intended that the present disclosure covers such modifications and variations as come within the scope of the appended claims and their equivalents.

In some embodiments, the present disclosure is directed to high-barrier packages for perishable products and methods for the manufacture of such high-barrier packages, such as hermetically-sealed container assemblies for packaging humidity- and/or oxygen-sensitive solid food products, for example. The container assemblies produced according to the devices and methods described herein may be capable of sustaining a variety of atmospheric conditions when filled and closed. More specifically, the hermetically-sealed container assemblies may be suitable for maintaining the freshness of crisp food products such as, for example, snack foods, potato chips, processed potato snacks, cookies, nuts, and the like. As used herein, the term "hermetic" refers to the property of sustaining an oxygen ($O_2$) level with a barrier such as, for example, a seal, a surface, and/or a container assembly. For example, when the oxygen transmission rate of a container assembly is less than 50 $cm^3$ of $O_2/m^2$/day when subjected to ambient conditions of air at about 22.7° C. and about 0% relative humidity, the container assembly may be considered hermetically-sealed.

In some embodiments, the systems and methods described herein may produce hermetically sealed container assemblies having a paper-based, composite bottom closure which may be a paper-based disc inserted into the open bottom end of a composite container body and sealed in a recessed position. Further, the containers of the present disclosure may maintain their hermetic seal while being transported worldwide (e.g., via truck, air, rail), even as they are subjected to varying atmospheric conditions (e.g., caused by variations in temperature, humidity, and/or altitude). Such conditions may result in a significant pressure differential between the interior and exterior of the hermetically-sealed container assembly. Moreover, the atmospheric conditions may cycle between relatively high and relatively low values. The containers and methods described herein may advantageously yield container assemblies that can be transported and/or stored under widely differing climate conditions (e.g., temperature, humidity, and/or pressure). Further, in some embodiments, the hermetically-sealed container assemblies may be formed from raw materials with appropriate characteristics for high-speed manufacturing.

As noted, the hermetically-sealed container assemblies may include a paper-based, composite bottom closure. Likewise, the container body may comprise a paper-based composite material, allowing the entire container assembly to be recycled in a single stream (unlike conventional container assemblies with metal bottoms, for example). In some embodiments, the container assemblies may be about 90% or more paper content by mass. In some embodiments, the container assemblies may be about 95% or more paper content by mass. These paper content percentages may advantageously qualify the container assemblies as mono-material in certain countries, allowing them to be accepted in the recycling streams of most countries globally. In some embodiments, the term "mono-material" includes any material that can be collected and enter a waste management flow to obtain raw material from a residue for a different application.

As used herein, the term "coating" may mean any material covering a substrate or the surface of an object or layer. For example, a coating may be applied to substrate, object or layer as a liquid, gas, and/or solid. A coating may completely cover the substrate, object or layer or may partially cover the same. A coating may have decorative and/or functional properties.

As used herein, a "sealant" is a material may be used to seal one layer or component to another layer or component.

A sealant may comprise a heat-sealable material in an embodiment. A sealant may comprise a heat-sealable thermoplastic material, in an embodiment. In an embodiment, a sealant may comprise an ionomeric material, an adhesive, or a tie layer. A sealant may comprise a coating or a film in an embodiment.

As used herein, a "tie layer" may comprise an adhesive, sealant, or any other material that ties, adheres, or affixes one layer to another. The adhesives discussed herein may be permanent, pressure sensitive, peelable, or otherwise.

Container Assembly

Figures 17A, 17B, 17C, 17D:
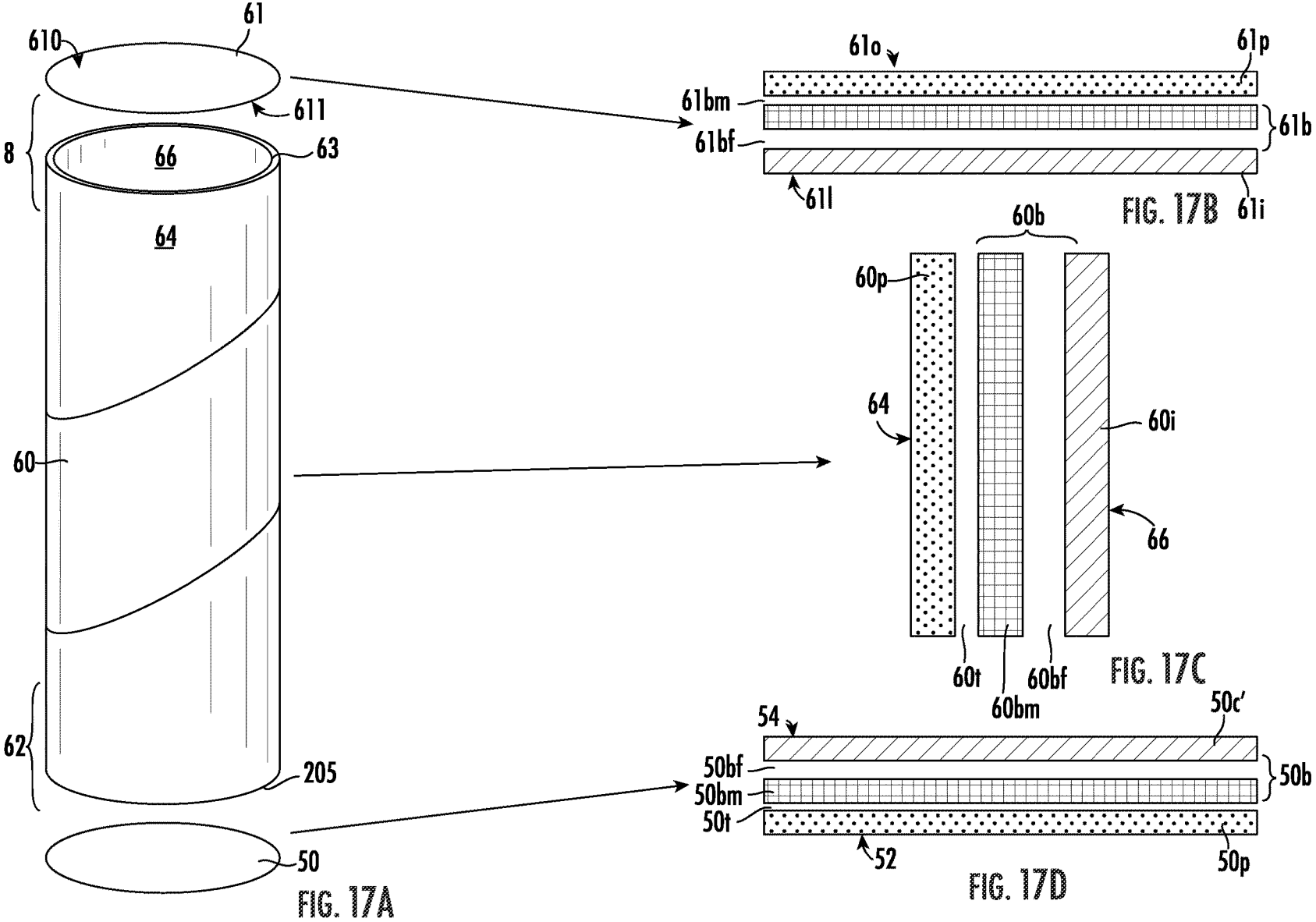
FIG. 17A illustrates a top-front-side view of an exemplary container body, top closure, and paper-based disc, in accordance with some embodiments of the present disclosure.
FIGS. 17B-17D are cross-sectional views of the exemplary container body, top closure, and paper-based disc of FIG. 17A, in accordance with some embodiments of the present disclosure.
Figure 18:
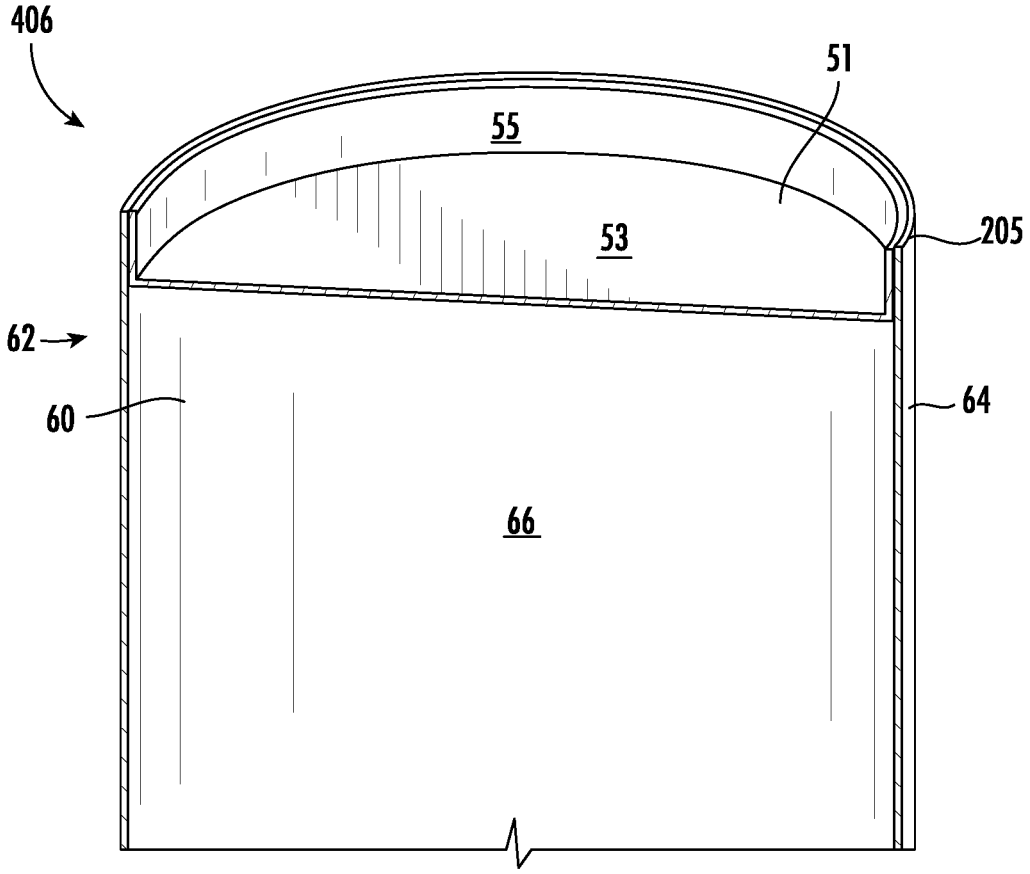
FIG. 18 illustrates a cross-section of an exemplary sealed container assembly, in accordance with some embodiments of the present disclosure.
Figure 19:
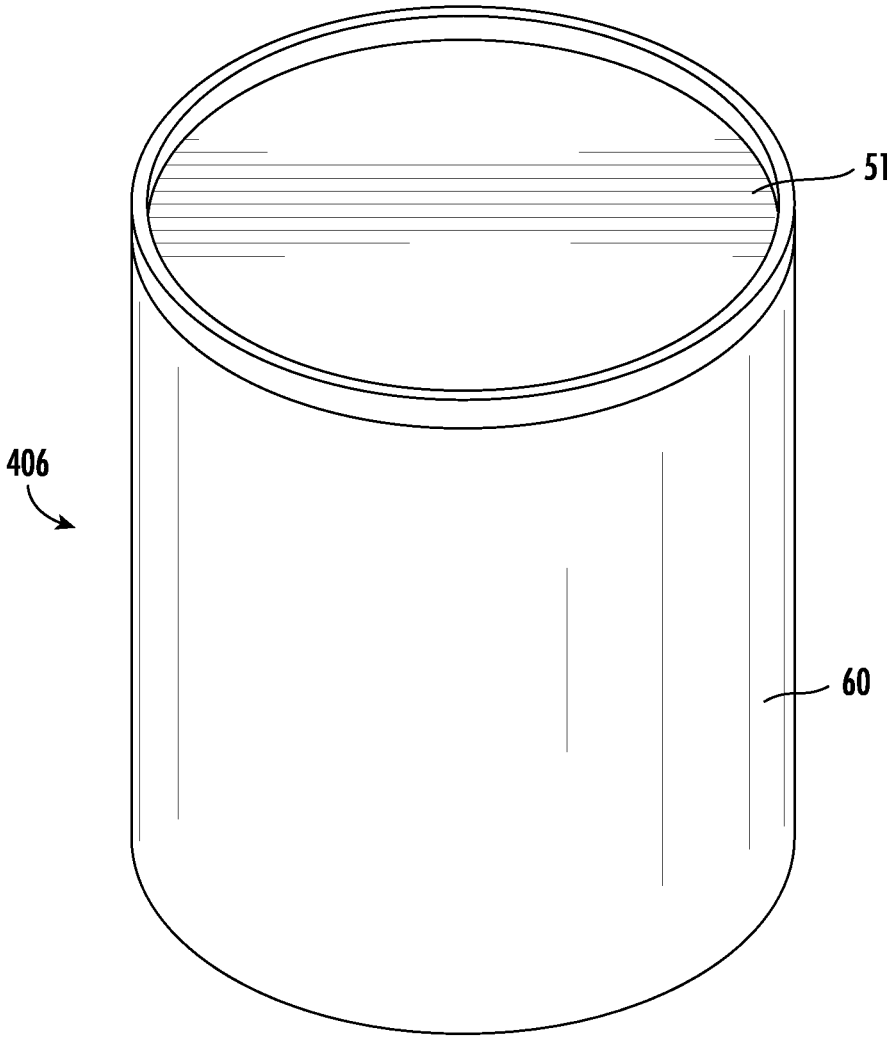
FIG. 19 illustrates a bottom end of an exemplary sealed container assembly with a recessed bottom closure, in accordance with some embodiments of the present disclosure.

An example embodiment of the paper-based container assembly is shown in FIGS. 17-19. In such embodiments, a paper-based disc 50 is formed into an end closure 51 and sealed to a rigid, paper-based, composite container body 60. The container body 60, top closure 61, and bottom closure 51 together become a sealed container assembly 406. While depicted as generally cylindrical, it should be understood that the container assembly 406 may be otherwise shaped. For example, the container assembly 406 could be square, rectangular, ovular, elliptical, or any other cross-sectional shape known in the art. In some embodiments, the container assembly 406 may have a height within a range of about 5-40 cm (about 2-16 in.), for example.

Container Assembly Characteristics

Without being bound by theory, it is believed that the combination of the raw materials used in the disclosed container assemblies, systems, and/or methods of assembling impart superior characteristics and performance of the resulting container assemblies. For example, the combination of barrier layers and ionomer layers may provide enhanced abrasion and/or puncture resistance. Further, in some embodiments, the container assemblies pass accelerated high-altitude testing at about 10 inHg for at least about 10 minutes. Further, the seal between the container body 60 and bottom closure 51 may remain undisturbed during high-speed assembly, resulting in a better seal using raw materials that can directly enter the paper-recycling stream.

In some embodiments, the container assemblies resulting from the systems and methods of the present disclosure may afford a shelf life (e.g., moisture gain less than about 1% per gram of contained food products) within a range of about 6-24 months, for example. This superior performance may be due to low water vapor and/or oxygen transmission rates for the produced container assemblies. For example, in some embodiments, the water vapor transmission rate of the container assembly 406 may be equal or superior to about 0.05 $g/m^2/day$. In other embodiments, the water vapor transmission rate of the container assembly 406 may be equal or superior to about 0.15 $g/m^2/day$. In still other embodiments, the water vapor transmission rate of the container assembly 406 may be equal or superior to about 0.05 $g/m^2/day$. These testing results may be from weight measurements in ambient conditions of air at about 38° C. and about 90% relative humidity taken periodically over the course of one day. In some embodiments, the oxygen transmission rate of the container assembly 406 may be equal or superior to about 0.5 $cm^3/m^2/day$. These testing results may be from measurements taken after the container assembly is subjected to ambient conditions of air at about 22.7° C. and about 0% relative humidity.

In some embodiments, the container assembly 406 may pass helium leak testing (e.g., according to DIN EN 1179 or ASTM E493) for high barrier packaging up to about $1\times10^{-7}$, for example.

Container Body

FIG. 18 is a top-front-side view of an example container body 60, top closure 61, and paper-based disc 50. In some embodiments, the container body 60 may comprise a rigid cylindrical container body having a sidewall 63 terminating in a bottom peripheral edge 205 at an open end. In such embodiments, the open end may comprise a bottom end 62 of the container body 60. In some embodiments, the open bottom end 62 may be sealed with a paper-based end closure (e.g., bottom closure 51). In some embodiments, the container body 60 may additionally have a second open end (e.g., the top end 68), opposite the open bottom end 62, which may be sealed with a flexible membrane or other closure (e.g., top closure 61).

In some cylindrical embodiments, the container body 60 may have an inner diameter within a range of about 3-16 cm (about 1-8 in.). For example, the container body 60 may have an inner diameter of about 7.315 cm (about 2.880 in.). In some cylindrical embodiments, the container body 60 may have an outer diameter within a range of about 3-20 cm (about 1-8 in.). For example, the container body 60 may have an inner diameter of about 7.630 cm (about 3.004 in.). The open bottom end 62 of the container body 60 may be circumscribed by a bottom peripheral edge 205 formed by the terminating edge of the sidewall 63 that forms the body of the container body 60. The sidewall 63 may include an interior surface 66 facing the container interior and an exterior surface 64 facing the outside of the container body 60. The interior surface 66 may be the product-facing side of the sidewall 63 of the container body 60. In some embodiments, the product(s) may be food products, and the interior surface 66 may include a food-safe layer, film, liner, and/or coating to help protect the integrity of the food product(s) to be contained within the container body 60. The exterior surface 64 may include printing or other applied graphics for labeling and/or advertising the product(s) to be contained within the container body 60.

In some embodiments, the sidewall 63 of the container body 60 may have a thickness (e.g., as measured from the interior surface 66 to the exterior surface 64 of the container body 60) within a range of about 0.05-0.2 cm (about 0.02-0.787 in.). For example, the sidewall 63 of the container body 60 may have a thickness of about 0.157 cm (0.062 in.).

As shown in FIG. 17C, in some embodiments, the rigid sidewall 63 of the container body 60 may include multiple layers, such as a paper-based layer 60*p*, a barrier layer 60*b*, an ionomer layer 60*i*, and/or a tie layer 60*t*, for example. Each component layer (paper-based layer 60*p*, a barrier layer 60*b*, ionomer layer 60*i*) may comprise a single layer or may comprise a plurality of layers.

The paper-based layer 60*p* may comprise a fiber-based and/or pulpable material, such as cardboard, paperboard, cupboard stock, and/or litho paper, for example. In some embodiments, the paper-based layer 60*p* of the container body 60 may have a total area weight within a range of about 200-600 $g/m^2$. In some embodiments, the paper-based layer 60*p* may have a thermal conductivity within the range of about 0.04-0.3 W/(mK).

The paper-based layer 60*p* may comprise a single layer or multiple layers joined by means of one or more adhesive tie layers (e.g., tie layer 60*t*). The tie layer 60*t* may be applied to one or more paper layers (or any layer discussed herein) using any adhesive tie laminating method known in the art (e.g., wet bond, solvent, solventless) and/or may be applied via thin-gauge extrusion, merely as examples. As used herein, the terms "tie layer" or "adhesive tie layer" may include adhesives as well as laminated extrusions.

In some embodiments, the tie layer 60*t* may include ionomer resin, polypropylene, polycarbonate, polyethylene (e.g., linear low-density polyethylene (LLDPE), low-density polyethylene (LDPE), high-density polyethylene (HDPE), medium-density polyethylene), polyethylene terephthalate (PET), polypropylene, polystyrene, polyvinyl chloride, metallocene catalyzed polyolefins, ethylene-methyl acrylate (EMA), and/or copolymers, coextrusions, and blends thereof.

The barrier layer 60*b* may act as a sufficient barrier to oxygen, moisture, and/or oil (e.g., mineral oil). In an embodiment, the barrier layer 60*b* may include a metal foil (e.g., aluminum foil) and/or a metallized film (e.g., metallized polyethylene, metallized polypropylene). For example, the barrier layer 60*b* may include a metal portion 60*bm* (e.g., an aluminized coating or film) with a thickness of about 0.5 μm (about 0.02 mil) disposed on a film portion 60*bf* (e.g., polyethylene terephthalate (PET), oriented polypropylene, and/or homopolymer/copolymer variations and combinations thereof). In an embodiment, the barrier layer 60*b* may comprise metalized polyethylene terephthalate (MPET) film, aluminum oxide (AlOx) coated polyethylene terephthalate (PET) film, aluminum foil, and/or metalized polybutylene terephthalate (MPBT) film, for example.

In some embodiments, the barrier layer 60*b* may have a thickness within the range of about 6-15 μm (about 0.2-0.6 mil). In some embodiments, the barrier layer 60*b* may have a thermal conductivity within the range of about 30-280 W/(mK).

In an embodiment, the ionomer layer 60*i* of the container body 60 may comprise a thermoplastic material suitable for forming a heat seal. In some embodiments, the ionomer layer 60*i* may be disposed throughout the entire interior surface 66 of the container body 60. In other embodiments, the interior surface 66 of the sidewall 63 may include an ionomer layer 60*i* disposed about the open bottom end 62 and/or open top end 68, but not necessarily throughout the entire interior surface 66 of the container body 60. In some embodiments, ionomer layer 60*i* may soften or melt under heat and seal the assembled bottom closure 51 to the container body 60. The ionomer layer 60*i* may be resistant to abrasion, in some embodiments.

The ionomer layer 60*i* may be heat-sealable within the temperature range of about 90-300° C., in some embodiments. The ionomer layer 60*i* may have a thermal conductivity within a range of about 0.3-0.6 W/(mK), in an embodiment. The ionomer layer 60*i* may comprise, for example, an ionomer-type resin, ionomers, ionomeric polymers, salts (e.g., sodium, zinc) of ethylene-methacrylic acid (EMAA), ethylene acrylic acid (EAA), ethylene-vinyl acetate (EVA), ethylene-methyl acrylate (EMA), ethylene-based graft copolymers and/or copolymers, coextrusions, and blends thereof. In some embodiments, ionomer layer 60*i* may include coextruded film structures, such as an ionomer/HDPE coextrusion, LDPE/HDPE coextrusion, and the like, for example.

In some embodiments, no ionomer layer 60*i* is disposed on the interior of the container body 60, such that the ionomer layer 50*i* of the paper-based disc 50 (discussed below) forms a seal directly with the barrier layer 60*b* of the sidewall 63 of the container body 60. Alternatively, the ionomer layer 60*i* of the interior surface 66 of the container body 60 may be a different grade from that of the ionomer layer 50*i* of the paper-based disc 50, such that the ionomer layer 50*i* of the paper-based disc 50 softens or melts to form a seal with the container body 60, but the ionomer layer 60*i* of the container body 60 does not soften or melt (e.g., due to higher melting temperature and/or different grade of ionomer).

In an embodiment, moving from the exterior surface 64 of the container body 60 inward, the paper-based layer 60*p* of the sidewall 63 may comprise an outer ply of paper (e.g., white). The paper-based layer 60*p* may comprise a coating, label ply, liner, or other material (not shown) on its exterior surface 64. In an embodiment, an ionomeric material may be disposed on the exterior surface 64 of the body 60. In this embodiment, the ionomeric material may or may not be heat-sealable. In this embodiment, the ionomeric material may or may be heat-sealed to anything. Advantageously, an ionomeric material applied to the exterior surface 64 of the body 60 may increase the strength and abrasion-resistance of the sidewall 63 of the container body 60. In an embodiment, the paper-based layer 60*p* may comprise one or more additional plies (not shown) of paper (e.g., brown cardboard, paperboard) immediately adjacent the outer ply of paper. As such, the paper-based layer 60*p* of the sidewall 63 of the container body 60 may be multi-ply. In some embodiments, a tie layer 60*t* may connect the plurality of paper-based layers 60*p* to one another and/or to the barrier layer 60*b*. The barrier layer 60*b* may have a thickness of about 0.0008 cm (about 0.0003 in.). In various embodiments, the barrier layer 60*b* may include single or multiple layers. For example, as shown in FIG. 17C, the barrier layer 60*b* comprises a metal portion 60*bm* (e.g., aluminum oxide) coated on a film portion 60*bf* (e.g., polyethylene terephthalate (PET) film). In some embodiments, the ionomer layer 60*i* may comprise ethylene acid copolymer having acid groups partially neutralized by zinc or sodium ions. Other configurations are also possible. Any combination of layers (paper, metal, and/or sealant) may be utilized in the container bodies of the present disclosure.

In some embodiments, the container body 60 may include a film, liner and/or coating of a polyethylene (e.g., low-density polyethylene (LDPE), linear low-density polyethylene (LLDPE), medium-density polyethylene, and/or mixtures thereof) on the interior surface 66 and/or exterior surface 64 of the container body 60.

Bottom Closure

In some embodiments, the paper-based disc 50 of the present disclosure may be a paper-based end closure. In some embodiments, the paper-based disc 50 may be a generally flat circle, sized to overlay the circumference of the open bottom end 62 of the container body 60. In some embodiments, the paper-based disc 50 may be pre-stamped and/or pre-formed with specific structural features (not shown). The stamping and/or pressing process may include feeding flat closure material into a die press (e.g., stamping press) and compressing the material between opposing dies. In either case, in embodiments with cylindrical container bodies, the rotational/circumferential orientation of the paper-based disc 50 relative to the container body 60 may be ignored where the container body 60 and paper-based disc 50 are uniform throughout all angles of rotation. Other shapes (e.g., rectangular, polygon with extended side) are possible, however.

Figure 2:
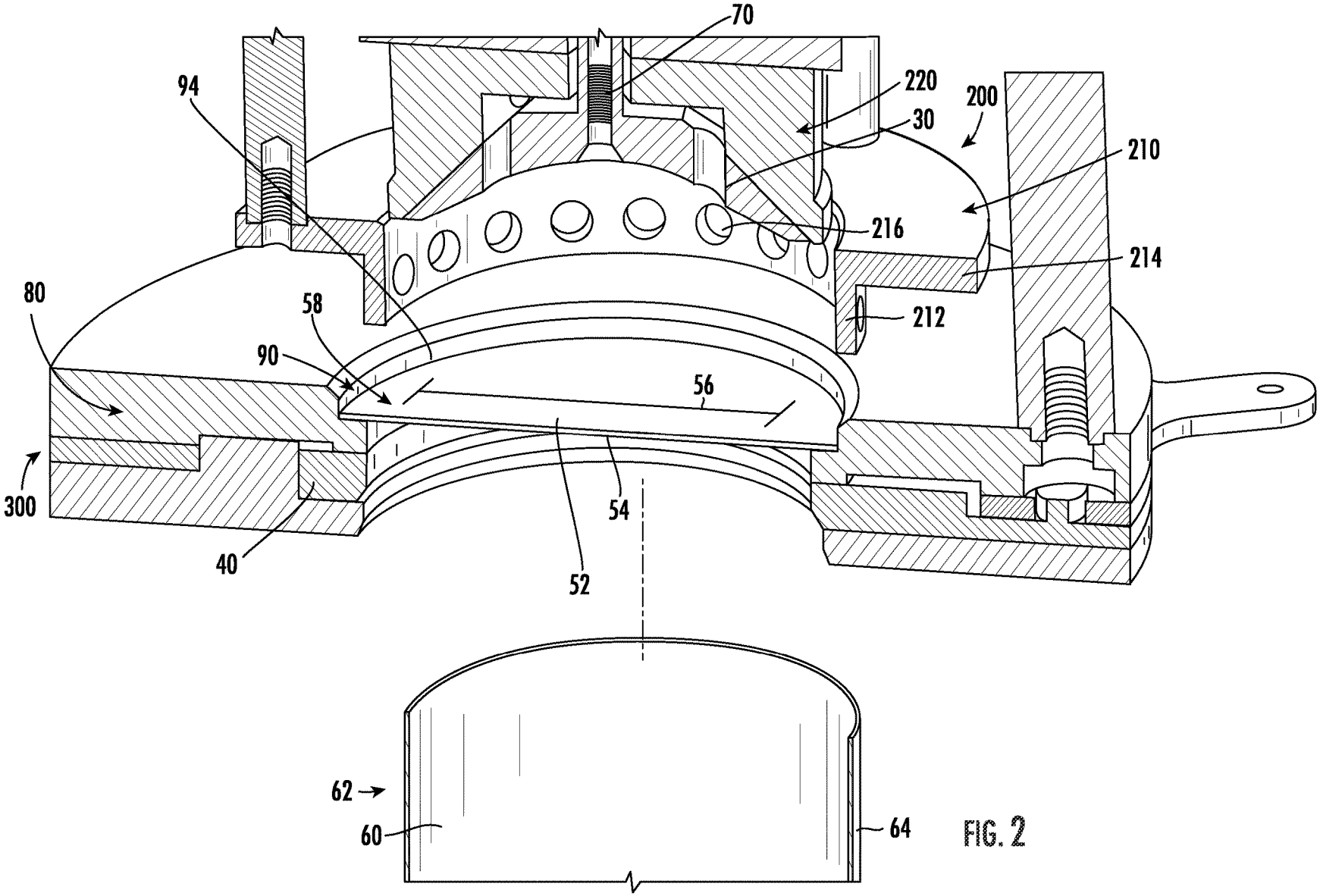
FIG. 2 illustrates a cross-section of an exemplary sealing system, in accordance with some embodiments of the present disclosure.

As discussed herein, the interior-facing 54 and exterior-facing 52 sides of the bottom closure 51 (also referred to herein as the lower surface 54 and the upper surface 52 of the paper-based layer 50*p*, respectively, as shown in an upside down configuration in FIG. 2) will be referred to in the context of the orientation of the paper-based disc 50 when applied to the open bottom end 62 of the container body 60. Here, as shown in FIG. 17, the container body 60 is oriented with respect to the paper-based disc 50 with the bottom peripheral edge 205 of the open bottom end 62 of the container body 60 facing downward so as to face the interior-facing side 54 of the paper-based disc 50. The interior-facing side 54 of the disc 50 faces upward and the exterior-facing side 52 of the paper-based disc 50 faces downward. In embodiments where the open end of the container body 60 is the bottom of the container body 60, the exterior-facing side 52 of the paper-based disc 50 would thus be facing downward when the container assembly 406 is oriented upright. It should be understood that other orientations not depicted in the present disclosure are possible for applying the paper-based disc 50 to the container body 60, but the exterior-facing side 52 of the paper-based disc 50 may be that which faces outside (e.g., away from the container interior) when assembled as part of the end product container assembly 406 (e.g., as shown in FIG. 19), and the interior-facing side 54 is that which faces the product(s) inside the container interior when assembled as part of the end product container assembly 406.

While the paper-based disc 50 may primarily comprise paper and/or other fiber-based material, it may also contain non-fiber barrier layers made from metal and/or a polymeric material in an embodiment. In some embodiments, the disc 50 may comprise multiple layers of paper, barrier material, and/or ionomeric material.

As shown in FIG. 17D, in some embodiments, the paper-based disc 50 may include a paper-based layer 50*p*, a barrier layer 50*b*, an ionomer layer 50*i*, and/or a tie layer 50*t*, for example. The paper-based layer 50*p* may form the exterior-facing side 52 of the paper-based disc 50. The tie layer 50*t* may adhere the paper-based layer 50*p* to the barrier layer 50*b*. The ionomer layer 50*i* may be disposed adjacent the barrier layer 50*b* (opposite the paper-based layer 50*p*) to form the interior-facing side 54 of the paper-based disc 50.

The paper-based layer 50*p* may comprise a fiber-based and/or pulpable material, such as cardboard, paperboard, cupboard stock, and/or litho paper, for example. For example, in some embodiments, the paper-based disc 50 may be cupstock and/or paperboard coated with a liner and/or layer of a polyethylene (e.g., low-density polyethylene (LDPE), linear low-density polyethylene (LLDPE), medium-density polyethylene, and/or mixtures thereof). The paper-based layer 50*p* may comprise a single layer or multiple layers joined by means of one or more adhesive tie layers (e.g., tie layer 50*t*).

As discussed above with regard to the container body 60, the tie layer 50*t* may comprise any material and may be applied via any method known in the art. In some embodiments, the tie layer 50*t* may include ionomer resin, polypropylene, polycarbonate, polyethylene (e.g., linear low-density polyethylene (LLDPE), low-density polyethylene (LDPE), high-density polyethylene (HDPE), medium-density polyethylene), polyethylene terephthalate (PET), polypropylene, polystyrene, polyvinyl chloride, metallocene catalyzed polyolefins, ethylene-methyl acrylate (EMA), and/or copolymers, coextrusions, and blends thereof.

The barrier layer 50*b* may act as a sufficient barrier to oxygen, moisture, and/or mineral oil. The barrier layer 50*b* may include a metal foil (e.g., aluminum foil) and/or a metallized film (e.g., metallized polyethylene, metallized polypropylene). For example, the barrier layer 50*b* may include a metal portion 50*bm* (e.g., an aluminized coating or film) with a thickness of about 0.5 μm disposed on a film portion 50*bf* (e.g., polyethylene terephthalate (PET), oriented polypropylene, and/or homopolymer/copolymer variations and combinations thereof). In some embodiments, the barrier layer 50*b* may comprise metalized polyethylene terephthalate (MPET) film, aluminum oxide (AlOx) coated polyethylene terephthalate (PET) film, aluminum foil, and/or metalized polybutylene terephthalate (MPBT) film, for example.

In some embodiments, the barrier layer 50*b* may have a thickness within the range of about 6-15 μm. The barrier layer 50*b* may be a metal (e.g., aluminum) foil with a thickness of about 0.0008 cm (about 0.0003 in.). In some embodiments, the barrier layer 50*b* may have a thermal conductivity within the range of about 30-280 W/(mK).

The ionomer layer 50*i* of the paper-based disc 50 may comprise a thermoplastic material suitable for forming a heat seal. The thermoplastic material may be heat-sealable within the temperature range of about 90-300° C. The thermoplastic material of the ionomer layer 50*i* may include an ionomer-type resin, ionomers, ionomeric polymers, salts (e.g., sodium, zinc) of ethylene-methacrylic acid (EMAA), ethylene acrylic acid (EAA), ethylene-vinyl acetate (EVA), ethylene-methyl acrylate (EMA), ethylene-based graft copolymers, and/or copolymers, coextrusions, and blends thereof, for example. In some embodiments, thermoplastic material may include coextruded film structures, such as an ionomer/HDPE coextrusion, LDPE/HDPE coextrusion, and the like, for example. The ionomer layer 50*i* may be resistant to abrasion, in some embodiments.

In a particular embodiment, the paper-based layer 50*p* of the paper-based disc 50 may comprise two plies (not shown) of paper. In some embodiments, a tie layer 50*t* may adhere the one or more paper-based layers 50*p* to one another and/or to the barrier layer 50*b*. In an embodiment, the ionomer layer 50*i* may comprise ethylene acid copolymer having acid groups partially neutralized by zinc or sodium ions. The ionomer layer 50*i* may be disposed on the barrier layer 50*b* and/or on the exterior-facing side 52 of the paper-based disc 50. Other configurations are also possible.

In embodiments in which the barrier layer 50*b* is a single layer of metal foil, the metal foil layer may be coated with a heat-sealable material (e.g., the ionomer layer 50*i*). In such embodiments, the metal foil layer may aid in induction heating or thermo transfer heating, causing the heat-sealable material to soften and/or melt and seal the bottom closure 51 to the container body 60.

The ionomer layer 60*i* of the container body 60 and/or the ionomer layer 50*i* of the bottom closure 51 may be heated to form a heat seal between the container body 60 and the bottom closure 51. In some embodiments, the ionomer layer 60*i* of the container body 60 and the ionomer layer 50*i* of the bottom closure 51 may have compatible chemistry (e.g., same or similar grade of ionomer), such that an acceptable seal can be formed when heat-sealed during assembly. In some embodiments, the ionomer layer 60*i* of the container body 60 and the peelable sealant layer 61*i* of the top closure 61 may have compatible chemistry (e.g., same or similar grade of ionomer), such that an acceptable seal can be formed when heat-sealed during assembly.

In some embodiments, the ionomer layer 50*i* may be disposed on the interior-facing side 54 of the paper-based disc 50 only around the outer periphery of the disc 50, where the paper-based disc 50 is configured to contact the interior surface 66 of the container body 60 (e.g., within the second deformed surface 55). In other embodiments, the ionomer layer 50*i* may be applied to the entire interior-facing side (e.g., the lower surface 54 in FIG. 2) of the paper-based disc 50.

In some embodiments, after insertion, the disc 50 may have a second deformed surface 55 (e.g., as shown in FIG.

18) which may be configured to be pressed against the interior surface 66 of the sidewall 63 of the container body 60 when inserted into the open bottom end 62 of a container body 60. The seal area between the second deformed surface 55 of the bottom closure 51 and the interior surface 66 of the container body 60 may be sized to provide a hermetic seal. The seal area may also be sufficient to allow any wrinkles that could result in channels to be ironed out or minimized. In some embodiments, the seal area may be within a range of about 5-15 $cm^2$ (about 1-2 $in^2$). For example, the seal area may be about 11.9 $cm^2$ (about 1.85 $in^2$).

Advantageously, in some embodiments, the combined thickness of the ionomer layer 50*i* of the bottom closure 51 and the ionomer layer 60*i* of the container body 60 may be sufficiently large such that any food product and/or other debris present between the ionomer layers 50*i*, 60*i* may be entrapped and/or completely encapsulated without compromising the resulting seal strength. In some embodiments, the thickness of ionomer layer 50*i* of the paper-based disc 50 may be within the range of about 8-50 μm. In some embodiments, the thickness of ionomer layer 60*i* of the sidewall 63 of the container body 60 may be within the range of about 2-40 μm.

In some embodiments, the hermetic seal formed between ionomer layer 50*i* of the bottom closure 51 and the ionomer layer 60*i* of the container body 60 may have a leakage rate less than or equivalent to a hole with a diameter within a range of about 10-300 μm, for example, when measured by the vacuum decay method (e.g., according to DIN EN 1779/ASTM test method E493). The vacuum decay method may determine the equivalent hole diameter of the hermetic seal by coating the non-sealed portions of the container assembly 406 with a substance that inhibits leakage. Other testing methods may be utilized, including bubble leak, blue dye, and/or helium leak testing, for example.

As shown in FIG. 18, the bottom closure 51 may be recessed inside the container body 60 such that a first deformed surface 53 of the bottom closure 51 is spaced away from (e.g. recessed within) the bottom peripheral edge 205 of the container body 60. The bottom closure 51 may be recessed into the container body 60 at a predetermined recessed distance "Dr". The recessed distance "Dr" may be measured from the bottom peripheral edge 205 of the container body 60 to the first deformed surface 53 of the bottom closure 51. In some embodiments, the recessed distance "Dr" may be within a range of about 0.2-2 cm (about 0.08-1.2 in.). For example, the recessed distance "Dr" may be about 0.7 cm (about 0.275 in.). The recessed distance "Dr" may be configured to minimize any protrusion of the first deformed surface 53 of the bottom closure 51 past the bottom peripheral edge 205 of the container body 60 when the container assembly 406 is exposed to higher pressure differentials between the container interior and external environment. For example, example testing has shown that the depth of the recessed distance "Dr" of the bottom closure 51 may ensure that bottom closure 51 will not over inflate past the bottom peripheral edge 205 of the container body 60 at pressure differentials exceeding about 10 inHg (~34 kPa). These test results may be based on measurements made using various pressure differential methods (e.g., according to ASTM test method D6653). In this way, the recessed distance "Dr" combined with the integrity of the hermetic seal may help prevent rocking and/or other issues the bottom closure 51.

In some embodiments, the paper-based disc 50 may have a density of about 1-2.5 $g/m^3$. In some embodiments, the paper-based disc 50 may have a modulus of elasticity of about 10-35 GPa. In some embodiments, the paper-based layer 50*p* may have a thermal conductivity within the range of about 0.04-0.3 W/(mK). The paper-based layer 50*p* of the bottom closure 51 may have a total area weight within the range of about 130-450 $g/m^2$.

Top Closure

As shown in FIG. 17A, the top closure 61 may be a flat sheet shaped (e.g., as a disc) to fit over the open top end 68 of the container body 60. The top closure 61 may have an exterior-facing side 610 (shown facing upward in FIG. 17A) and an interior-facing side 611 (shown facing downward in FIG. 17A). When the top closure 61 is applied to the top rim of the container body 60, the interior-facing side 611 is configured to seal to the top rim of the container body 60 and face the container interior.

As shown in FIG. 17B, in some embodiments, the top closure 61 may include multiple layers, such as a paper-based layer 61*p*, a barrier layer 61*b*, a peelable sealant layer 61*i* (which may be an ionomeric material in some embodiments), and/or a tie layer 61*t*, for example. The paper-based layer 61*p* may form the exterior-facing side 610 of the top closure 61. The tie layer 61*t* may adhere the paper-based layer 61*p* to the barrier layer 61*b*. The peelable sealant layer 61*i* may be adhered to or coated onto the barrier layer 61*b* to form the interior-facing side 611 of the top closure 61.

The paper-based layer 61*p* may comprise a fiber-based and/or pulpable material, such as cardboard, paperboard, cupboard stock, and/or litho paper, for example. In some embodiments, the paper-based layer 61*p* may have a thermal conductivity within the range of about 0.04-0.3 W/(mK). The paper-based layer 61*p* may comprise a single layer or multiple layers joined by means of one or more adhesive tie layers (e.g., tie layer 61*t*).

As noted above, the tie layer 61*t* may utilize any adhesive tie compositions or method known in the art. In some embodiments, the tie layer 61*t* may include ionomer resin, polypropylene, polycarbonate, polyethylene (e.g., linear low-density polyethylene (LLDPE), low-density polyethylene (LDPE), high-density polyethylene (HDPE), medium-density polyethylene), polyethylene terephthalate (PET), polypropylene, polystyrene, polyvinyl chloride, metallocene catalyzed polyolefins, ethylene-methyl acrylate (EMA), and/or copolymers, coextrusions, and blends thereof.

The barrier layer 61*b* may act as a sufficient barrier to oxygen, moisture, and/or mineral oil. The barrier layer 61*b* may include a metal foil (e.g., aluminum foil) and/or a metallized film (e.g., metallized polyethylene, metallized polypropylene). For example, the barrier layer 61*b* may include a metal portion 61*bm* (e.g., an aluminized coating or film) with a thickness of about 50 μm disposed on a film portion 61*bf* (e.g., polyethylene terephthalate (PET), oriented polypropylene, and/or homopolymer/copolymer variations and combinations thereof). The barrier layer 61*b* may comprise metalized film, such as metalized polyethylene terephthalate (MPET) film, aluminum oxide (AlOx) coated polyethylene terephthalate (PET) film, aluminum-coated polyethylene terephthalate (PET) film, and/or metalized polybutylene terephthalate (MPBT) film, for example. In some embodiments, the barrier layer 61*b* may include vacuum-deposited aluminum adjacent to the peelable sealant layer 61*i*.

In some embodiments, the barrier layer 61*b* may have a thickness within the range of about 4-20 μm. In some embodiments, the barrier layer 61*b* may have a thermal conductivity within the range of about 40-280 W/(mK).

The peelable sealant layer 61*i* may comprise any peelable sealant known in the art to secure top membrane closures to container bodies. For example, the peelable sealant layer 61*i* may be a polyethylene-based sealant and/or an ionomer-resin (e.g., SURLYN® polymer). In some embodiments, the peelable sealant layer 61*i* of the top closure 61 may have a thickness within the range of about 10-50 μm.

The top closure 61 may be sealed to the top rim of the container body 60 via peelable sealant layer 61*i*. In some embodiments, the peelable sealant layer 61*i* may be modified with a polymer material to promote additional adhesion to the container body 60. In certain embodiments, the peelable sealant layer 61*i* may comprise a resealable material such that the container may be reclosable.

The peelable sealant layer 61*i* may provide a consumer-friendly opening mechanism. In some embodiments, the top closure 61 may be shaped to facilitate removal from the container assembly 406, such as via a pull-tab. In some embodiments, an overcap (not shown) may be configured for removal and reattachment to the container body 60 before and after the membrane seal is removed, respectively.

EXAMPLE EMBODIMENTS

In some embodiments, the sidewall 63 of the container body 60 may comprise a paper-based layer 60*p* adhered to a barrier layer 60*b* of metalized polyethylene terephthalate (MPET) film via an adhesive tie layer 60*t*. Adjacent the barrier layer 60*b*, an ionomer layer 60*i* may be formed.

In some embodiments, the sidewall 63 of the container body 60 may comprise a paper-based layer 60*p* adhered to a barrier layer 60*b* of aluminum oxide (AlOx) coated polyethylene terephthalate (PET) film via an adhesive tie layer 60*t*. The film may be transparent in this embodiment. Adjacent and adhered to the barrier layer 60*b*, an ionomer layer 60*i* may be formed.

In some embodiments, the sidewall 63 of the container body 60 may comprise a paper-based layer 60*p* adhered to a barrier layer 60*b* of aluminum foil via an adhesive tie layer 60*t*. Adjacent and adhered to the barrier layer 60*b*, an ionomer layer 60*i* may be formed. In this embodiment, the ionomer may be applied as a film rather than a coating.

In some embodiments, the sidewall 63 of the container body 60 may comprise a paper-based layer 60*p* adhered to a barrier layer 60*b* of metalized polybutylene terephthalate (MPBT) film via an adhesive tie layer 60*t*. Adjacent and adhered to the barrier layer 60*b*, an ionomer layer 60*i* may be formed.

In some embodiments, the paper-based disc 50 may comprise a paper-based layer 50*p* of cupstock adhered to a barrier layer 50*b* of metalized polyethylene terephthalate (MPET) film via an adhesive tie layer 50*t*. Adjacent the barrier layer 50*b*, an ionomer layer 50*i* may be formed.

In some embodiments, the paper-based disc 50 may comprise a paper-based layer 50*p* of cupstock adhered to a barrier layer 50*b* of aluminum oxide (AlOx) coated polyethylene terephthalate (PET) film via an adhesive tie layer 50*t*. Adjacent and adhered to the barrier layer 50*b*, an ionomer layer 50*i* may be formed.

In some embodiments, the paper-based disc 50 may comprise a paper-based layer 50*p* of cupstock adhered to a barrier layer 50*b* of aluminum foil via an adhesive tie layer 50*t*. Adjacent and adhered to the barrier layer 50*b*, an ionomer layer 50*i* may be formed.

In some embodiments, the paper-based disc 50 may comprise a paper-based layer 50*p* of cupstock adhered to a barrier layer 50*b* of metalized polybutylene terephthalate (MPBT) film via an adhesive tie layer 50*t*. Adjacent and adhered to the barrier layer 50*b*, an ionomer layer 50*i* may be formed.

In some embodiments, the top closure 61 may comprise a paper-based layer 61*p* adhered to a barrier layer 61*b* of metalized polyethylene terephthalate (MPET) film via an adhesive tie layer 61*t*. Adjacent the barrier layer 61*b*, a peelable sealant layer 61*i* may be formed.

In some embodiments, the top closure 61 may comprise a paper-based layer 61*p* adhered to a barrier layer 61*b* of aluminum oxide (AlOx) coated polyethylene terephthalate (PET) film via an adhesive tie layer 61*t*. Adjacent and adhered to the barrier layer 61*b*, a peelable sealant layer 61*i* may be formed.

In some embodiments, the top closure 61 may comprise a paper-based layer 61*p* adhered to a barrier layer 61*b* of aluminum-coated polyethylene terephthalate (PET) film via an adhesive tie layer 61*t*. Adjacent and adhered to the barrier layer 61*b*, a peelable sealant layer 61*i* may be formed.

In some embodiments, the top closure 61 may comprise a paper-based layer 61*p* adhered to a barrier layer 61*b* of metalized polybutylene terephthalate (MPBT) film via an adhesive tie layer 61*t*. Adjacent and adhered to the barrier layer 61*b*, a peelable sealant layer 61*i* may be formed.

Below, an exemplary sealing system for sealing a paper-based end closure, as described herein, to a paper-based container body, as described herein, is more fully explained and described.

The Sealing System

Figure 10:
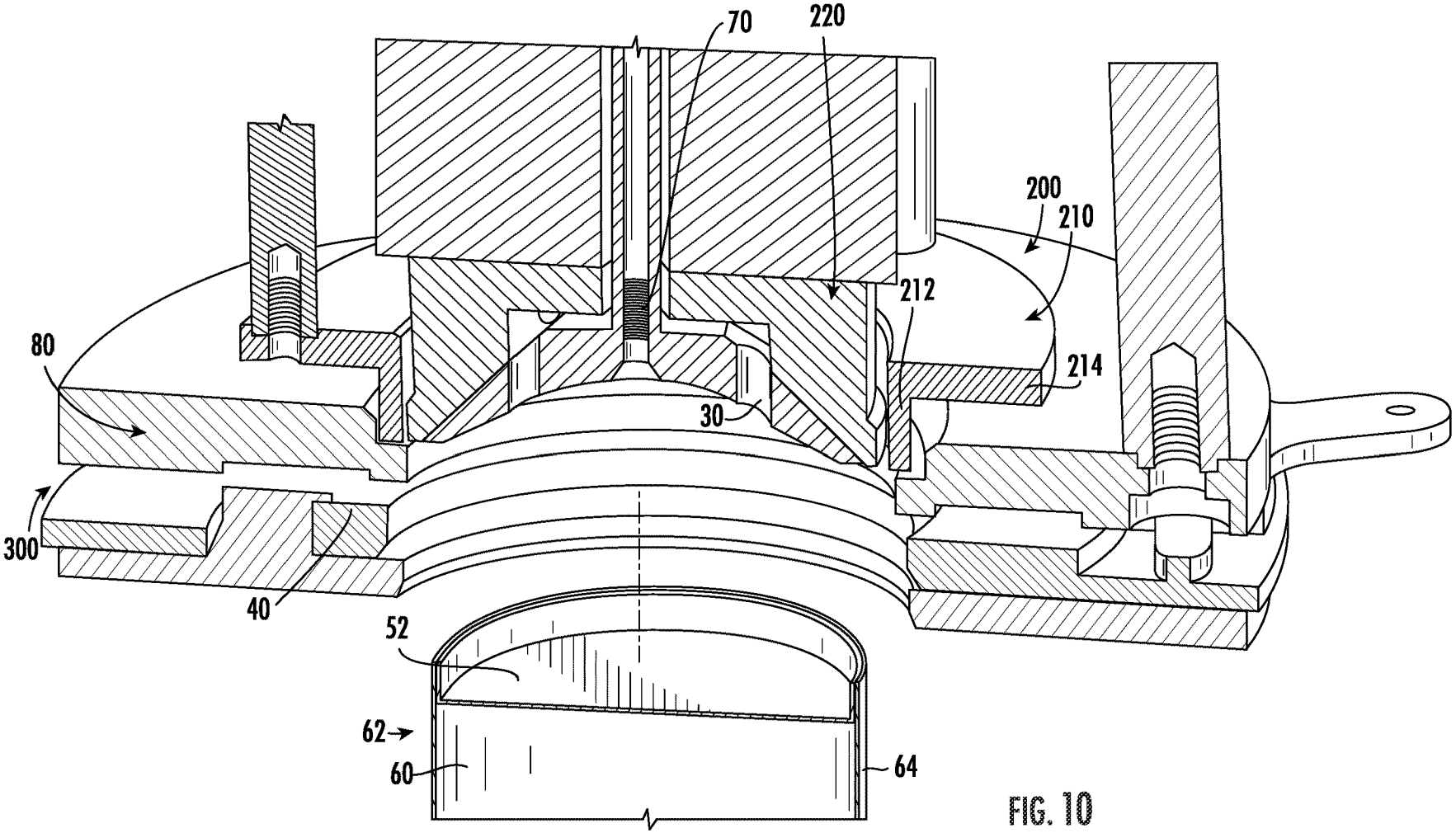
FIG. 10 illustrates a cross-section of an exemplary sealing system, in accordance with some embodiments of the present disclosure.
Figure 11:
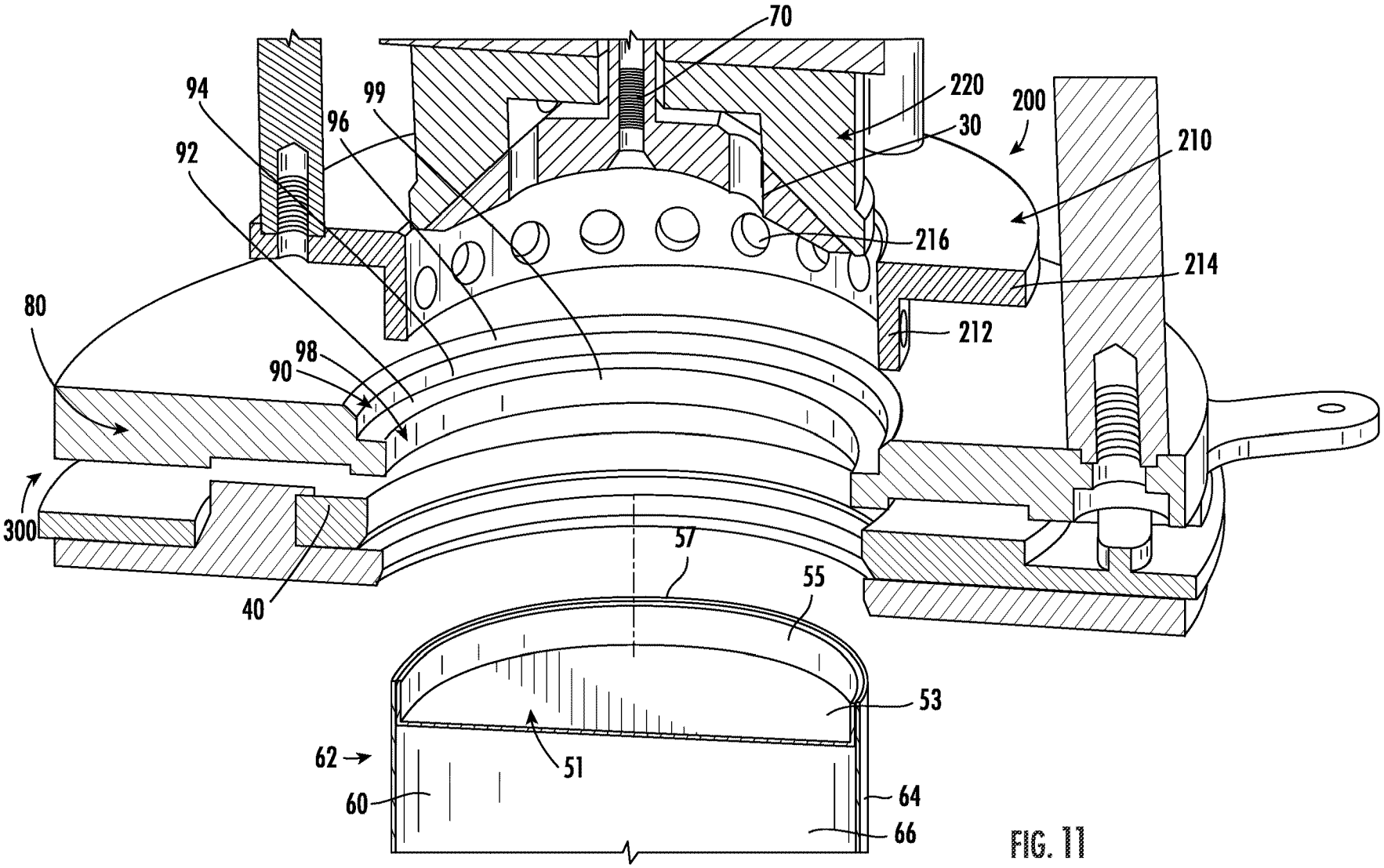
FIG. 11 illustrates a cross-section of an exemplary sealing system, in accordance with some embodiments of the present disclosure.

Referring to FIGS. 1-11, the containers described herein may be formed using the following sealing systems 100 and/or according to the following methods. In some embodiments, the paper-based bottom may begin as a sheet or disc. For example, a composite sheet or paper-based disc 50 may be shaped to conform to a composite container body 60 via a mandrel assembly 200, a die assembly 300, and a container support assembly (not shown) operating in cooperation. The mandrel assembly 200 may be utilized to stamp or press a paper-based disc 50 to form it into a composite bottom 51 (e.g., as shown in FIG. 10-11).

The mandrel assembly 200 may include an outer mandrel 210 (sometimes referred to as a "downholder" due to its purpose of holding the disc 50 downwardly, against the die assembly 300) and an inner mandrel 220 (sometimes referred to as a "sealing punch" due to its purpose of punch drawing the disc 50 into a container 60 and sealing the disc 50 against the sidewall of the container 60). The outer mandrel 210 and inner mandrel 220 may each move along the Y-axis independent of one another. The inner mandrel 220 may translate with respect to the outer mandrel 210 to form a paper-based disc 50 into a bottom closure 51. Further, the die assembly 300 may cooperate with the mandrel assembly 200 to shape the paper-based disc 50 into the bottom closure 51, simultaneously or nearly simultaneously inserting the closure 51 into the bottom end 62 of a composite body 60. The die assembly 300 may generally comprise a die 80 having a top surface 97, a positioning portion 90, a die opening 98 and sealing member(s) 40, also known as the die bush ring. The tube assembly may be configured to retain and move the composite body 60, relative to the mandrel assembly 200 and die assembly 300. For example, the tube assembly may move the composite body laterally to align the axis of the container body 60 with the axis of the mandrel assembly 200 and die assembly 300 and/or vertically along the axis of the mandrel assembly 200 and die assembly 300.

In some embodiments, the mandrel assembly 200, the die assembly 300, and the container support assembly may be aligned along the Y-axis, at least during the methods described herein, such that a paper-based disc 50 may be urged through the die opening 98 by the inner mandrel 220 and inserted into the bottom end 62 of a composite body 60 held by the tube support member.

The Die Assembly

The die assembly 300 may be configured to receive and retain the paper-based disc 50 prior to insertion of the disc 50 through the die opening 98 and into the container body 60. In some embodiments, the disc 50 is received from a separate disc feeding assembly (not shown). In an embodiment, the die assembly 300 may be configured to mate or otherwise align with the feeding assembly. For example, the die 80 may comprise notches, ridges, or other alignment features 302 on its upper end which allow it to mate with, align with, or receive a corresponding mechanical element of the feeding assembly. This allows for proper placement of the disc 50 within the die 80.

More specifically, the die assembly 300 may comprise a die 80 (i.e., die bush ring) having a positioning portion 90 (i.e., collet seat), configured to accept and align a paper-based disc 50 within the die 80 prior to forming the disc 50 into a recessed bottom end closure 51. The positioning portion 90 may be disposed adjacent the die opening 98 in order to align a paper-based disc 50 with the die opening 98.

The positioning portion 90 may comprise a sloped surface 96 that connects a top surface 97 of the die 80 to a sidewall 94 of the positioning portion 90. The sloped surface 96 may slope downward, toward the die opening 98 and axis of the die assembly 300. In some embodiments, the sloped surface 96 may allow the disc 50 to be guided into the positioning portion 90.

The sidewall 94 of the positioning portion 90 may be vertical or substantially vertical, in some embodiments. The sidewall 94 of the positioning portion 90 may be longer than the thickness of the disc 50, in some embodiments. The outer diameter of the sidewall 94 of the positioning portion 90 may be substantially similar to the diameter of the disc 50, in some embodiments. In another embodiment, the outer diameter of the sidewall 94 of the positioning portion 90 may be slightly larger than the diameter of the disc 50.

In some embodiments, the sloped surface 96 of the positioning portion 90 may have a larger perimeter nearest to the top surface 97 of the die 80 and a smaller perimeter nearest to sidewall 94. In some embodiments, the circumference of the outer edge of the sloped surface 96 of the positioning portion 90 may be larger than the paper-based disc 50. The sloped surface 96 may be tapered downward to allow gravitational assistance for the alignment of the paper-based disc 50 within the positioning portion 90. Once seated, the paper-based disc 50 may be positioned adjacent the disc support surface 92 and the sidewall 94 of the positioning portion 90. In some embodiments, the disc support surface 92 and the sidewall 94 of the positioning portion 90 connect at a ninety-degree angle or substantially a ninety-degree angle. In some embodiments, the disc support surface 92 may be horizontal or substantially horizontal. In some embodiments, the seated disc 50 is positioned such that its lower surface 54 (e.g., as shown in FIG. 2) is adjacent (e.g., seated atop) the disc support surface 92. In some embodiments, the seated disc 50 is positioned such that its thickness is adjacent the sidewall 94 of the positioning portion 90.

In some embodiments, the inner circumference of the disc support surface 92 is smaller than the circumference of the disc 50. In some embodiments, the inner circumference of the disc support surface 92 adjacent the die opening 98. In some embodiments, the disc support surface 92 is disposed adjacent a die opening inner surface 99. The die opening inner surface 99 may be vertical or substantially vertical, in some embodiments. In some embodiments, the disc support surface 92 is disposed at a right angle or a nearly right angle to the die opening inner surface 99.

In use, a disc 50 is inserted into the die assembly 300, positioned within the positioning portion 90, and seated on the disc support surface 92. In some embodiments, vacuum pressure may be applied to the paper-based disc 50, from underneath, to align it within the positioning portion 90 of the die 80.

While the die opening 98 is depicted as having a substantially circular cross-section, the die opening 98 may have a cross-section that is substantially circular, triangular, rectangular, quadrangular, pentagonal, hexagonal or elliptical. In some embodiments, the die opening 98 may be configured to accept the inner mandrel 220, discussed below. In some embodiments, the die opening 98 may have a substantially similar cross-section as that of the inner mandrel 220.

The Gas Evacuation Assembly

In some embodiments, a gas evacuation assembly 400 is included in the present system. In some embodiments, the gas evacuation assembly 400 is disposed at least partially within the die assembly 300. The gas evacuation assembly 400 may be designed to suction or vacuum a defined volume of gas out of the container interior prior to or simultaneously with insertion of the disc 50 into the container body 60.

The gas evacuation assembly 400 may comprise one or more valves 420 which are integral in the die assembly 300. In some embodiments, the valves 420 are disposed within the die 80. More particularly, there may be a port or a bore 82 through the interior of the die 80 which connects the die outer surface 89 to an internal channel 430. The valve 420 may be disposed within said port or bore 82. The port or bore 82 may connect the internal channel 430 to an upper surface of the die, a lower surface of the die, or a side/lateral surface of the die. That is the valve(s) 420 may extend laterally within the die and/or may extend vertically upwardly or downwardly within the die.

In some embodiments, the bore 82 may be configured generally horizontally within the die 80. In some embodiments, the bore 82 may be disposed in an upper section 87 of the die 80. In some embodiments, at least a portion of the bore 82 and valve 420 may be disposed above the channel 430. In some embodiments, the valve 420 may have an opening that is directed downward, within the bore 82, toward the channel 430. That is, there may be direct gaseous communication between the valve 420 and the channel 430. In some embodiments, air may be suctioned from the channel 430 via the valve 420.

In some embodiments, the valve 420 may comprise any suction or vacuum valve known in the art. In some embodiments, the valve 420 may have an open position and a closed position. In the open position, the valve 420 may allow the exchange of gasses and in the closed position, the valve 420 may not allow exchange of gasses. In some embodiments, the valve 420 may comprise an elongated tube or pipe that extends generally horizontally or vertically through the upper section 87 of the die 80 with a through hole 422 disposed at its proximal end (with reference to the interior of the die 80). In this embodiment, the through hole 422 may be disposed adjacent the internal channel 430. In some embodiments, the through hole 422 may be disposed directly above at least a portion of the internal channel 430.

In some embodiments, a manifold connection 426 may connect the bore 82 and the channel 430. In some embodiments, the through hole 422 may connect to and communicate with the internal channel 430. The through hole 422 may take any shape known in the art. In an exemplary embodiment, the through hole 422 is circular, but may be ovular, square, rectangular, or any other shape known in the art.

The internal channel 430 may be hollow, in some embodiments. The channel 430 may be shaped or configured as desired, but in some embodiments, may be square, rectangular, circular, or semi-circular in cross-section. The channel 430 may be disposed circumferentially or partially circumferentially within the die 80, in some embodiments. In a particular embodiment, the channel 430 may comprise a recessed portion of the upper section 87 of the die 80. In this embodiment, the channel 430 may comprise at least one sidewall 432. In some embodiments, the channel 430 may comprise two opposing sidewalls 432, 434 and a top wall 436. In some embodiments, the bottom wall of the channel 430 may comprise the top surface 42 of the sealing member(s) 40. That is, if the upper section 87 of the die 80 were separated from the sealing member(s) 40, the channel 430 would have an open bottom end.

The channel 430 may have one or more channel openings 440 disposed between the channel 430 and the die opening inner surface 99. In some embodiments, the channel openings 440 are disposed laterally inward of the channel 430, nearer to the central axis of the container 60 which will be sealed. In some embodiments, the channel openings 440 may connect the channel 430 to the interior of the die 80 such that gasses may be exchanged therebetween. That is, the channel openings 440 may provide for gaseous communication between the channel 430 and the interior of the die 80. The channel openings 440 may be shaped as desired, but in some embodiments, may be square, rectangular, circular, ovular or semi-circular in cross-section. In a particular embodiment, the opening 440 into the interior of the die 80 may be square or rectangular. The number, size, and arrangement of the channel openings 440 may vary based upon the amount of gas that must be evacuated.

In an embodiment, the channel 430 may comprise a single channel opening 440. The channel opening 440 may extend circumferentially, between the channel 430 and the die opening inner surface 99. In an embodiment, the channel opening 440 may extend partially or fully circumferentially about the die 80.

In other embodiments, the channel 430 may comprise a plurality of channel openings 440. For example, six channel openings 440 may be utilized in some embodiments. The channel openings 440 may vary in size, one to another. The channel openings 440 may be spaced equidistance from each other or may be spread out in any other manner known in the art. In an embodiment, the channel openings 440 may be disposed on only one side of the die assembly.

Figure 33:
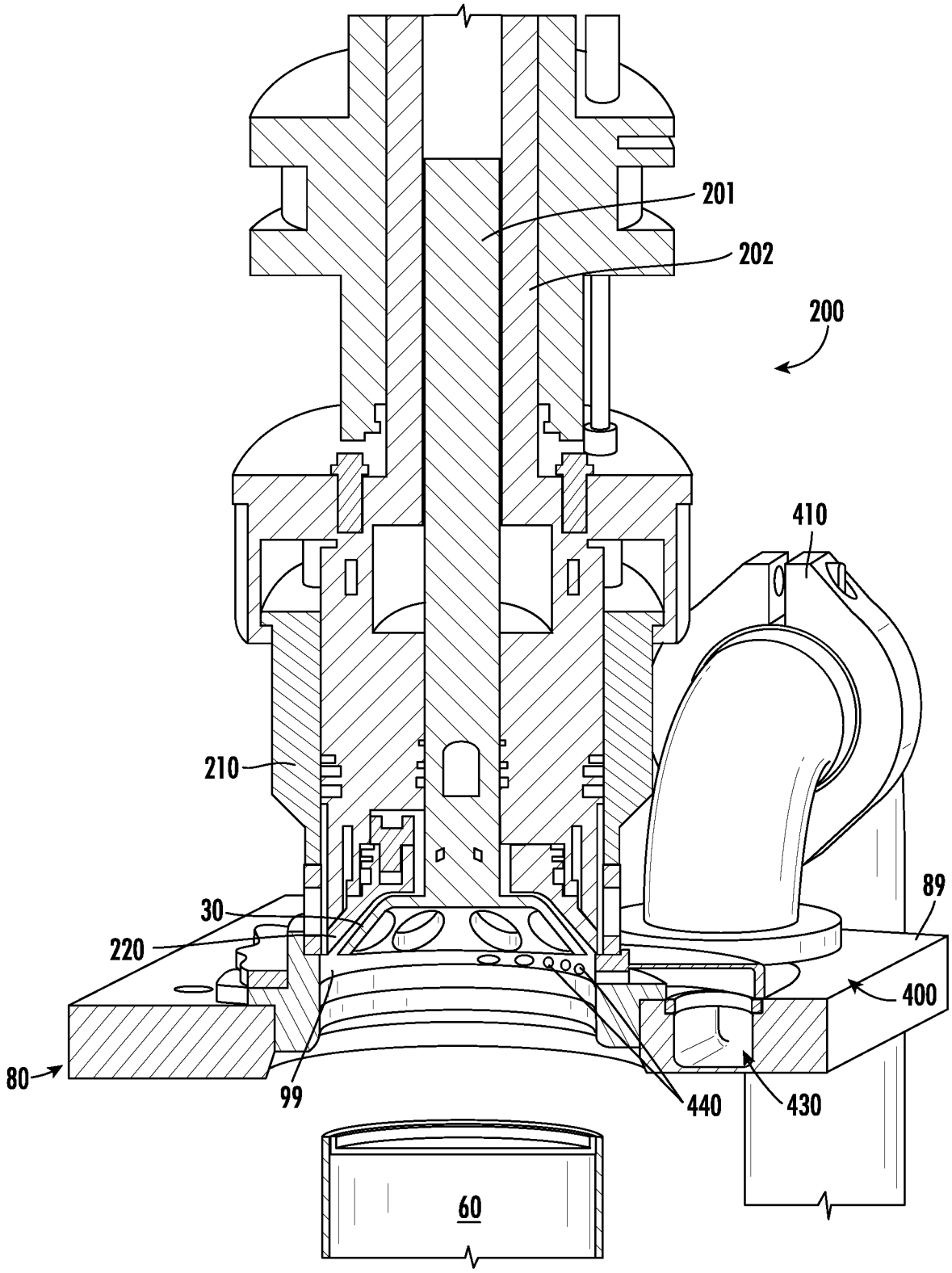
Figure 34:
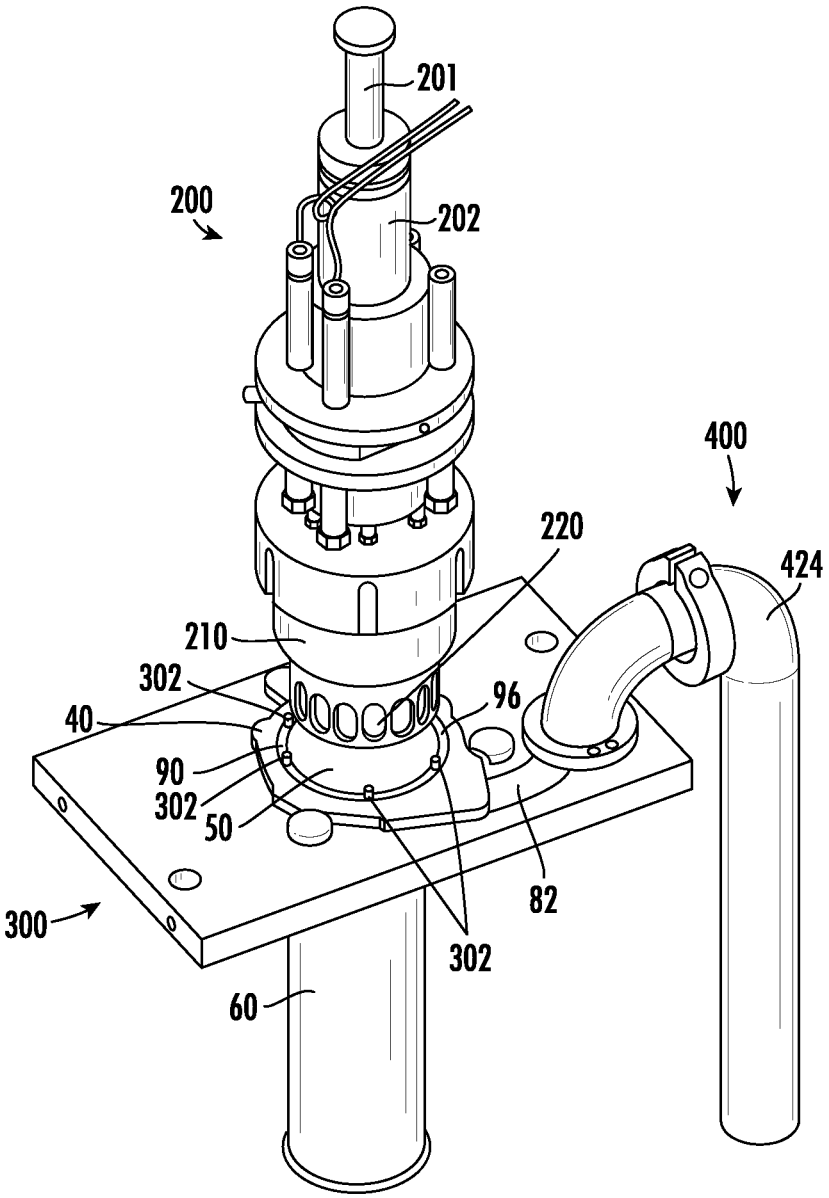
Figure 35A:
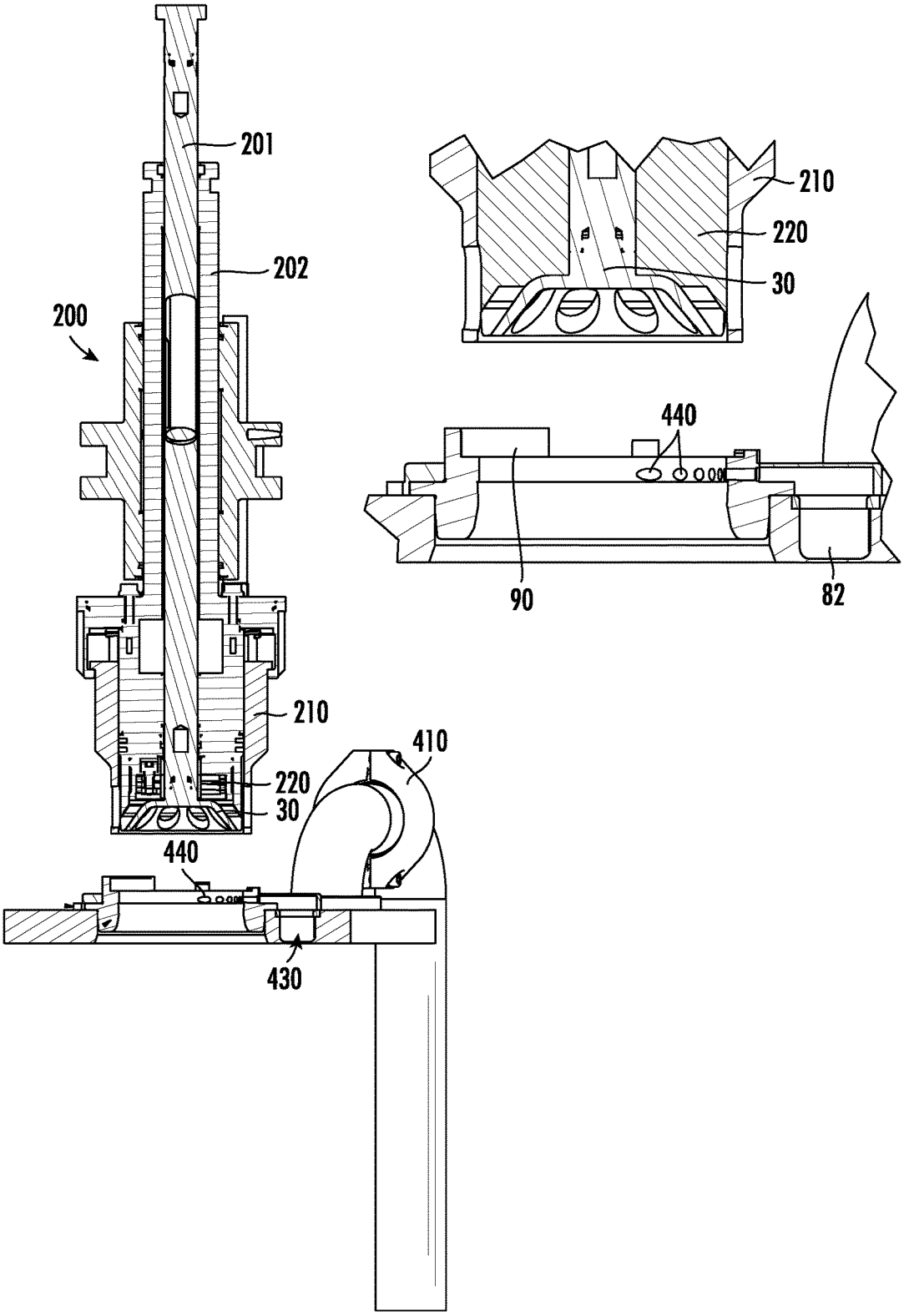
FIGS. 35A-35F illustrate an exemplary die and gas evacuation system in accordance with an embodiment of the invention.
Figure 35B:
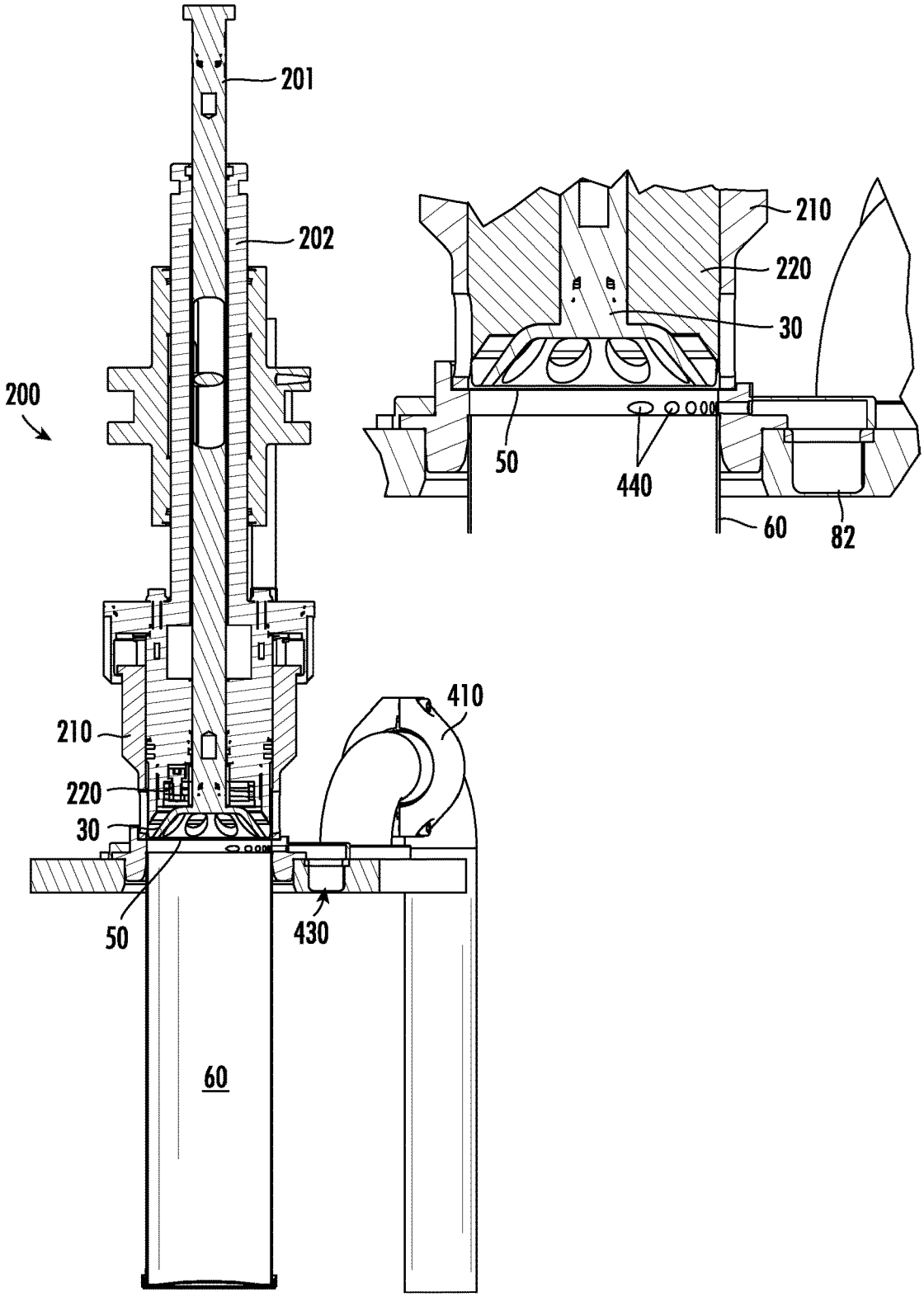
Figure 35C:
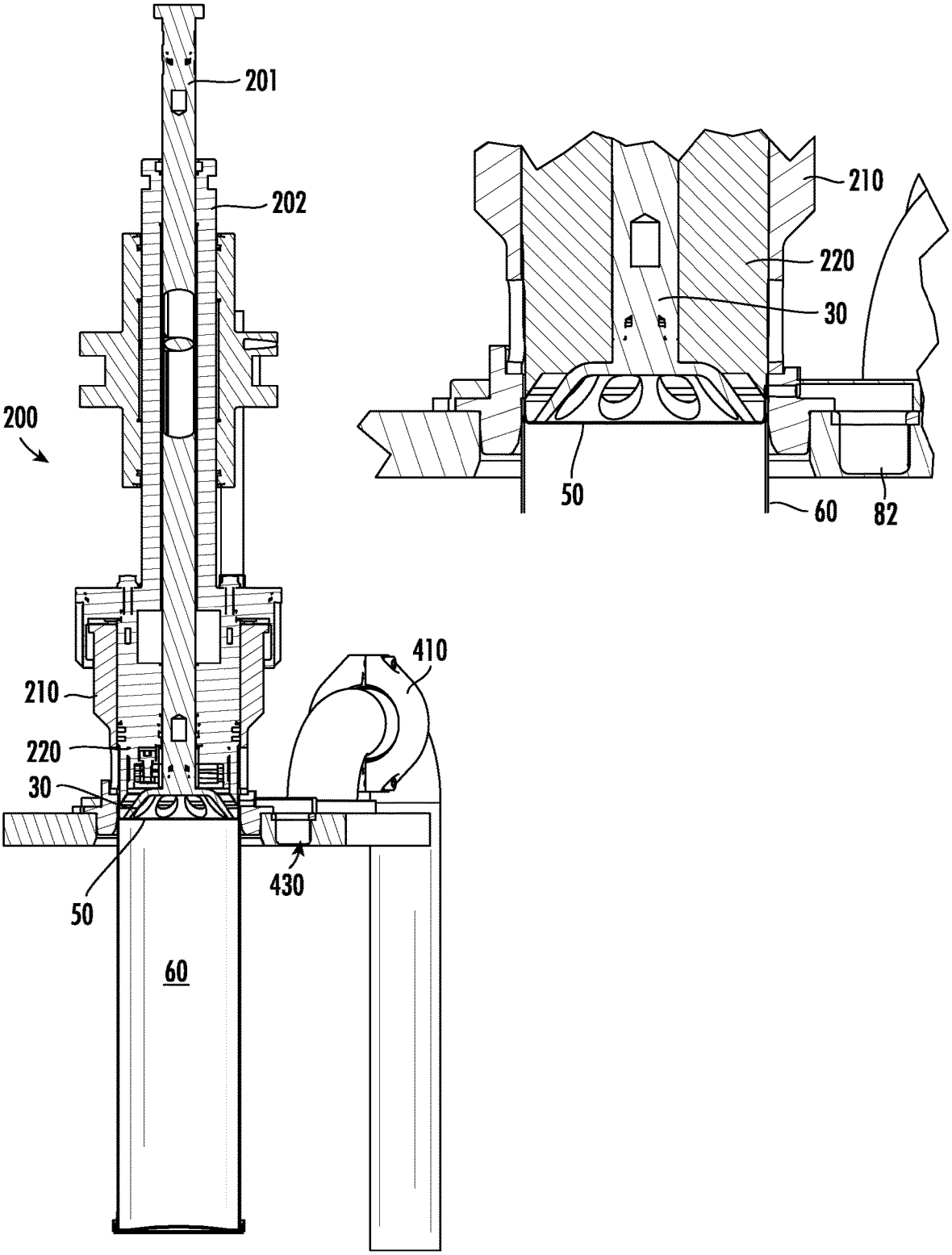
Figure 35D:
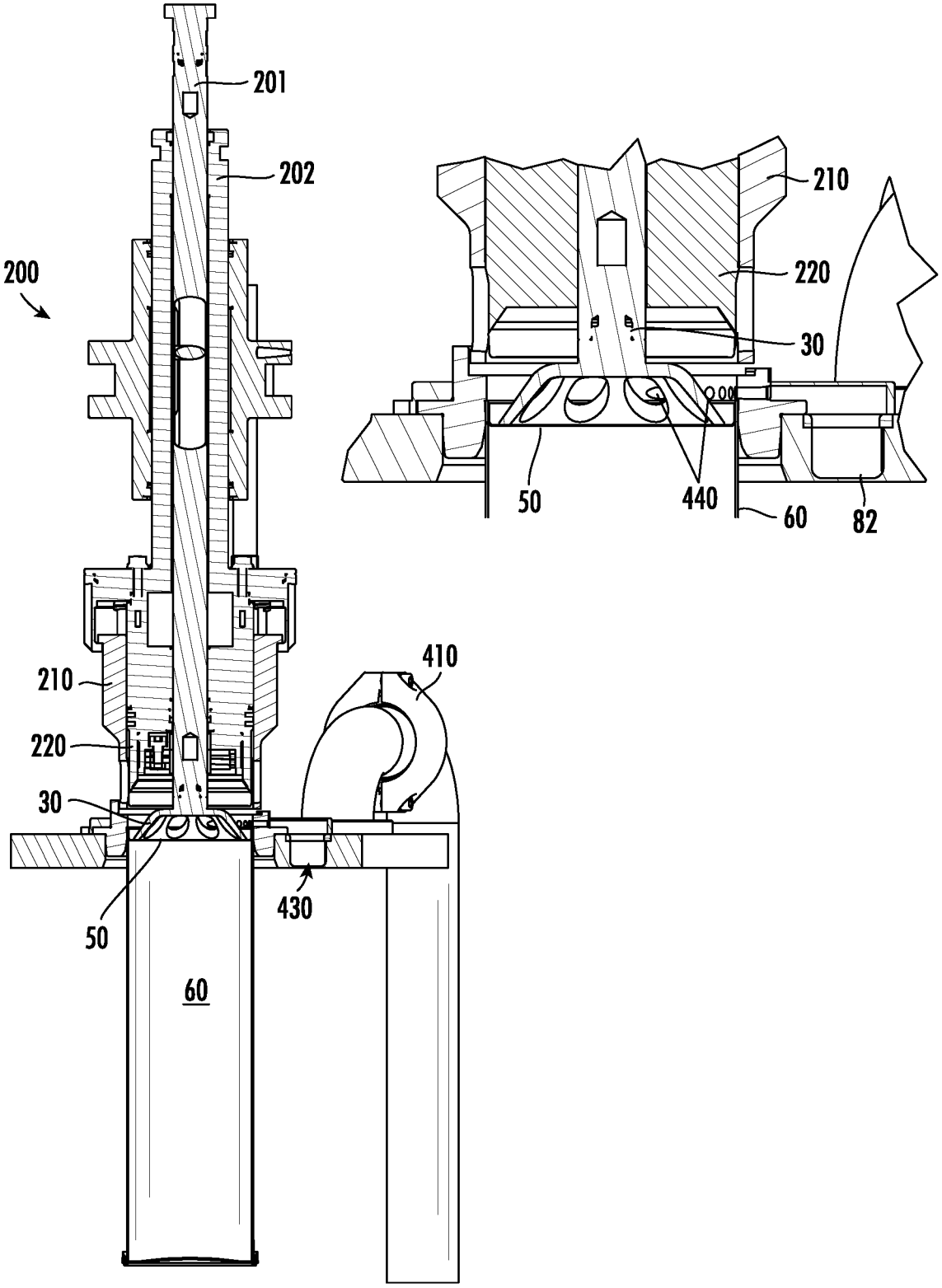
Figure 35E:
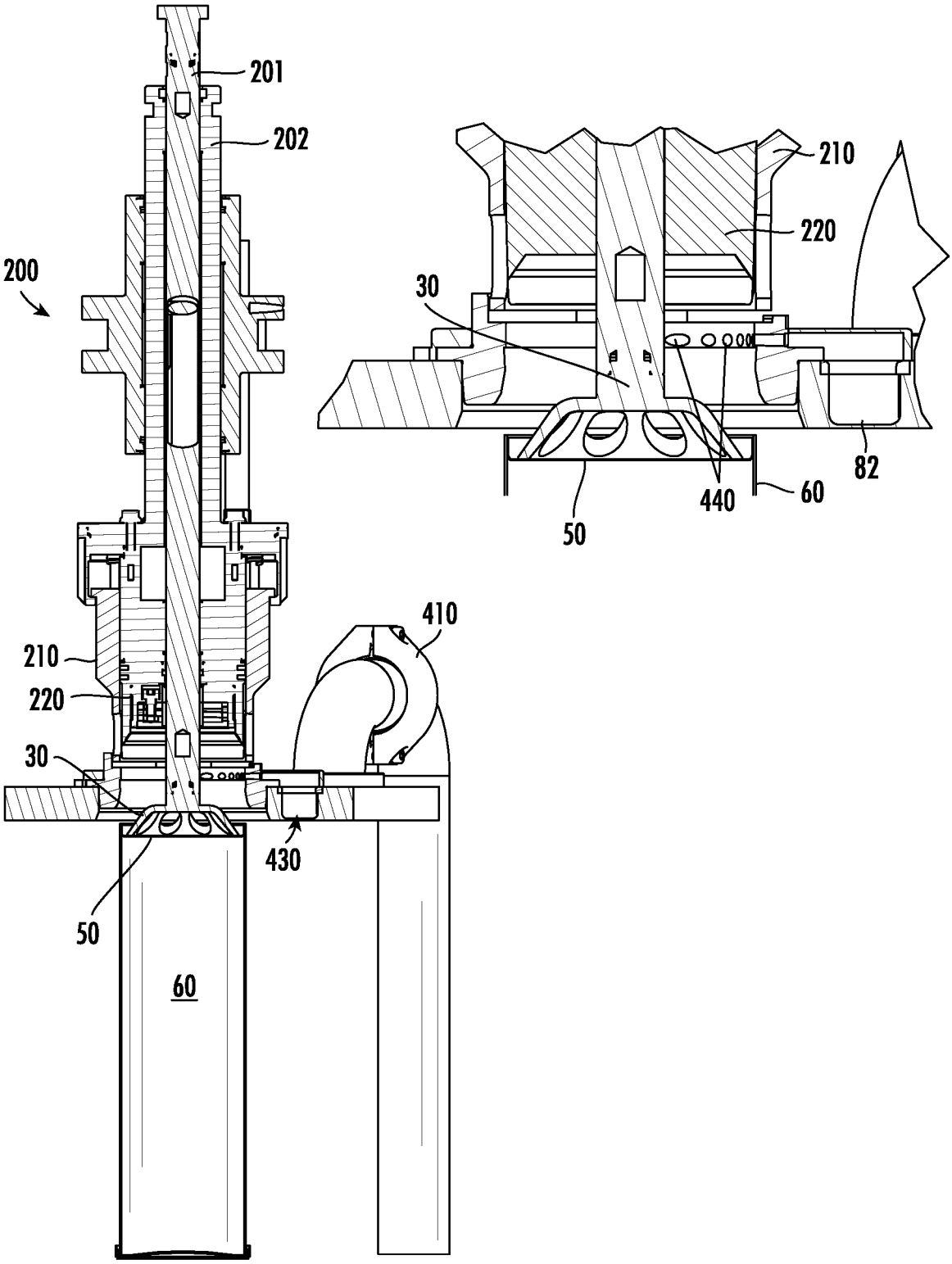
Figure 35F:
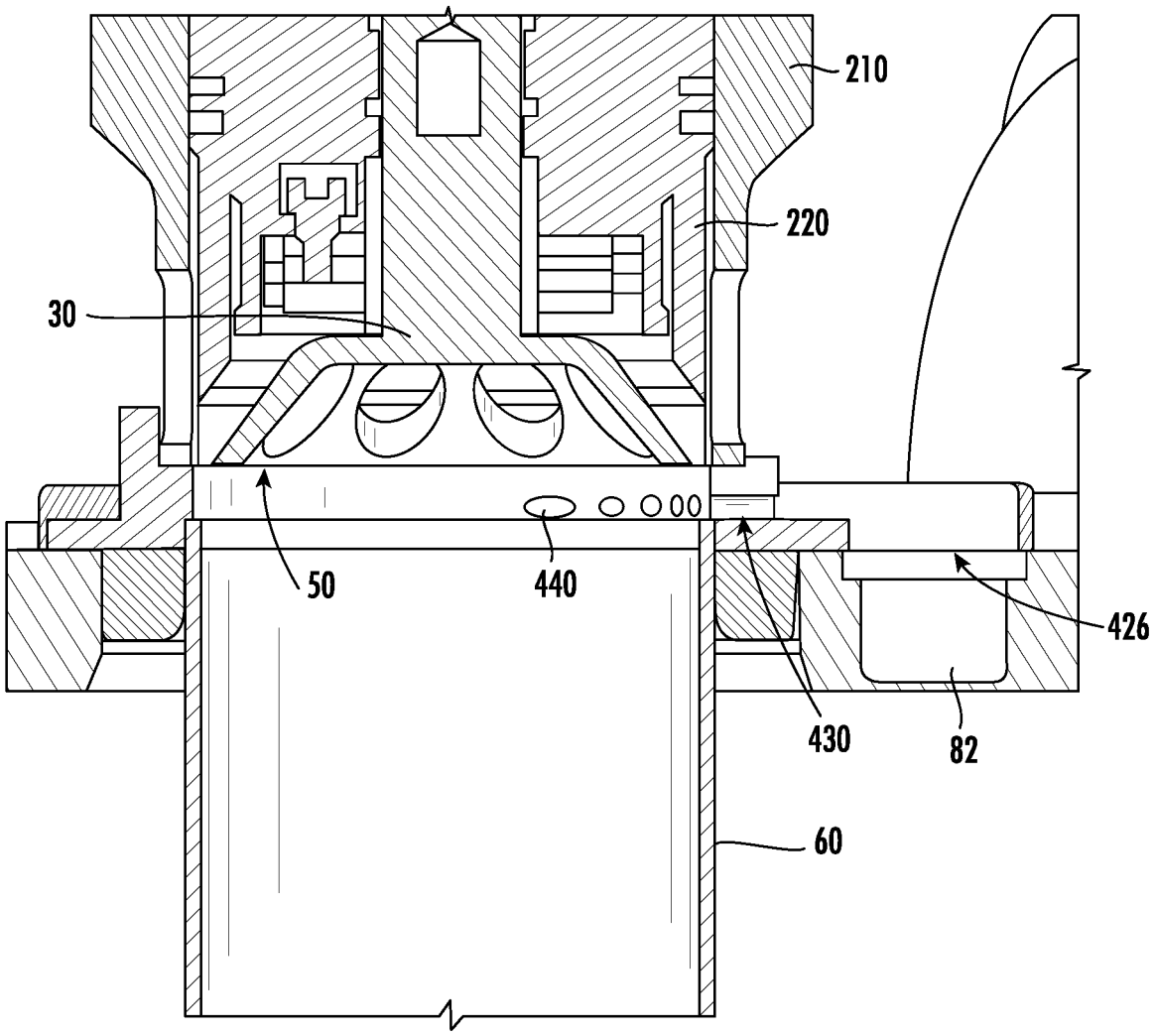
Figure 36:
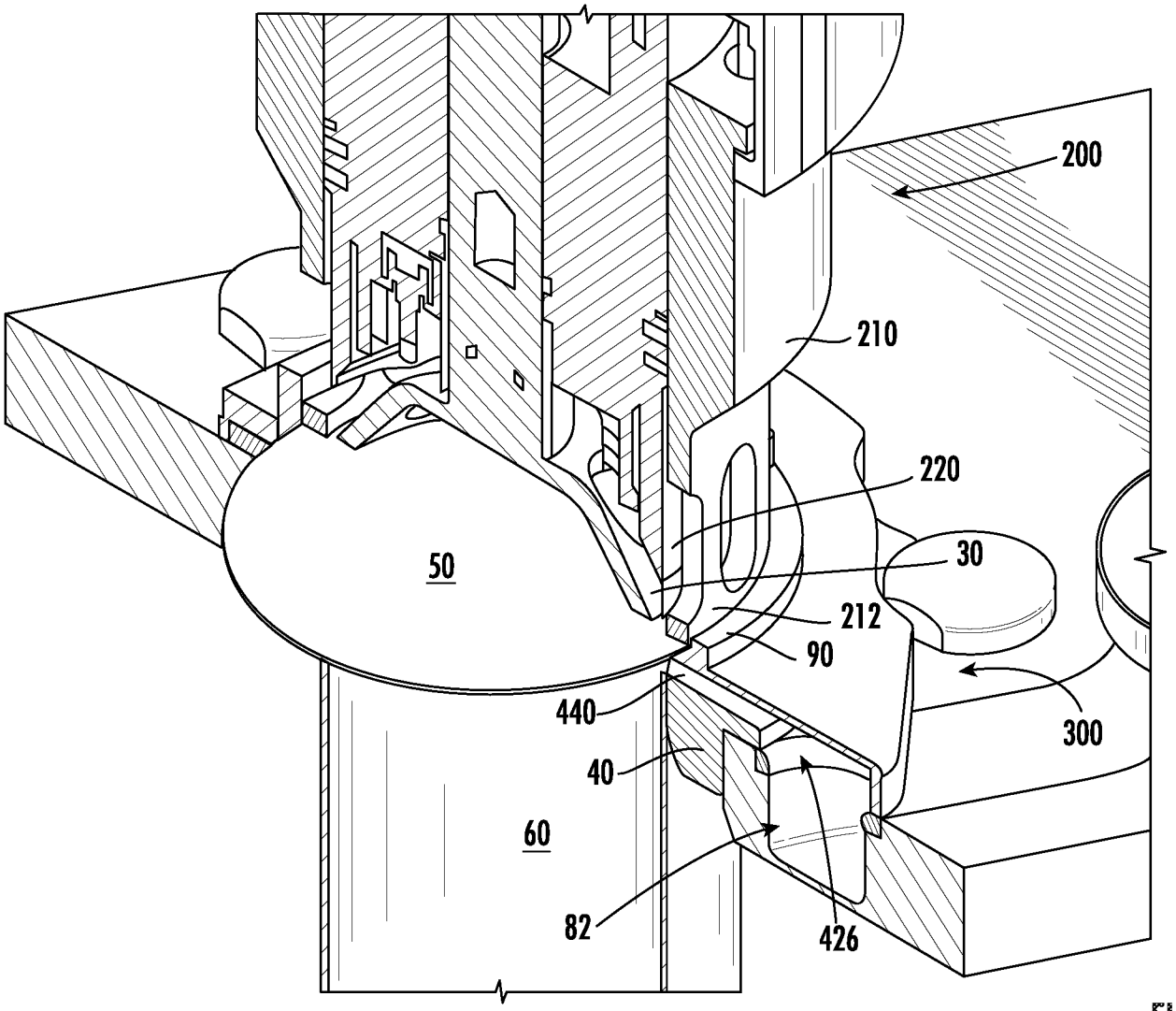
FIG. 36 illustrate an exemplary die and gas evacuation system in accordance with an embodiment of the invention.

In some embodiments, the channel openings 440 may be disposed below the positioning portion 90 of the die 80. More particularly, the channel openings 440 may be disposed below the disc support surface 92 of the positioning portion 90. As such, when the disc 50 is in position, before insertion into the container 60, the channel openings 440 may be disposed below the disc 50 (see FIG. 33). In some embodiments, the channel openings 440 may be disposed within the die opening inner surface 99. In some embodiments, the channel 430 and channel openings 440 may disposed adjacent the bottom surface 85 of the upper section 87 of the die 80.

In some embodiments, the channel 430 is fully circumferential within the die 80. In other embodiments, the channel 430 is partially circumferential within the die 80. In some embodiments, the channel 430 comprises a plurality of discontinuous channels within the die 80.

Figure 4:
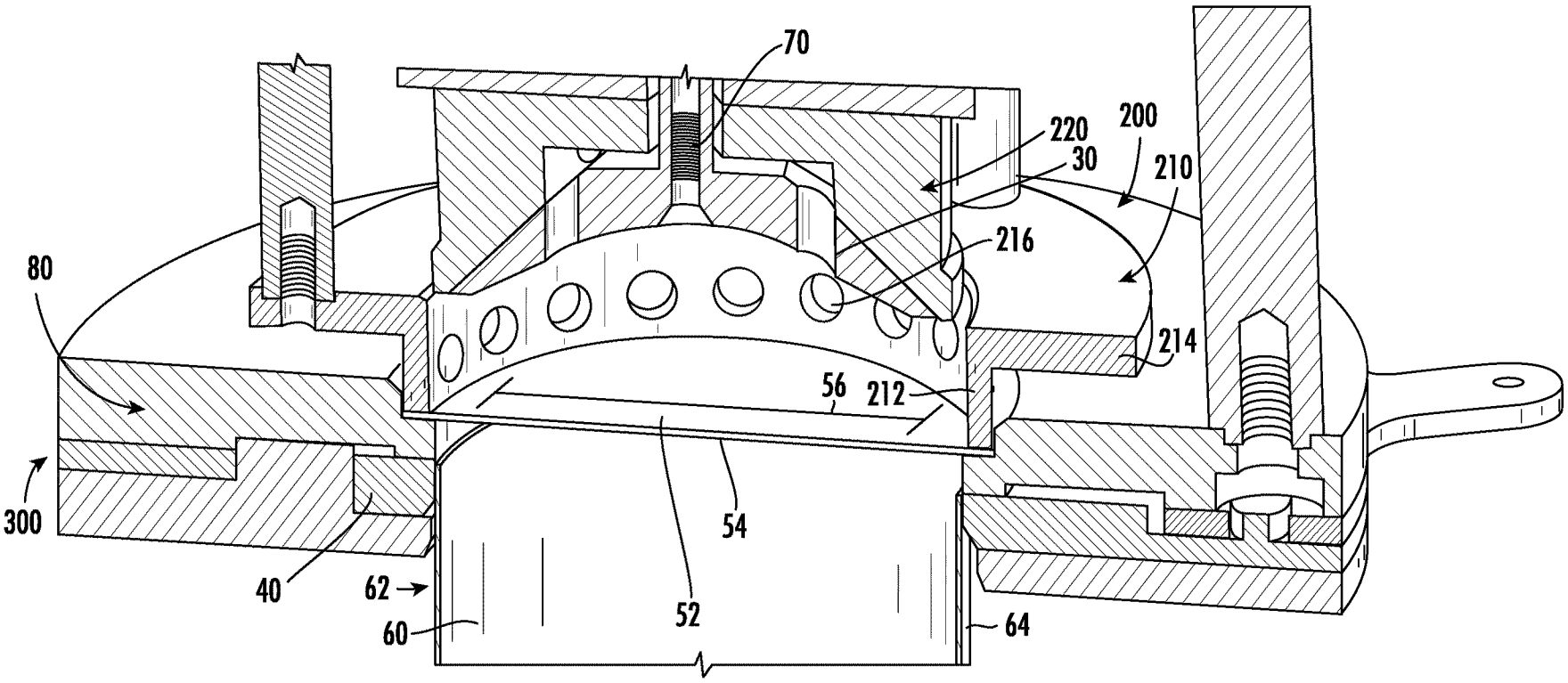
FIG. 4 illustrates a cross-section of an exemplary sealing system, in accordance with some embodiments of the present disclosure.

In some embodiments, the channel 430 may be sealed off from access to the atmosphere when the disc 50 is positioned within the positioning portion 90 of the die 80. In some embodiments, the vertically extending portion 212 of the outer mandrel 210 (discussed below) constrains the paper-based disc 50 (e.g., as shown in FIG. 4) during the bottom end formation. In some embodiments, the pressure that the vertically extending portion 212 of the outer mandrel 210 places on the paper-based disc 50 may seal the channel 430 off from access to the atmosphere. At such point, the gas evacuation assembly 400 may suction or vacuum gas from the container interior, as will be further explained herein.

In some embodiments, the valves 420 may connect via piping or tubing 424 to a side channel pump, blower or fan or a vacuum pump (not shown). Any side channel pump, vacuum pump or suction device known in the art may be utilized. The valves 420 may connect to the tubing via a coupling connection 410. The coupling connection 410 may be integral to the die 80. Alternatively, the coupling connection 410 may be screwed into the die 80. That is, there may be screw threads on at least a portion of the internal surface of the bore 82 which may align with and interconnect with threads on an external surface of the coupling connection 410.

The coupling connection 410 may have a distal end 412 which is configured to connect to a hose or tube. The connection may be a snap-fit, twist, or any other configuration known in the art. In some embodiments, the coupling connection 410 may comprise an elbow joint, allowing the tubing to attach and hang in a vertical, horizontal, or any other position. In some embodiments, the coupling connection 410 may rotate about its axis to prevent tangling of the tubing.

In some embodiments, the evacuation assembly 400 comprises a plurality of valves 420, coupling connections 410, and tubes. In a particular embodiment, the evacuation assembly 400 comprises three valves 420 and three corresponding coupling connections 410 and tubes. In some embodiments, the number of valves 420 corresponds to the number of sealing members 40 (discussed below). In this embodiment, if there are three sealing members 40, three valves 420 are present, each disposed in one of the sealing members 40. In other embodiments, the number of valves 420 may be greater than the number of sealing members 40. For example, the sealing member 40 may comprise a single, unitary sealing member 40 but may have two or three valves 420 disposed therein. In some embodiments, a certain number of channel openings 440 are disposed in each valve section 414, 416, 418. For example, three, four, five, or six channel openings 440 may be disposed in each valve section.

In some embodiments, the gas evacuation mechanism is operated in a vacuum chamber which has been depressurized. In another embodiment, however, the gas evacuation mechanism is operated under standard atmospheric conditions, without use of a vacuum chamber.

The Mandrel Assembly

As noted above, the mandrel assembly 200 may comprise an inner mandrel 220 and an outer mandrel 210. The inner mandrel 220 and the outer mandrel 210 may be translatable, separately from one another. In an embodiment, the inner mandrel 220 and the outer mandrel 210 translate parallel to one another, which may be vertically but need not necessarily be vertically. For example, the system may provide an inner mandrel 220 and an outer mandrel 210 that translate horizontally or angularly.

In an embodiment, the inner mandrel 220 may move a first distance and the outer mandrel 210 may move a second distance, wherein the first and second distances are different from one another. Likewise, the inner mandrel 220 may move at a first time and the outer mandrel 210 may move at a second time, wherein the first and second times are different from one another. In some embodiments, the inner mandrel 220 and the outer mandrel 210 may move in unison during a first time period. In some embodiments, the inner mandrel 220 may have a first extension length and the outer mandrel 210 may have a second extension length, wherein the first and second extension lengths are different from one another. In an embodiment, the outer mandrel 210 may move in unison with both the inner mandrel 210 and the ejector 30 until such time as the mandrel assembly 200 contacts the die assembly 300. Each of the outer mandrel 210, the inner mandrel 210 and the ejector 30 may contact the die assembly 300 simultaneously in an embodiment.

The outer mandrel 210 may be generally cylindrical, in some embodiments. In another embodiment, the outer mandrel 210 may comprise a vertically extending (e.g., downward) portion 212 and a radially-outwardly directed flange 214. The vertically extending portion 212, in some embodiments, may be perforated and/or may have through holes 216 disposed therein. In some embodiments, the vertically extending portion 212 and the radially-outwardly directed flange 214 may join in a right angle or a nearly right angle. The flange 214 may not be present in some embodiments.

In some embodiments, the vertically extending portion 212 of the outer mandrel 210 may be sized to fit within the circumference of the positioning portion 90. In some embodiments, the vertically extending portion 212 of the outer mandrel 210 has a greater circumference than that of the die opening 98, such that the vertically extending portion 212 of the outer mandrel 210 cannot extend into the die opening. More specifically, the vertically extending portion 212 of the outer mandrel 210 may be sized and/or configured such that, when fully extended, it is disposed adjacent the positioning portion sidewall 94 and the disc support surface 92 of the positioning portion 90. In some embodiments, the vertically extending portion 212 of the outer mandrel 210 may be extended after the disc 50 is seated within the positioning portion 90 and may be configured to secure the disc 50 in place (e.g., as shown in FIG. 4).

Figure 12:
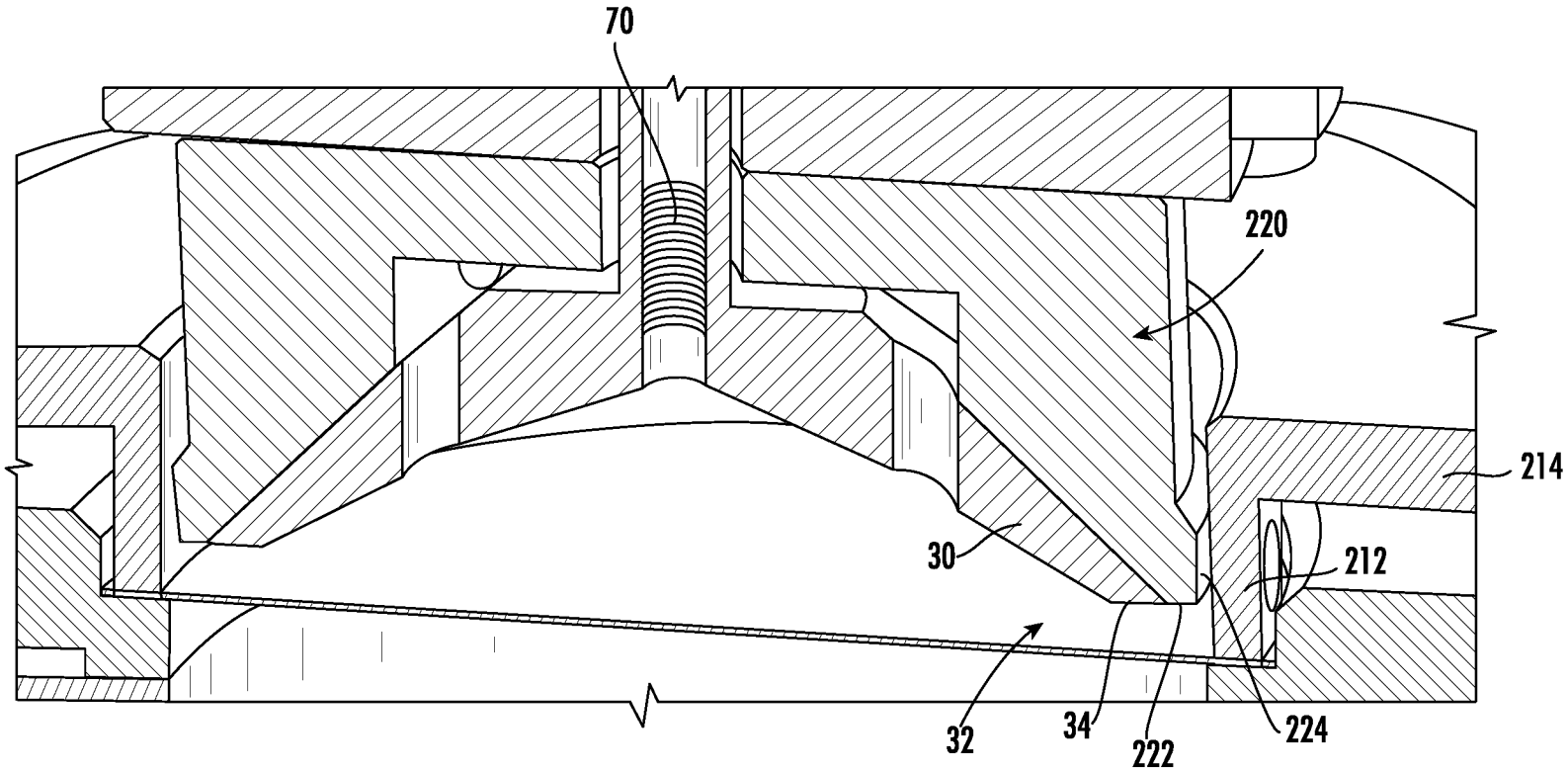
FIG. 12 illustrates a cross-section of an exemplary sealing system, in accordance with some embodiments of the present disclosure.

As shown in FIG. 12, the inner mandrel 220 may be generally cylindrical. In some embodiments, the inner mandrel 220 may be sized to fit within the inner circumference of the vertically extending portion 212 of the outer mandrel 210. In some embodiments, the inner mandrel 220 may be configured to extend vertically lower than the vertically extending portion 212 of the outer mandrel 210. In this embodiment, once the disc 50 is seated within the positioning portion 90 and constrained by the fully extended vertically extending portion 212 of the outer mandrel 210, the inner mandrel 220 may continue to move vertically downward, extending beyond the base of the vertically extending portion 212 of the outer mandrel 210, and pushing/urging the disc 50 into the open end 62 of the container body 60 (e.g., as shown in FIG. 6).

The inner mandrel 220 may comprise a first mandrel surface 222 adjacent to a second mandrel surface 224, together configured to insert and shape a paper-based disc 50 in some embodiments (e.g., as shown in FIG. 12). In some embodiments, the first mandrel surface 222 may join the second mandrel surface 224 in a right angle or approximately a right angle. In some embodiments, the first mandrel surface 222 may be horizontal or substantially horizontal and may be disposed adjacent the top surface of the disc 50. In some embodiments, the second mandrel surface 224 may be vertical or substantially vertical and may be configured to be adjacent an inner surface of the vertically extending portion 212 of the outer mandrel 210 as the inner mandrel 220 passes through the outer mandrel 210. That is, the circumference of the second mandrel surface 224 may be less than the inner circumference of the vertically extending portion 212 of the outer mandrel 210.

It is noted that while the first mandrel surface 222 and the second mandrel surface 224 are depicted in the figures as being substantially flat (horizontal and vertical), the first mandrel surface 222 and the second mandrel surface 224 may be curved, contoured or shaped. The inner mandrel 220 may further comprise a shaped portion that is disposed between the first mandrel surface 222 and the second mandrel surface 224. The shaped portion may be curved, chamfered, or comprise any other contour. It is noted that, while the inner mandrel 220 is depicted as having a substantially circular cross-section, the inner mandrel 220 may have a cross-section that is substantially circular, triangular, rectangular, quadrangular, pentagonal, hexagonal or elliptical.

Figure 5:
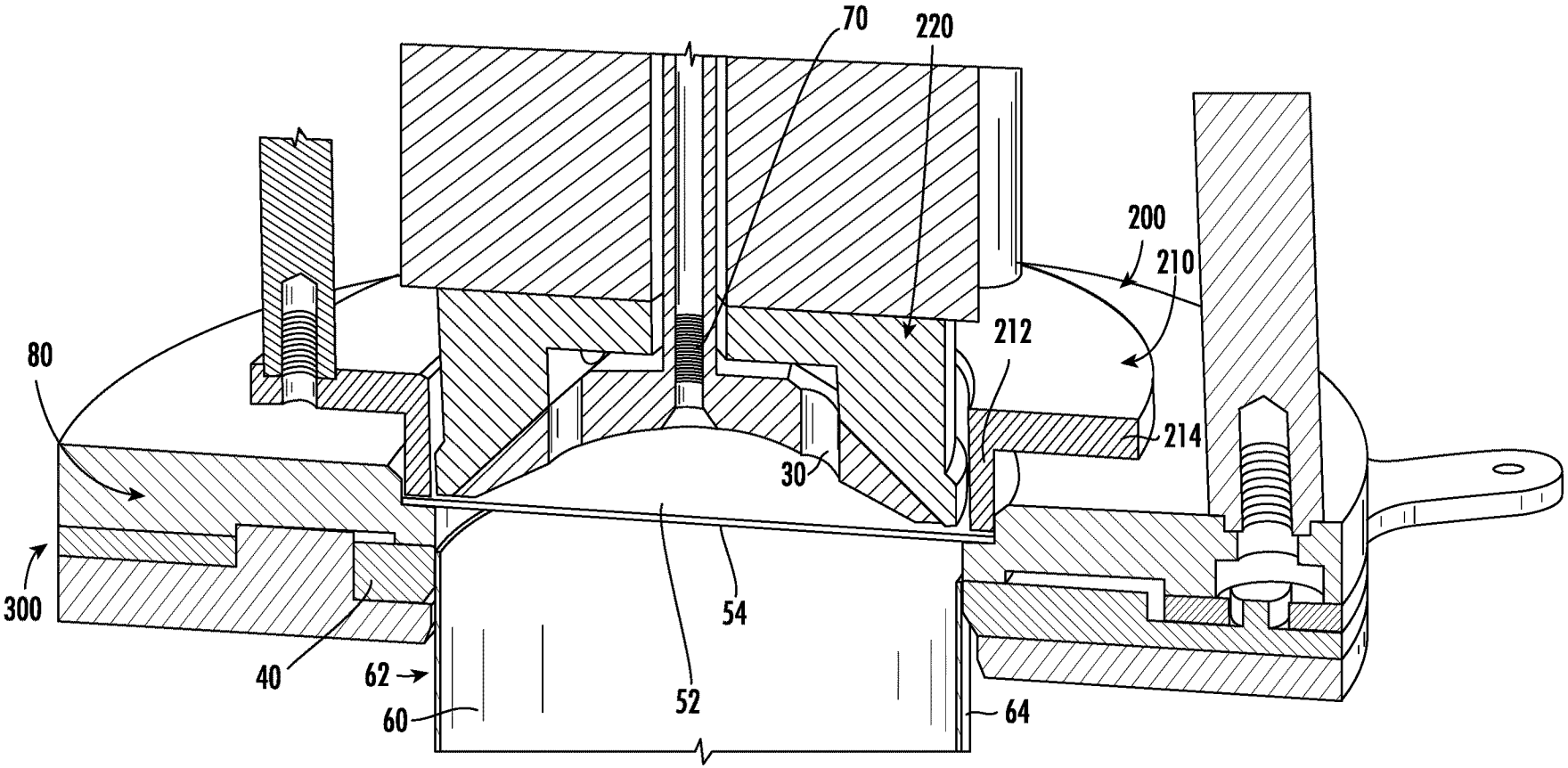
FIG. 5 illustrates a cross-section of an exemplary sealing system, in accordance with some embodiments of the present disclosure.
Figure 6:
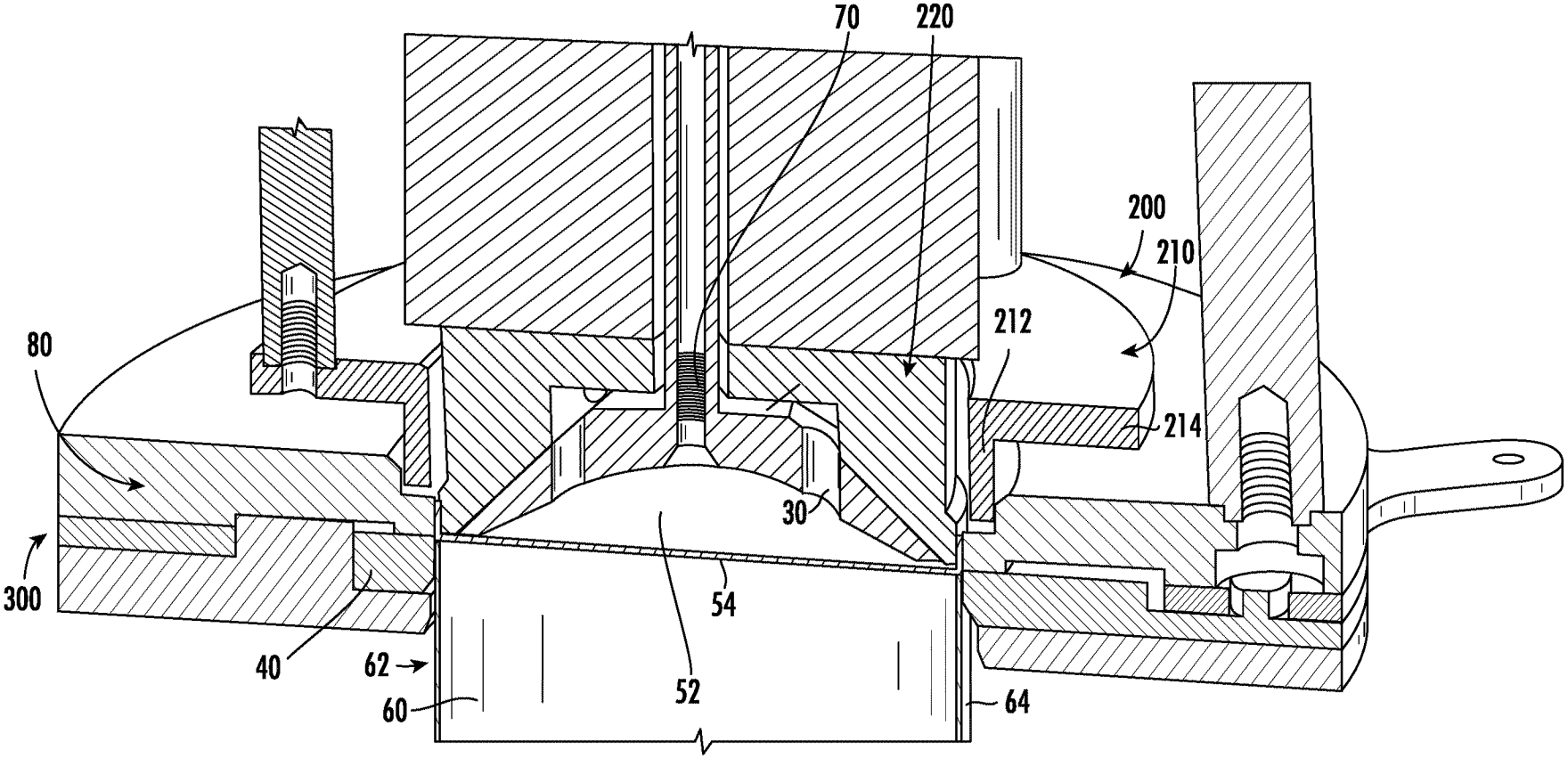
FIG. 6 illustrates a cross-section of an exemplary sealing system, in accordance with some embodiments of the present disclosure.

As the inner mandrel 220 pushes the disc 50 into the container body 60 (e.g., as shown in FIGS. 5-6), the disc is released from between the outer mandrel 210 and the positioning portion 90 of the die assembly 300. The central portion 56 of the disc 50 may be pushed downward, through the die opening 98, into the open bottom end 62 of the container body 60, such that the central portion 56 (the first deformed surface 53) remains flat or substantially flat (e.g., horizontal). During insertion of the disc 50 into the container body 60, in some embodiments, the peripheral portion 58 of the disc 50 may be bent at a right angle or a near-right angle, shown as the second deformed surface 55 in FIG. 11. In such embodiments, the peripheral portion 58 of the disc 50 (becoming the second deformed surface 55) may be forced adjacent the second mandrel surface 224, passing through the die opening 98. The resulting second deformed surface 55 (previously the peripheral portion 58) of the disc 50 may be disposed vertically or nearly vertically, adjacent the interior surface 66 of the container body 60, at the open bottom end 62.

The disc 50 may be pushed into the container body 60 any distance that would be practical in the art. In some embodiments, the disc 50 becomes a recessed composite bottom 51 (e.g., as shown in FIG. 11). In some embodiments, the peripheral edge 57 of the disc 50 is flush with the edge of the sidewall of the container body 60. In other embodiments, the peripheral edge 57 of the disc 50 is disposed inward, in relation to the peripheral edge of the sidewall 63 of the container body 60. In some embodiments, the first deformed surface 53 and the second deformed surface 55 are joined in a right angle or a near-right angle, within the container body 60.

In some embodiments, a mandrel heater may be configured to heat the first mandrel surface 222 and/or the second mandrel surface 224 of the inner mandrel 220, in some embodiments. In some embodiments, the mandrel heater may be disposed within the inner mandrel 220. The inner mandrel 220 may, in some embodiments, further comprise an insulated portion formed from a heat insulating material that is configured to mitigate heat transfer.

The Sealing Members

The sealing member(s) 40 may be configured to provide heat and pressure for heat sealing. The sealing member(s) 40 may be positionable between a sealing position (e.g., as shown in FIGS. 1-6) and an open position (e.g., as shown in FIGS. 7-11). When in the sealing position, sealing member(s) 40 are in contact with the exterior surface 64 of the container body 60 and when in the open position, the sealing member(s) 40 are not in contact with the container body 60. In an embodiment, the sealing member(s) 40 comprise segmented clamping brackets (see figures generally).

Figure 20:
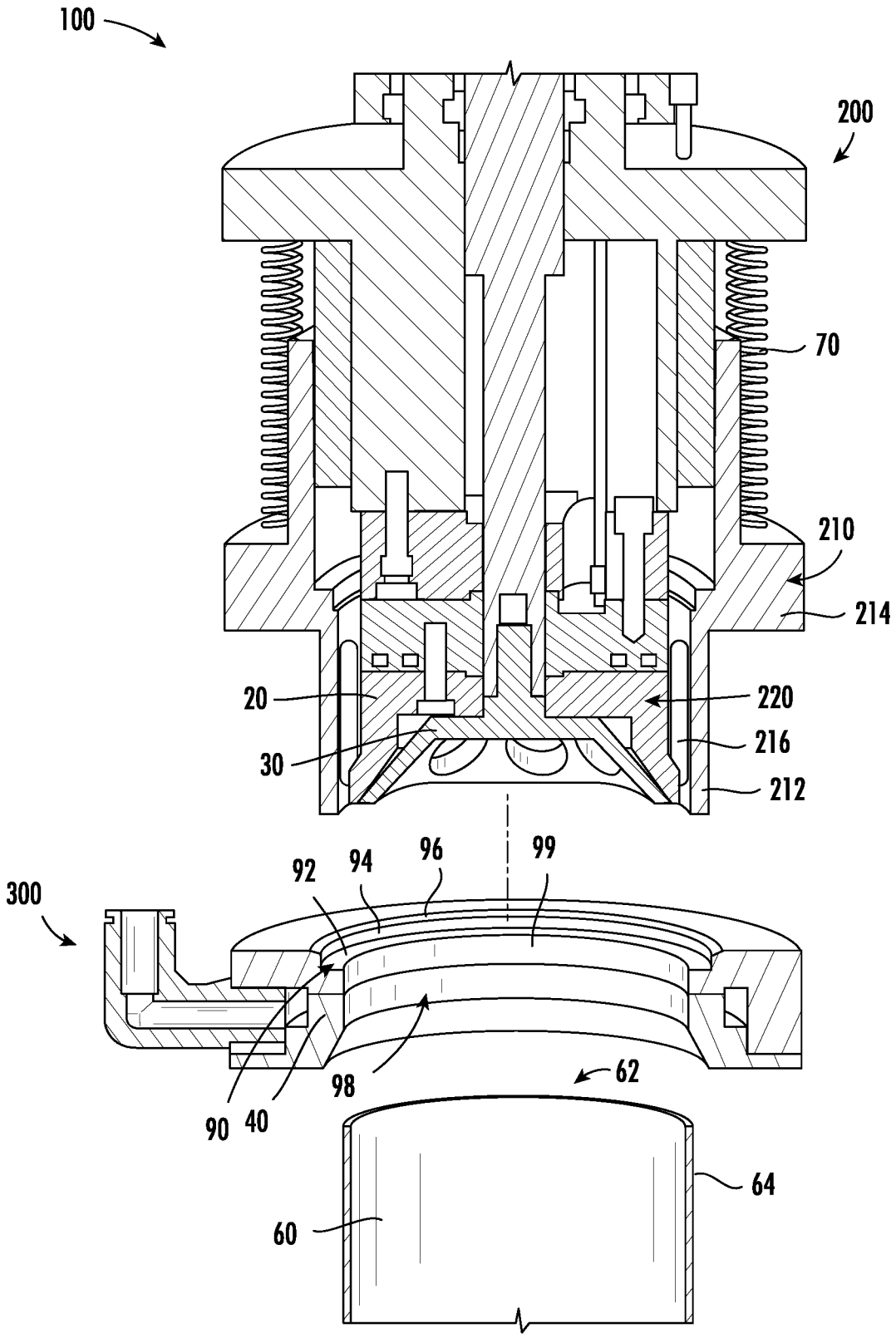
FIG. 20 illustrates an exemplary sealing system in accordance with an embodiment of the invention.
Figure 21:
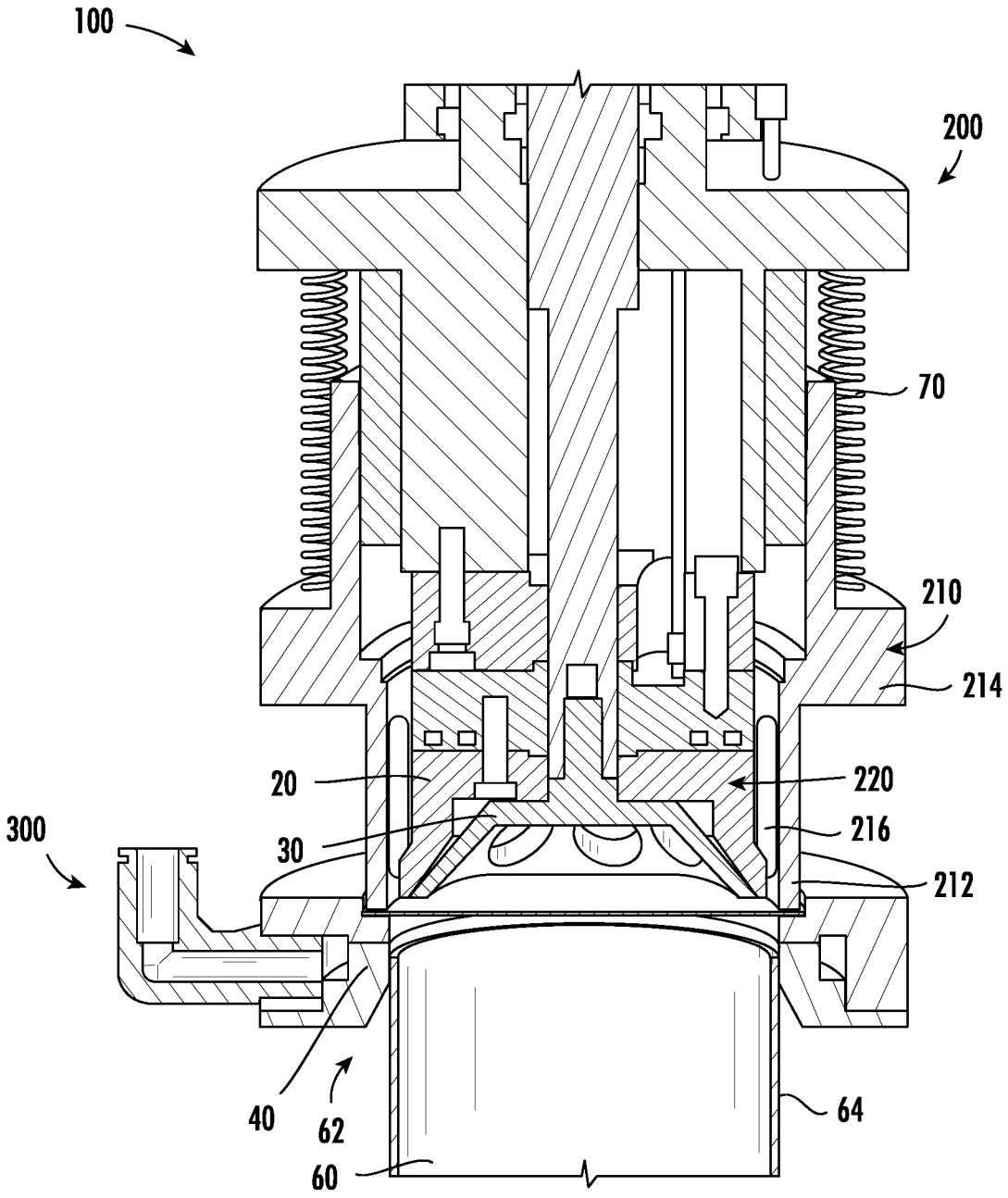
FIG. 21 illustrates an exemplary sealing system in accordance with an embodiment of the invention.
Figure 22:
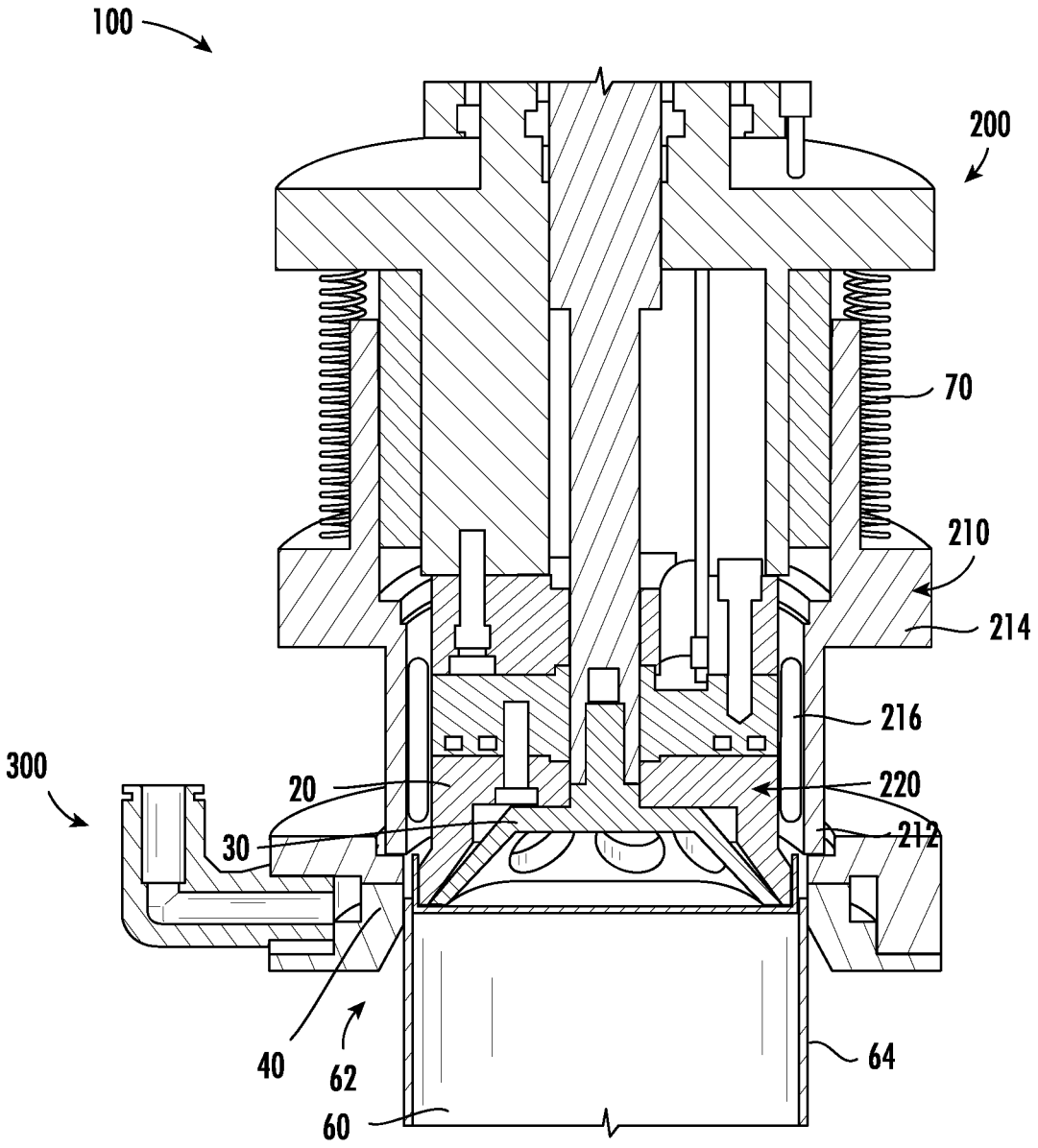
FIG. 22 illustrates an exemplary sealing system in accordance with an embodiment of the invention.
Figure 23:
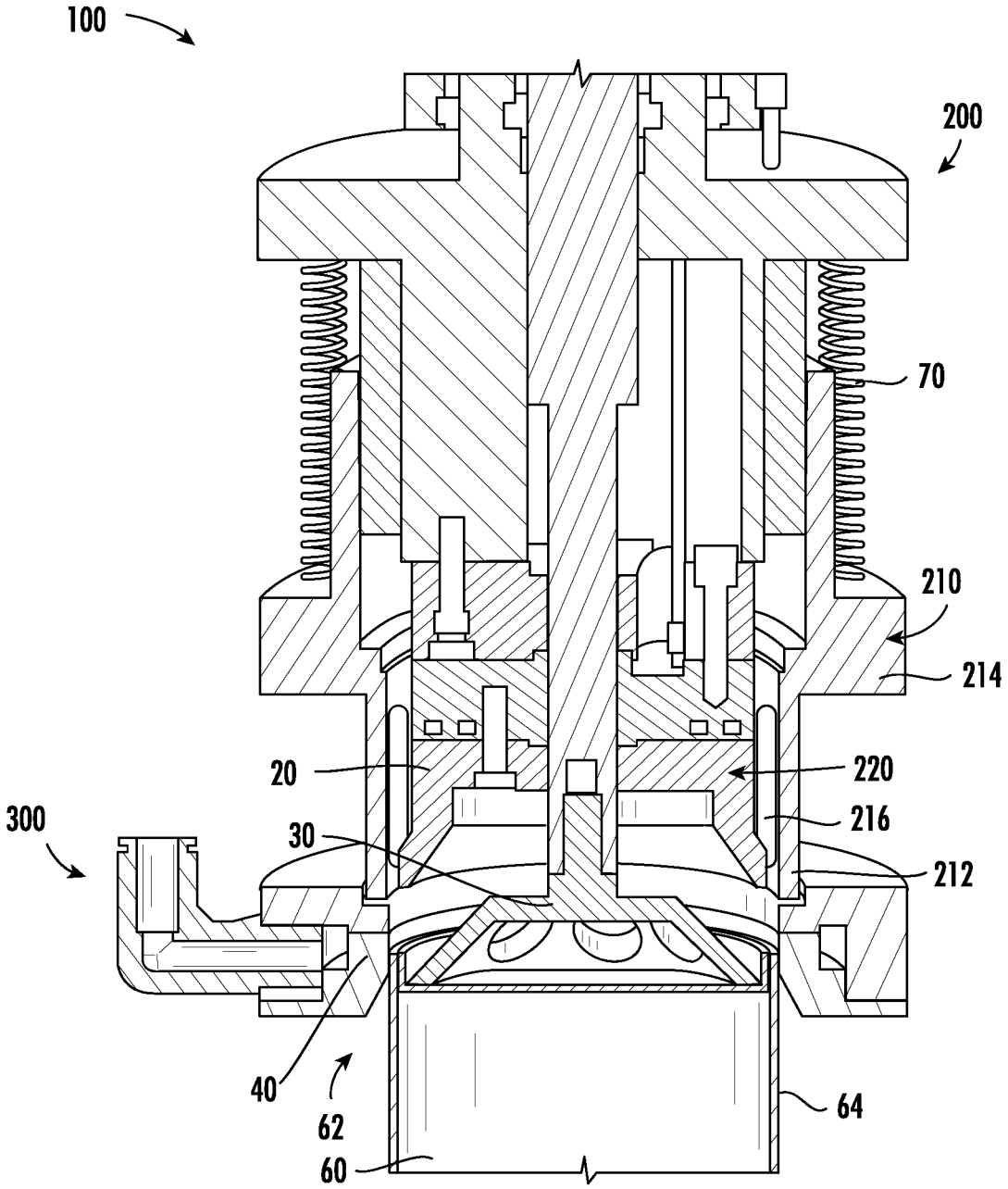
FIG. 23 illustrates an exemplary sealing system in accordance with an embodiment of the invention.
Figure 24:
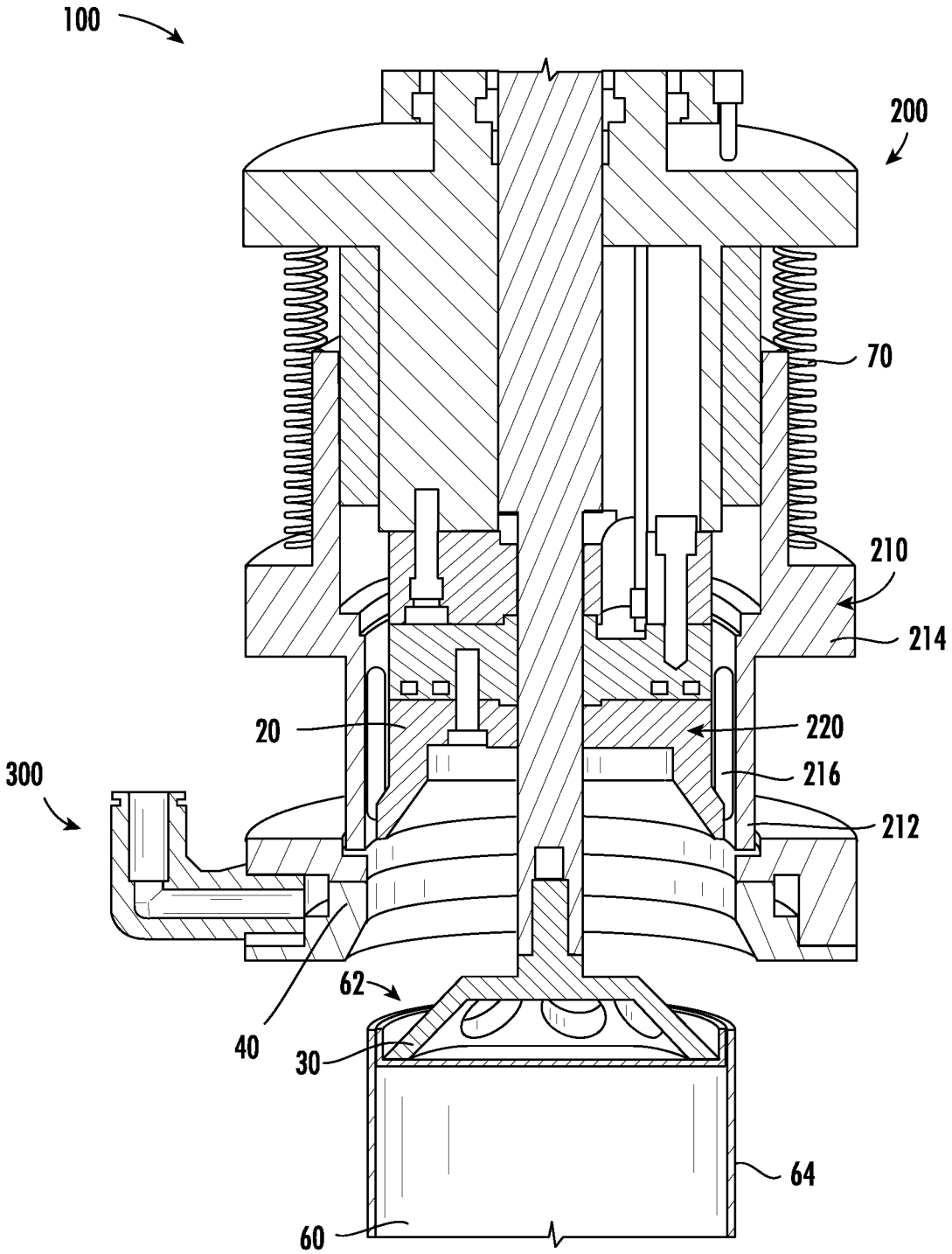
FIG. 24 illustrates an exemplary sealing system in accordance with an embodiment of the invention.
Figure 25:
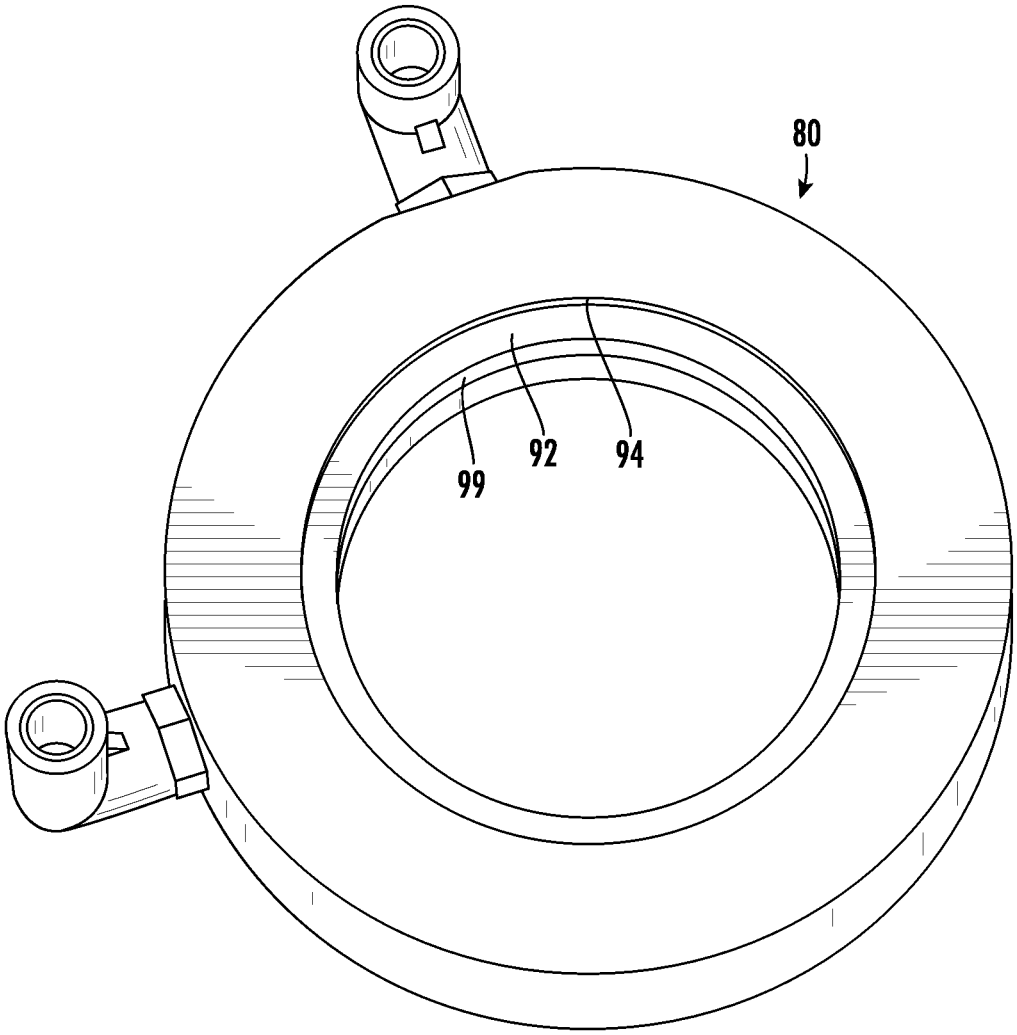
FIG. 25 illustrates an exemplary die and gas evacuation system in accordance with an embodiment of the invention.
Figure 26:
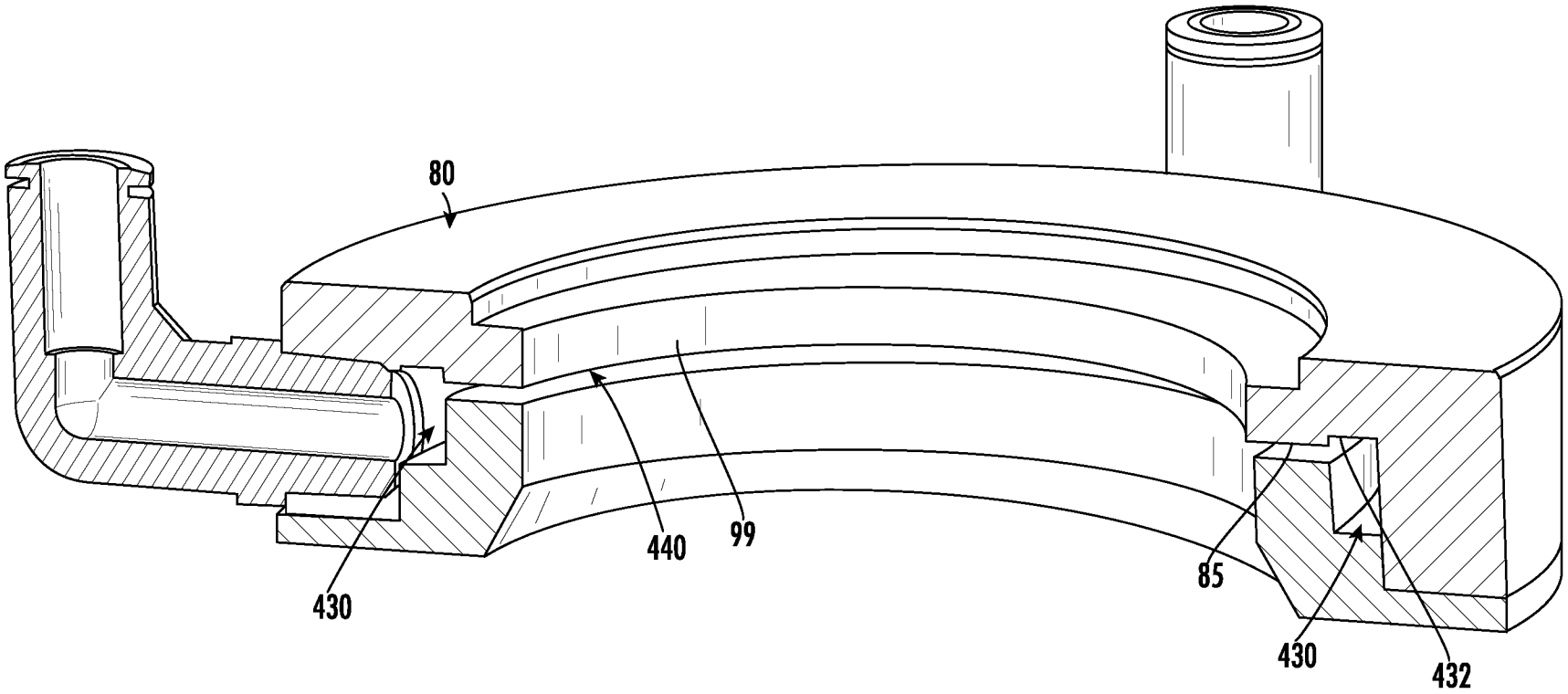
FIG. 26 illustrates an exemplary die and gas evacuation system in accordance with an embodiment of the invention.
Figure 27:
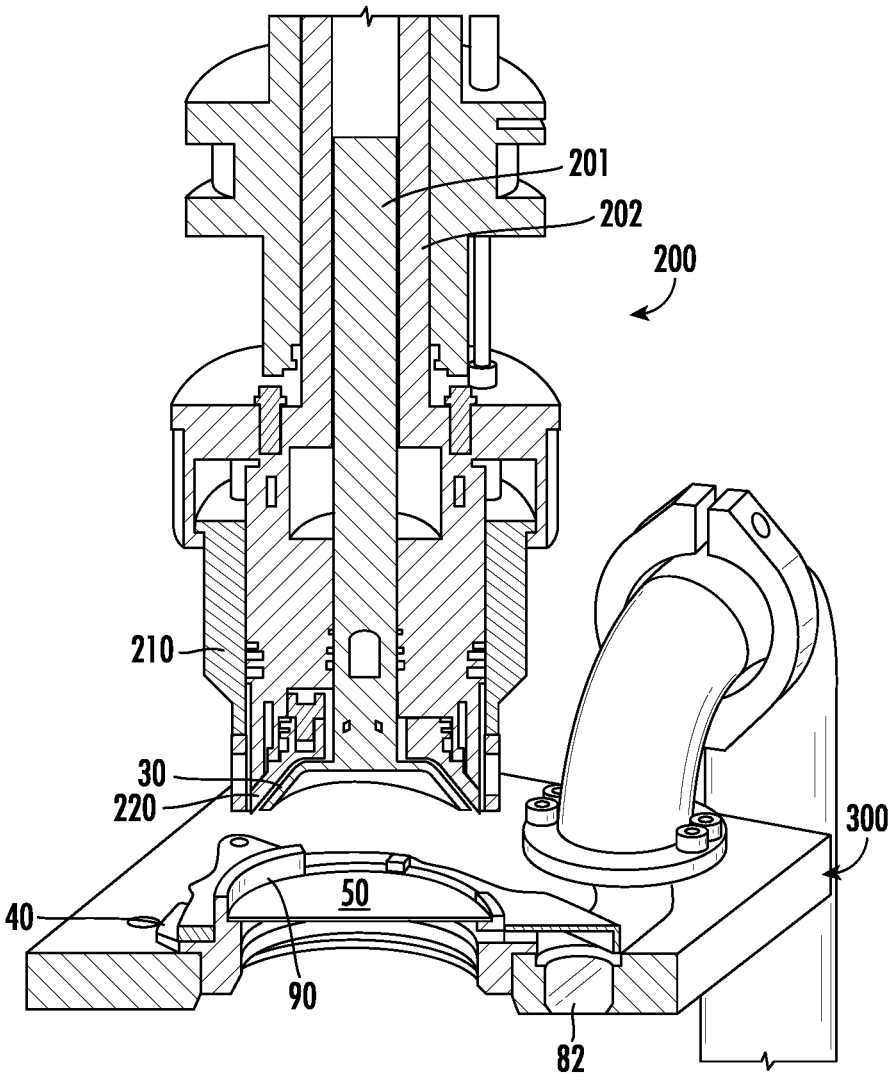
FIGS. 27-34 illustrate an exemplary die and gas evacuation system in accordance with an embodiment of the invention.
Figure 28:
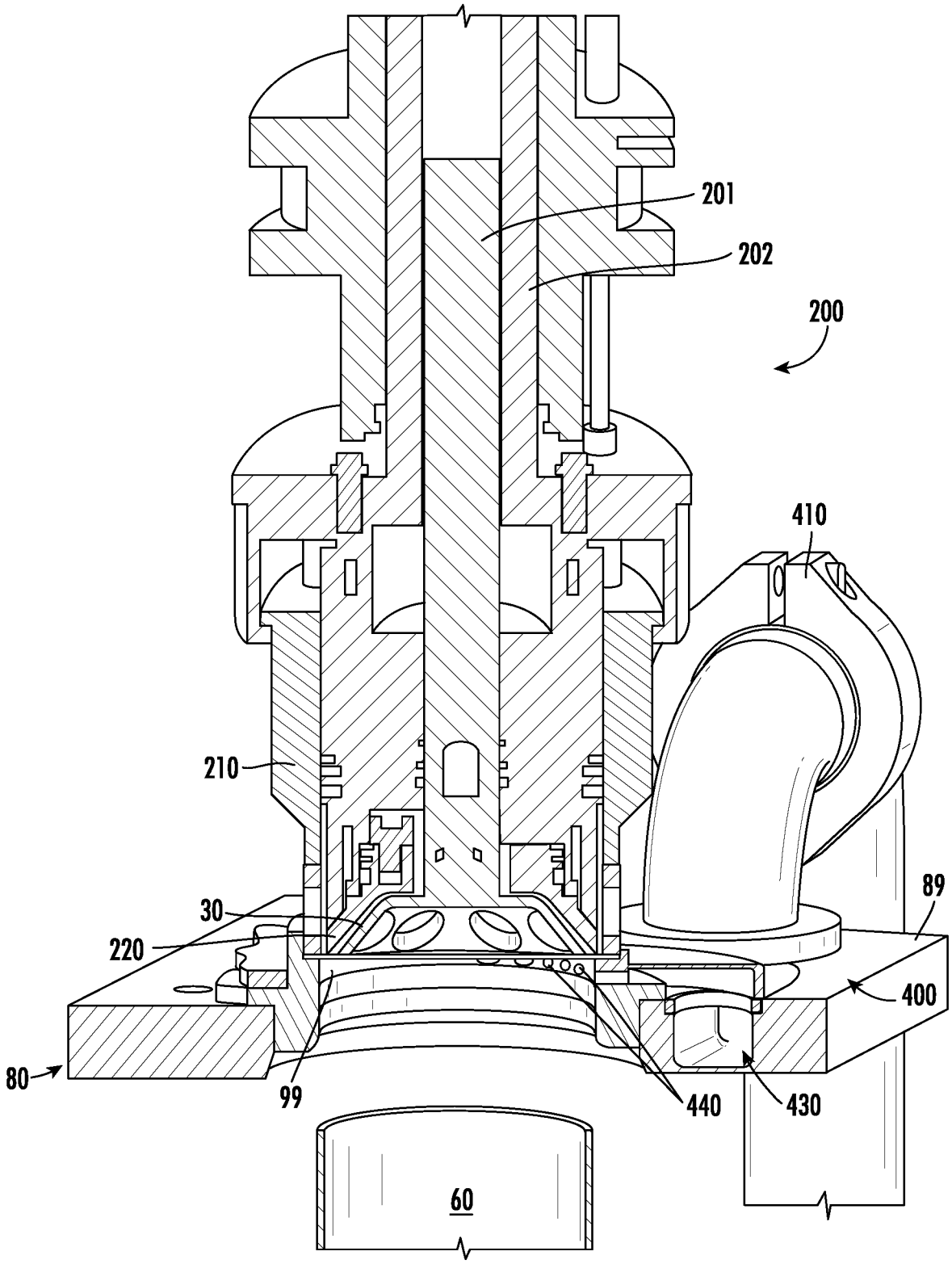
Figure 29:
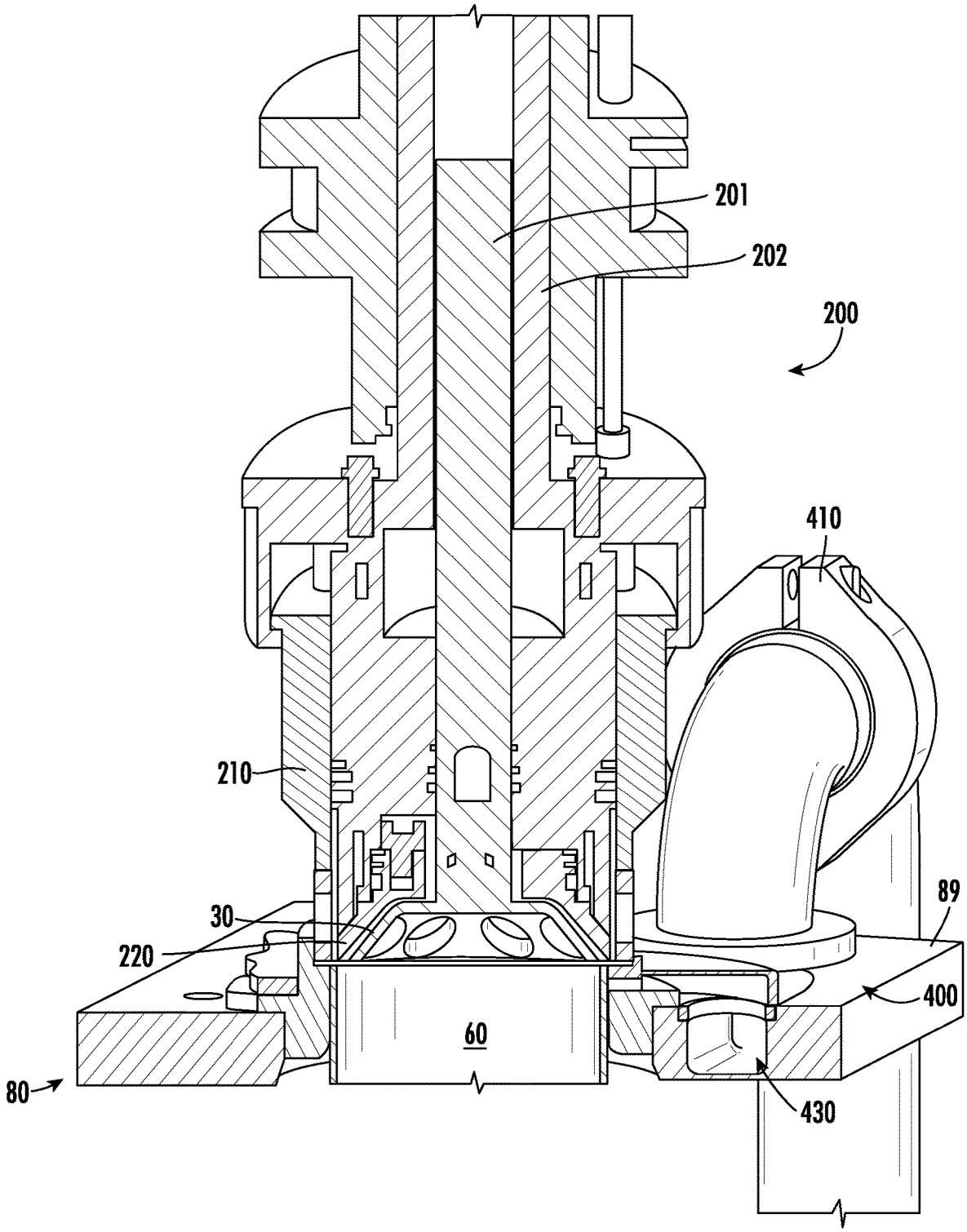
Figure 30:
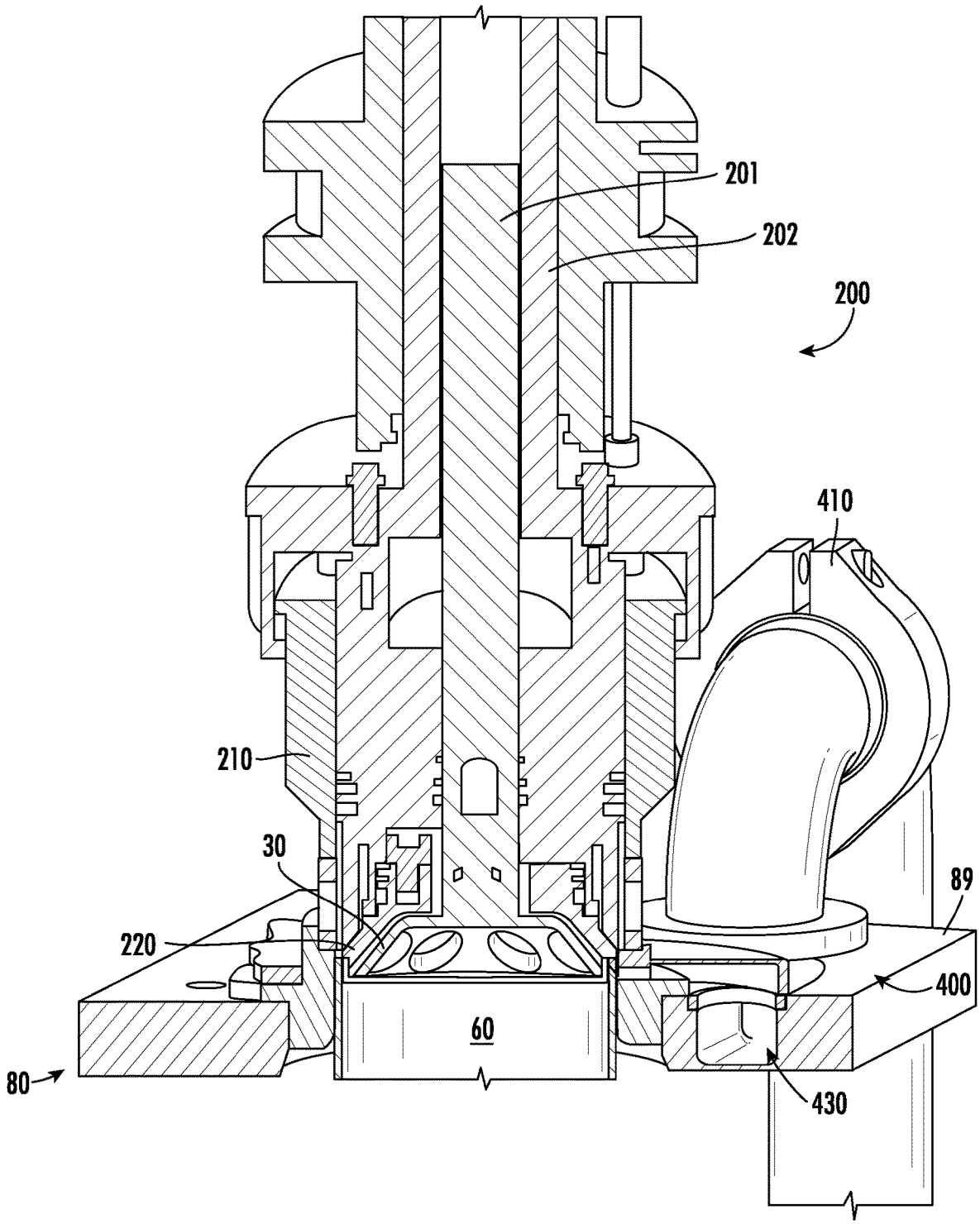
Figure 31:
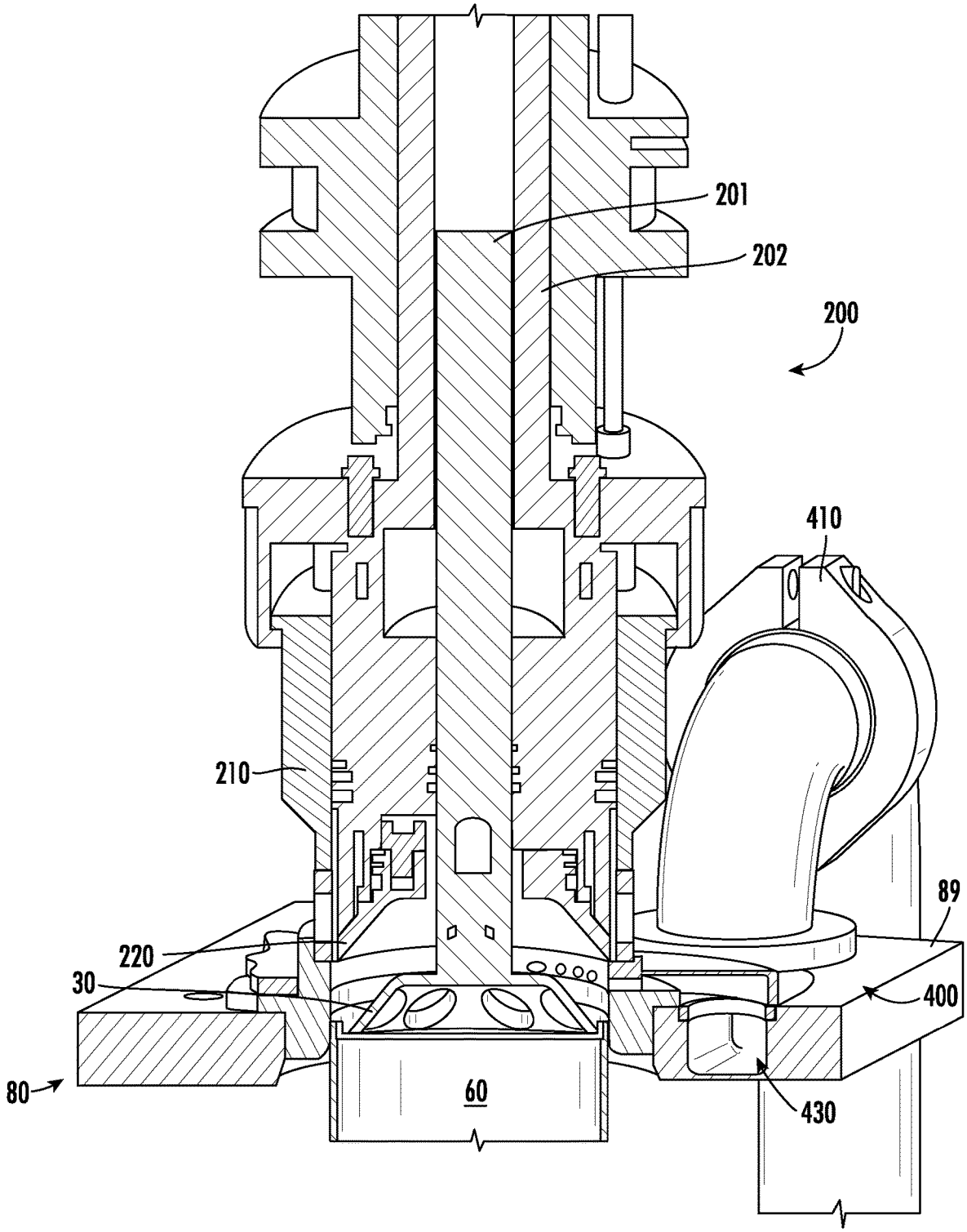
Figure 32:
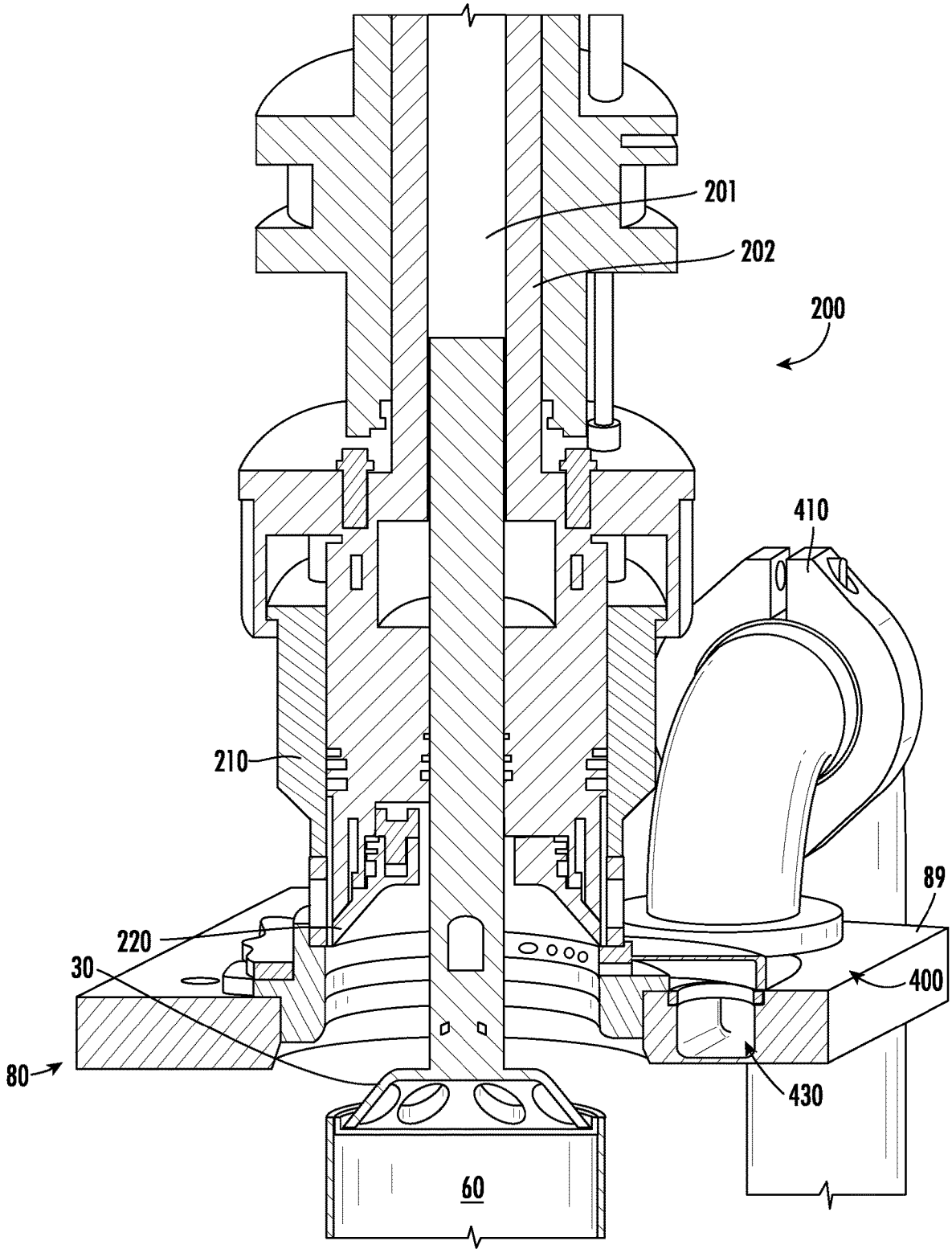

In other embodiments, the sealing member 40 comprises a non-segmented clamping ring (see FIGS. 20-23). FIG. 20 illustrates the inventive system with a non-segmented clamping ring, wherein the system is in its initial state. In FIG. 21, the system moves into position with a disc clamped in place. In FIG. 22, the system moves into the sealing position. FIG. 23 illustrates the removal of the sealing punch while the ejector supports the paper bottom in place. Finally, FIG. 24 illustrates the ejector moving away from the container. FIGS. 20-26 additionally illustrate the connections to the evacuation line. In this embodiment, the sealing member may comprise a static die bush ring. This type of sealing member may be particularly useful in ready-to-eat food processing equipment, which has a high focus on food safety.

In some embodiments, for example a segmented clamping bracket embodiment, the sealing member(s) 40 may be rotatably coupled to the die assembly 300. The sealing member(s) 40 may be complimentarily shaped to one another such that, when the sealing members 40 are in the sealing position, the sealing members substantially surround the work piece in a puzzle-like manner. In other embodiments, the sealing member 40 may comprise a single, unitary member (i.e. a closed ring) which surrounds the container body 60 when the container is in position. When sealing a paper-based disc 50 to a composite body 60, the sealing member(s) 40 may compress the bottom end 62 of the composite body 10 along a substantially complete perimeter of the exterior surface 64. When the composite body 60 has a substantially circular cross-section, a circumference of the composite body 60 may be compressed substantially evenly by the sealing member(s) 40. In some embodiments, three sealing members 40 are present. In other embodiments, one sealing member 40 is present (i.e. a non-segmented clamping ring). It is noted that any number of sealing members 40 may be utilized, however. For example, the sealing system may comprise from about one to about ten sealing member(s) 40. Moreover, the sealing member(s) 40 may each cover substantially equal segments of the composite body or may cover substantially non-equal segments.

The sealing member(s) 40 may be utilized to compress and heat a container body in order to perform a heat-sealing operation. Each sealing member 40 may provide conductive heating to a work piece of up to about 300° C. Moreover, the sealing member(s) 40 may apply a pressure of up to about 30 MPa to a work piece. The sealing member(s) 40 may be adjacent to one another.

Figure 7:
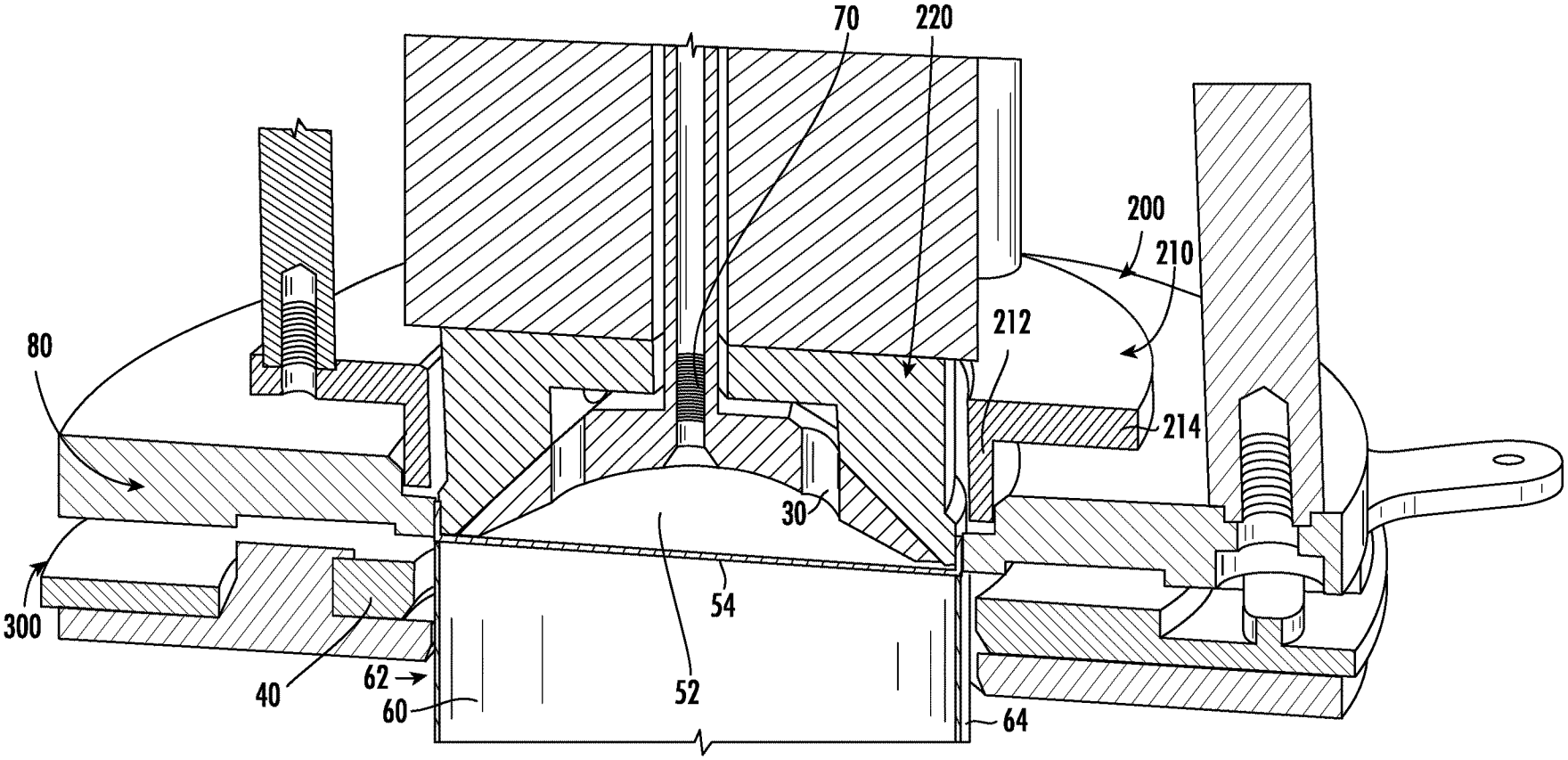
FIG. 7 illustrates a cross-section of an exemplary sealing system, in accordance with some embodiments of the present disclosure.

As the sealing member(s) 40 contact the exterior surface 64 of the container body 60, the container body 60 and the composite closure 51 may be compressed between the second mandrel surface 224 and the sealing members 40. After compression and heat has been applied for a sufficient dwell time, the sealing member(s) 40 may be moved away from the bottom end 62 of the container body 60 such that the sealing member(s) 40 are not in contact with the container body 60 (e.g., as shown in FIG. 7) after the dwell time expires.

Ejector

Once the sealing process is complete, in some embodiments, the mandrel assembly 200 is removed from the container body 60. In an embodiment, the outer mandrel 210 releases and is translated away from the die assembly 300 prior to movement of the inner mandrel 220. In other embodiments, the outer mandrel 210 and inner mandrel 220 simultaneously release and translate away from the die assembly 300.

In some embodiments, an ejector 30 is disposed interior of the inner mandrel 220 to aid in the removal of the mandrel assembly 200 from the container body 60. The ejector 30 may be spring-loaded, in some embodiments. In other embodiments, the ejector 30 may not be spring loaded. In some embodiments, the inner mandrel 220 may or may not be spring loaded. In a further embodiment, the outer mandrel 210 may or may not be spring loaded. In a particular embodiment, only the outer mandrel 210 is spring loaded.

The ejector 30 may have a circumference on its lower end 32 which is less than the circumference of the inner mandrel 220. In this respect, the ejector 30 may be fitted within the inner circumference of the inner mandrel 220 in its retracted position (e.g., as shown in FIG. 12). In some embodiments, the base of the ejector 30 may comprise a cylindrical pyramid. In such an embodiment, the interior of the inner mandrel 220 may comprise a recess which is cylindrically pyramidal, such that the ejector 30 can be fitted into the inner mandrel 220. In an embodiment, the ejector 30 may be perforated and/or may have through holes disposed therein.

In another embodiment, the base of the ejector 30 may comprise a plurality of disc contact sections, each contacting the bottom closure 51, but separated from one another. For example, the ejector may comprise three or four prongs that are flattened at the contact surface with the closure 51, to avoid damage to the closure 51.

In some embodiments, the ejector has a bottom surface 34 designed to contact the bottom closure 51. The ejector 30 may be solid across its bottom surface 34, from one side of the diameter to the other side of the diameter, in some embodiments. In another embodiment, the ejector 30 may have a hollow interior portion, as shown in the figures. In such embodiments, the bottom contact surface 34 may be circular in cross-section. In some embodiments, the bottom surface 34 of the ejector 30 may contact at least a portion of the first deformed surface 53 of the composite closure 51. In some embodiments, the first deformed surface 53 of the closure 51 may comprise a countersink portion of the closure 51. In some embodiments, the bottom surface 34 of the ejector 30 is circumferential and positioned near the second deformed surface 55 of the composite closure 51 when in its extended position (e.g., as shown in FIG. 13).

In some embodiments, the bottom surface 34 of the ejector 30 may be flush with the first (lower) surface 222 of the inner mandrel 220 when the ejector 30 is in its recessed position (e.g., as shown in FIG. 12). In another embodiment, the ejector 30 may be recessed slightly within the inner mandrel 220 such that the bottom surface 34 of the ejector 30 is higher than the first (lower) surface 222 of the inner mandrel 220 when the ejector is in its recessed position.

In some embodiments, the ejector 30 and the inner mandrel 220 (and/or outer mandrel 210) may each translate vertically, separately from one another. That is, the inner mandrel 220 may move a first distance and the ejector 30 may move a second distance, wherein the first and second distances are different from one another. Likewise, the inner mandrel 220 may move at a first time and the ejector 30 may move at a second time, wherein the first and second times are different from one another. In some embodiments, the inner mandrel 220 and the ejector 30 may move in unison during a first time period. In some embodiments, the inner mandrel 220 may have a first extension length and the ejector 30 may have a second extension length, wherein the first and second extension lengths are different from one another.

Figure 8:
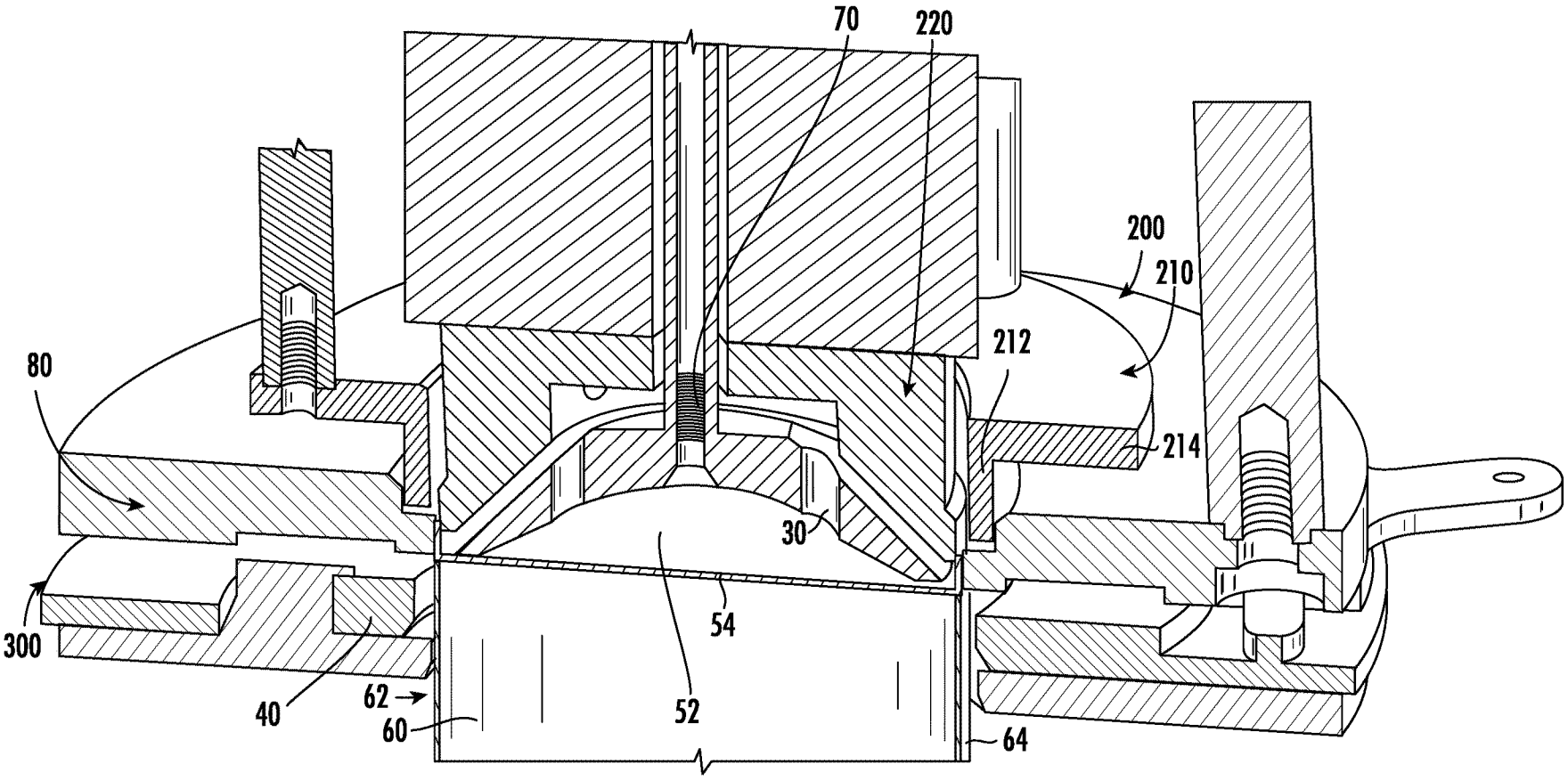
FIG. 8 illustrates a cross-section of an exemplary sealing system, in accordance with some embodiments of the present disclosure.
Figure 9:
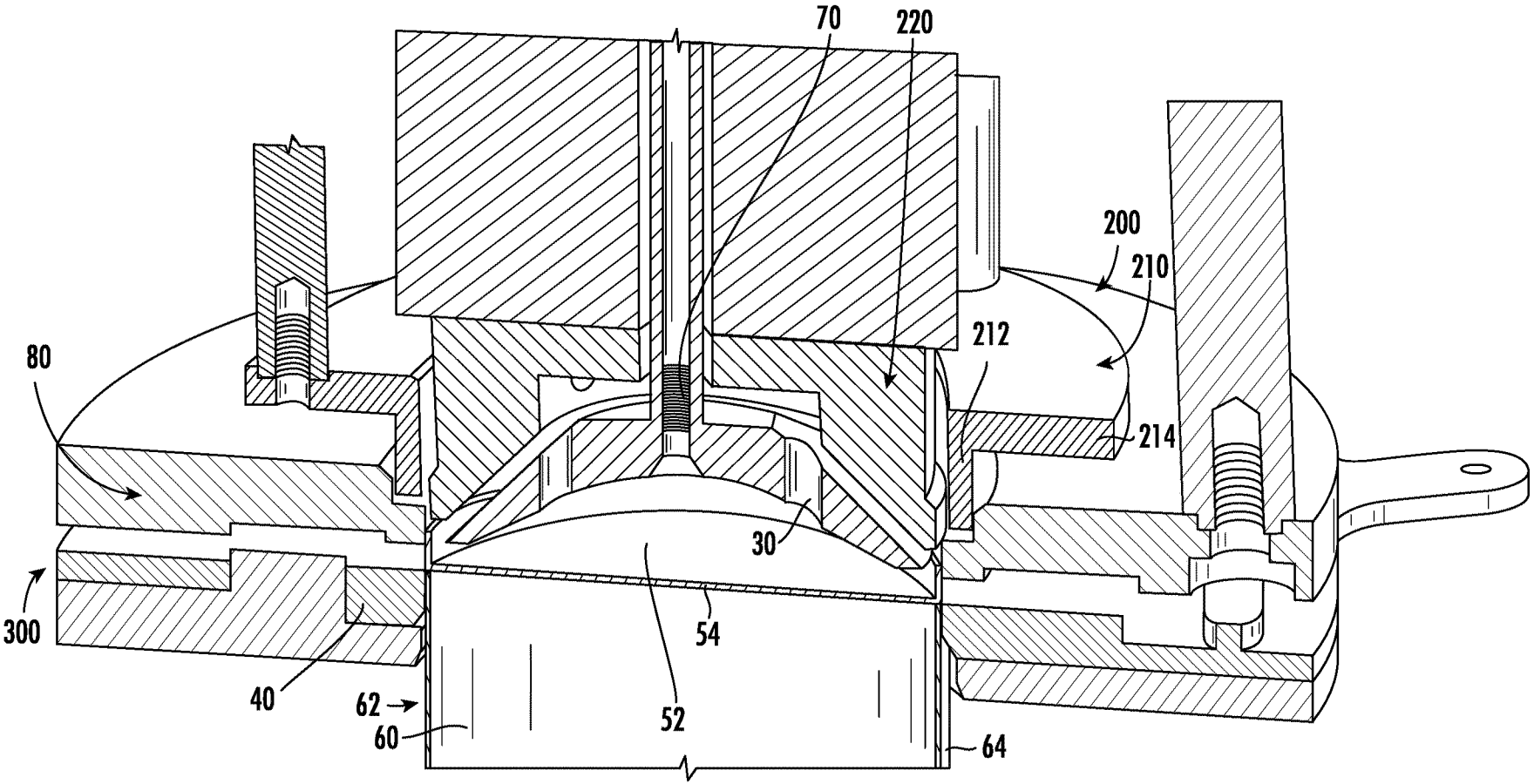
FIG. 9 illustrates a cross-section of an exemplary sealing system, in accordance with some embodiments of the present disclosure.
Figure 13:
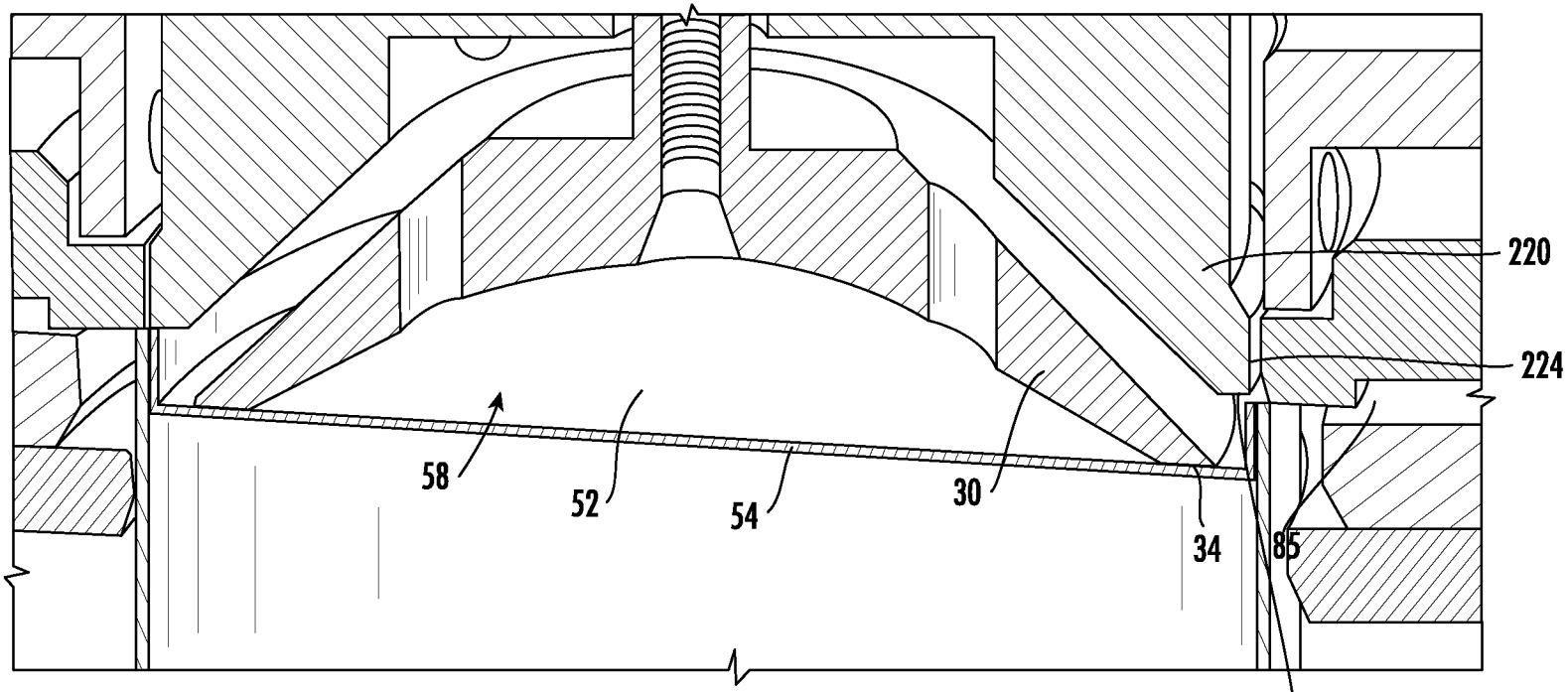
FIG. 13 illustrates a cross-section of an exemplary sealing system, in accordance with some embodiments of the present disclosure.
Figure 14:
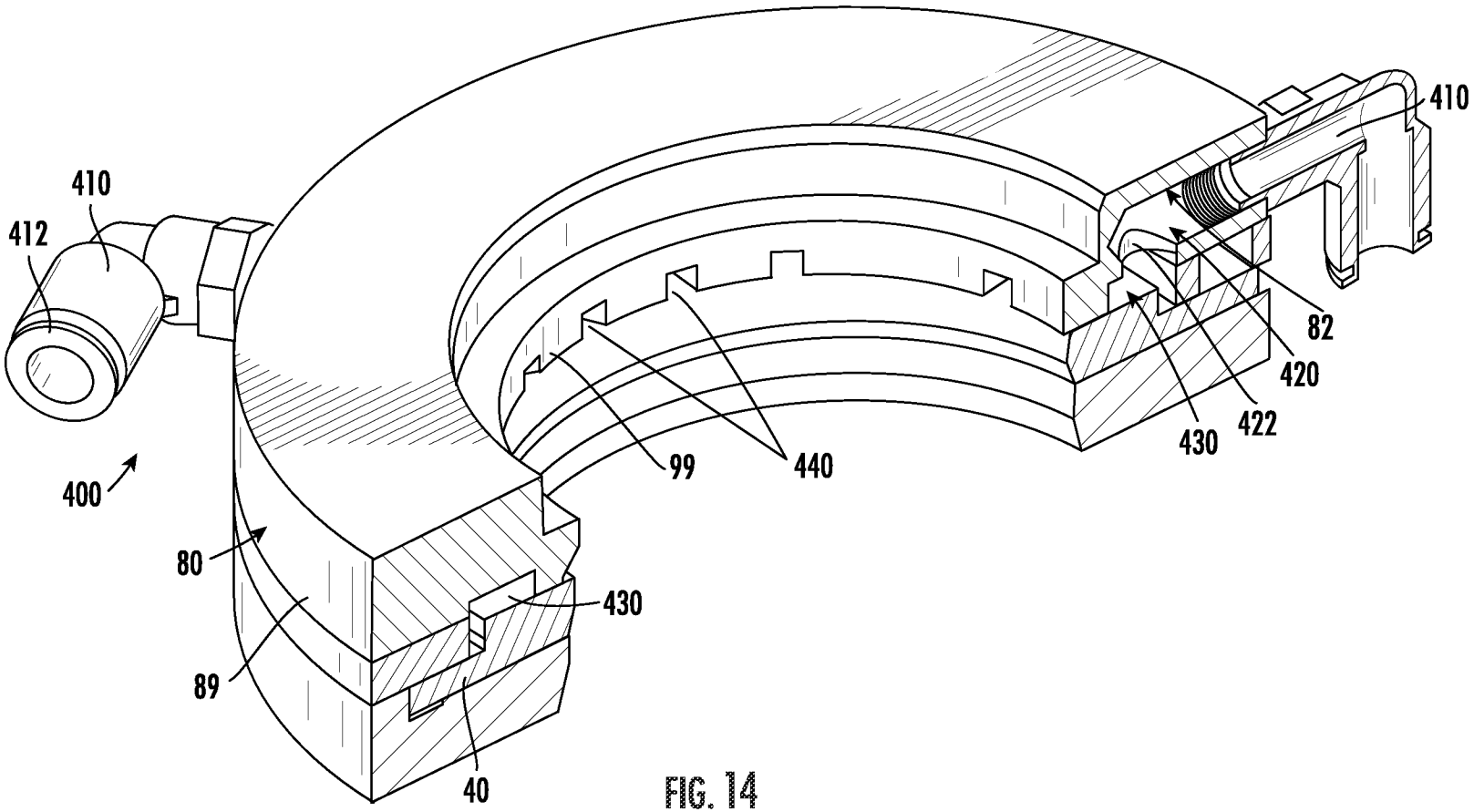
FIG. 14 illustrates a cross-section of an exemplary die and gas evacuation system, in accordance with some embodiments of the present disclosure.
Figure 15:
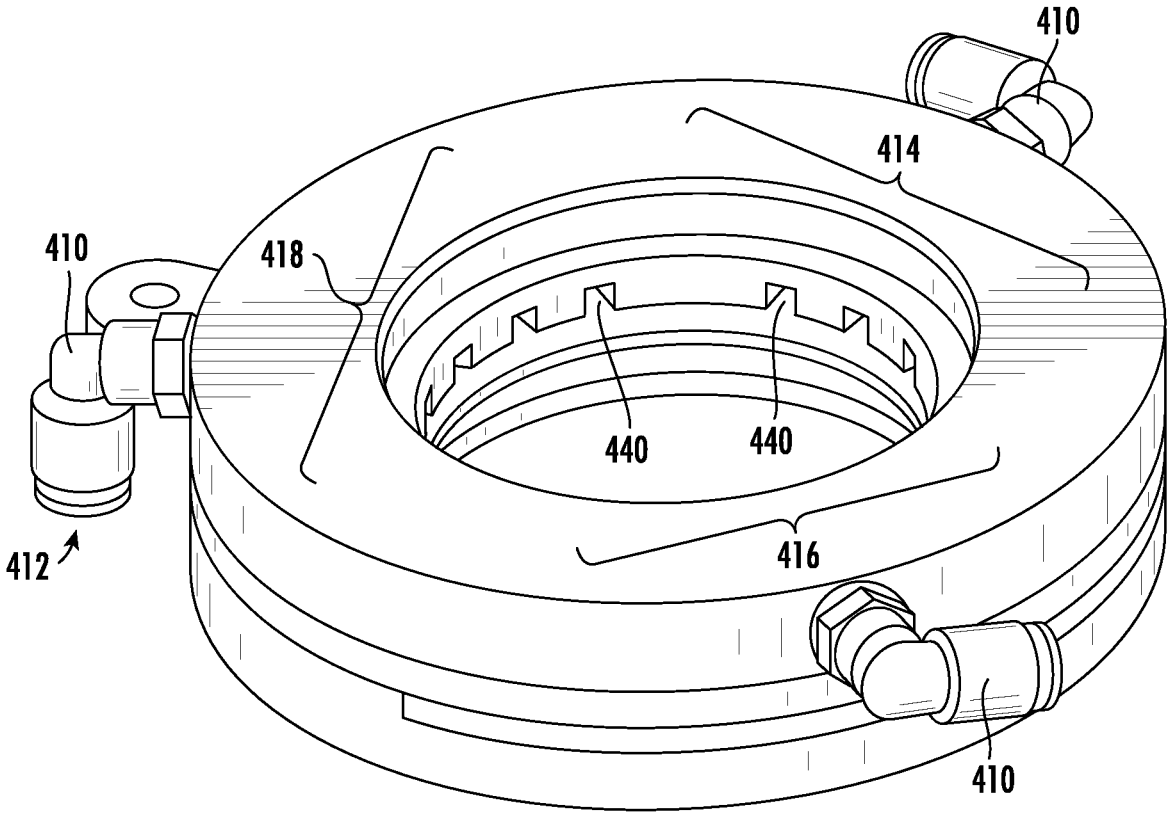
FIG. 15 illustrates an exemplary die and gas evacuation system, in accordance with some embodiments of the present disclosure.
Figure 16:
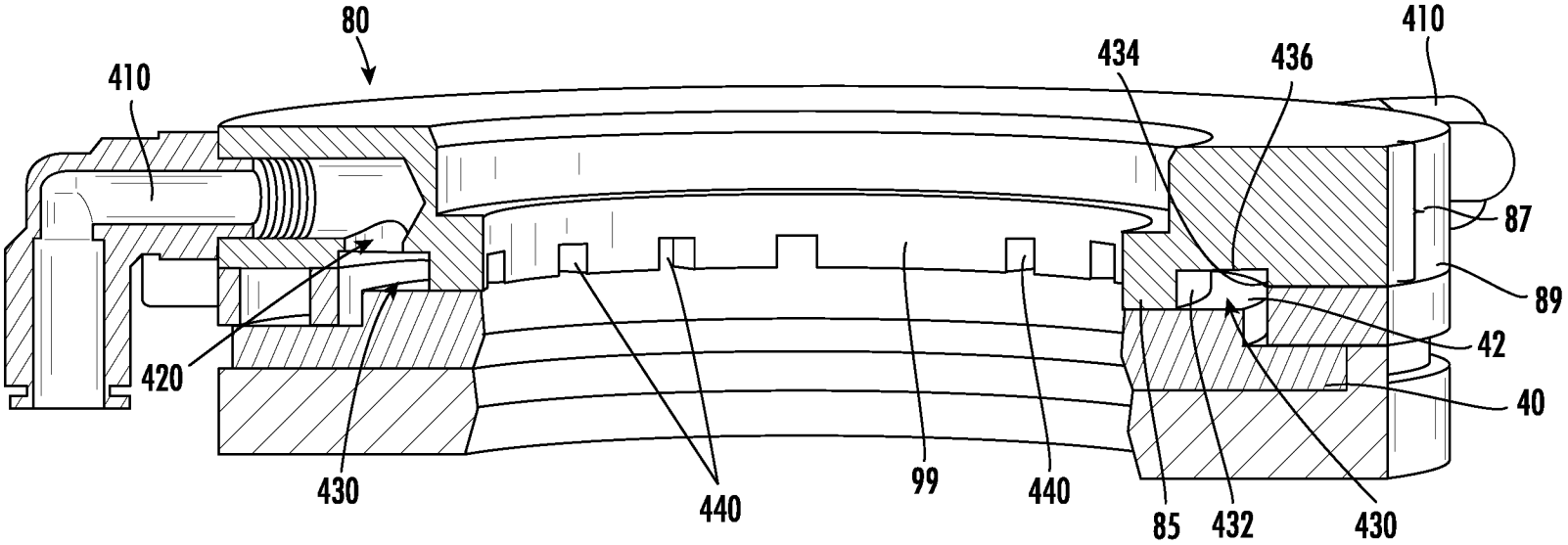
FIG. 16 illustrates a cross-section of an exemplary die and gas evacuation system, in accordance with some embodiments of the present disclosure.

In some embodiments, the inner mandrel 220 (and/or outer mandrel 210) is initially vertically retracted from the container body 60, while the ejector 30 remains positioned adjacent the composite closure 51 (e.g., as shown in FIGS. 8 and 13), retaining the position of the paper-based closure 51 within the container body 60. In such embodiments, a space may be disposed between the outer circumference of the lower end 32 of the ejector 30 and the deformed portion 55 of the closure 51. This position (e.g., as shown in FIGS. 8 and 13) may be referred to as the extended position of the ejector 30. In this embodiment, once the inner mandrel 220 is retracted beyond the peripheral edge 205 of the container body 60, in some embodiments, the ejector 30 is then retracted vertically upward, back into the interior of the inner mandrel 220.

In another embodiment, after the sealing process is complete, the ejector 30 may extend further downwardly than it extended during the sealing process in order to aid in removal of the container 60 from the die assembly 300. That is, the ejector 30 may push the container 60 downwardly via pressure on the closure 51. Alternatively, the ejector 30 may not add pressure to the closure 51, but may translate downwardly with the container 60 and closure 51, in concern with the movement of the container assembly. In this embodiment, the ejector 30 may then retract from contact with the closure 51 and retract into the mandrel assembly 200.

In some embodiments, the ejector 30 comprises a means for delivering a controlled blast of air directed toward the closure 51 concurrent with or just before retraction of the ejector 30 from the closure 51. In some embodiments, the delivery of pressurized air may comprise a shower head mechanism disposed within the ejector 30. In an embodiment, the mandrel assembly 200 comprises an ejector coupling 201 and a mandrel or sealing head coupling 202.

The ejector 30 of the present disclosure avoids the issue caused by a standard mandrel retraction process. That is, a standard mandrel retraction involves dragging the mandrel out of the container assembly (or vice versa), causing friction between the mandrel and the paper-based closure. As the mandrel and the container assembly are separated, any relative movement of the paper-based closure can cause folds, wrinkles, and/or bubbles to form in the seal, reducing or destroying the hermeticity of the container assembly. The ejector 30 of the present disclosure allows stabilization of the position of the paper-based closure within the container body during the process of removing the mandrel (e.g., during outfeed). The ejector 30 helps to ensure the hermeticity of the seal between the closure 51 and the container body 60, over the complete cycle of the paper-based bottom sealing process.

After retraction of both the inner mandrel 220 and the ejector 30, the container may be removed from the die assembly 300 and the mandrel assembly 200, optionally in a vertically downward manner (FIG. 10). In an embodiment, the movement of the inner mandrel 220, the ejector 30, and container may be synchronous. In an embodiment, the inner mandrel 220 and outer mandrel 210 may then fully retract vertically upwardly from the die assembly 300, optionally in a unitary manner (FIG. 11). In an embodiment, the mandrel assembly 200 and the die assembly 300 are then positioned for another insertion, bottom closure formation, and sealing process.

Container Support Assembly

The container support assembly may be configured to retrieve and/or retain a composite body 60 and hold the composite body 60 in a desired location. The container support assembly may comprise a tube support member that is shaped to accept the composite body 60. In some embodiments, the tube support member may lift the container body 60 upwardly vertically to meet the die assembly 300 and the mandrel assembly 200.

Figure 3:
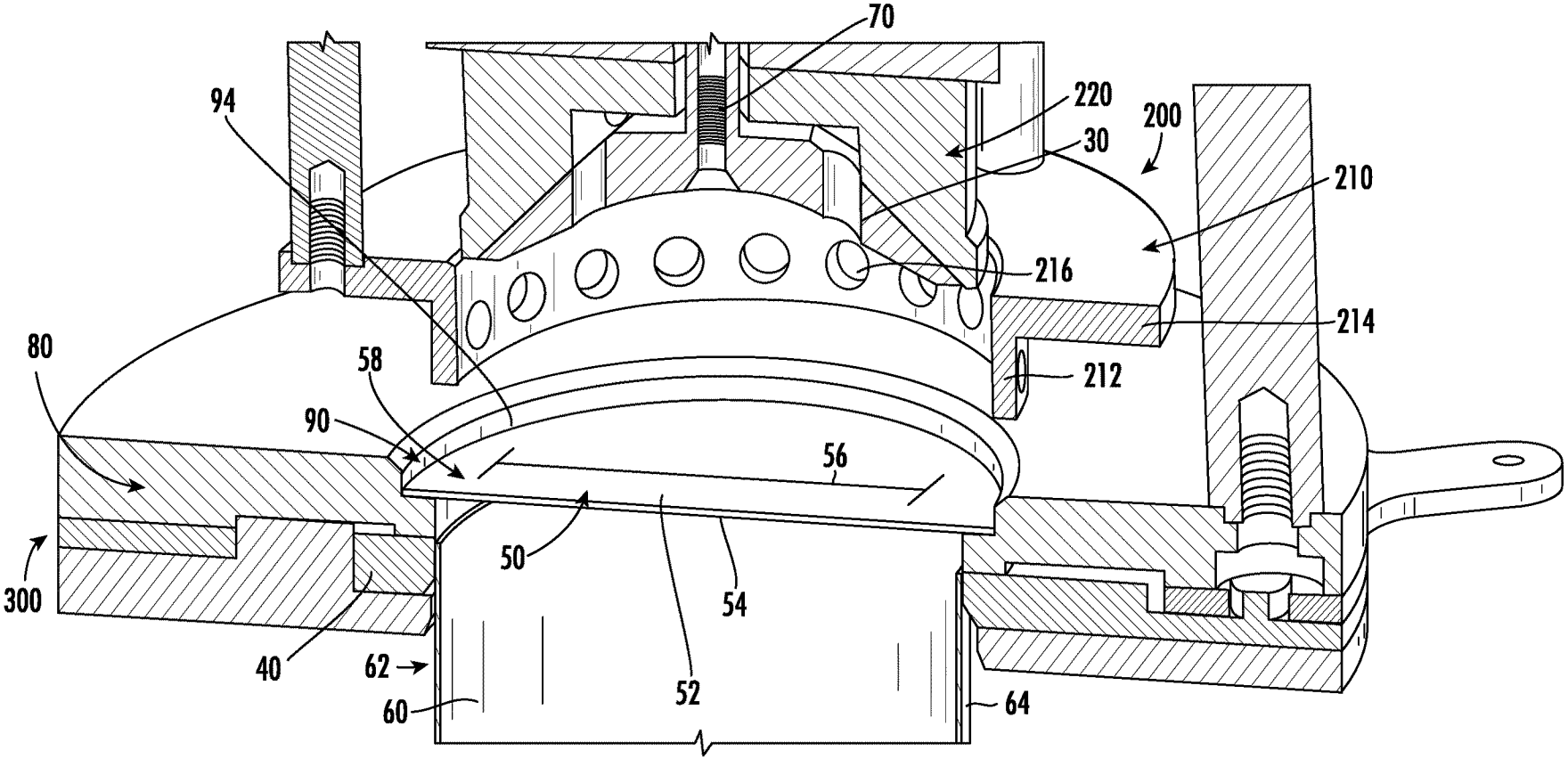
FIG. 3 illustrates a cross-section of an exemplary sealing system, in accordance with some embodiments of the present disclosure.

In an embodiment, the container 60 will be inserted into the die assembly by lifting upwardly and will be fixed in the vertical position in the die assembly by contacting the rim or edge of the container 60 with the lower surface of the die opening 98 (see FIG. 2-3). The container 60 will be in a secured position to avoid relative vertical movements of the container 60 while the inner mandrel 220 moves in and out of the container assembly.

Paper-Based Disc and Bottom Closure

As shown in FIG. 2, in some embodiments, the paper-based disc 50 may have an upper surface 52 and a lower surface 54 that define a sheet thickness. In some embodiments, the paper-based disc 50 may have a thickness in a range of about 0.01-0.6 cm, for example.

The paper-based disc 50 may comprise a layered structure, in some embodiments. For example, the layered structure may comprise a paper-based layer **50*p*, a barrier layer 50*b*, and/or an ionomer layer 50*i* (as discussed in further detail herein). In some embodiments, the ionomer layer 50*i* may form all or at least a portion of the lower surface 54 of the paper-based disc 50 (e.g., as shown in FIG. 17D). The paper-based disc 50 may comprise a central portion 56 and a peripheral portion 58. The central portion 56 and the peripheral portion 58 may be substantially flat, in some embodiments. For example, the paper-based disc 50 may be cut or shaped into a circular disc. In other examples, the paper-based disc 50 may be cut or formed into a domed disc (not depicted) such that the central portion 56 is offset along the Y-axis from the perimeter portion 58**.

After formation, the paper-based disc 50 becomes a bottom closure 51 (e.g., as shown in FIG. 11). The bottom closure 51 may have a first deformed surface 53 and a second deformed surface 55. The first deformed surface 53 may be substantially horizontal, in some embodiments. In some embodiments, the first deformed surface 53 comprises the central portion 56 of the paper-based disc. In another embodiment, the second deformed surface 55 may be substantially vertical and/or may comprise the peripheral portion 58 of the paper-based disc. In some embodiments, the interior-facing side (e.g., the lower surface 54 of the paper-based disc 50) of the first deformed surface 53 may be adjacent the container interior of the container body 60, and the interior-facing side (e.g., the lower surface 54 of the paper-based disc 50) of the second deformed surface 55 may be adjacent the interior surface 66 of the sidewall 63 of the container body 60. As discussed in further detail herein, in some embodiments, the ionomer layer **50*i* of the paper-based disc 50 within the second deformed surface 55 may be heat-melted to form a seal with the interior surface 66 of the sidewall 63 of the container body 60**.

Methods

In use, the sealing system 100 accepts a disc 50 and seats the disc 50 within the positioning portion 90 of the die assembly 300, optionally using vacuum pressure to properly seat the disc. In some embodiments, a container body 60 is then lifted via lifting plates toward the die assembly 300 until the peripheral edge 205 of the container body 60 contacts the lower surface of the die 80. In such embodiments, the interior surface 66 of the container body 60 may be flush with the die opening 98. The outer mandrel 210, in some embodiments, is then vertically translated downward toward the disc 50 until the outer mandrel 210 contacts the peripheral portion 58 of the disc 50, constraining it in place. More particularly, the vertically extending portion 212 of the outer mandrel 210 may be configured to secure the disc 50 in place (e.g., as shown in FIG. 4).

Once the disc 50 is clamped in place via the outer mandrel 210 (e.g., the vertically extending portion 212 thereof), the open end (bottom) of the container body 60 is isolated from the surrounding atmosphere. The force of the outer mandrel 210 against the disc 50 may create an airtight or nearly airtight condition within the container 60, between the container 60 and the disc 50. The gas valve(s) are then opened, if necessary, and air is vacuumed out of the container interior, through the channel openings 440 and channel 430, thus creating an underpressure condition within the container interior. More particularly, the side channel pump may be designed to suction a defined volume of gas from the container interior. The defined volume of gas may be related to the size and volume of the container 60 and the depth to which the disc 50 is to be inserted into the container body 60 for sealing thereto. More particularly, the defined volume of gas may be defined as the insertion depth of the formed paper bottom multiplied by the interior cross-sectional surface of the container. In any embodiment, the volume of gas which is evacuated should be less than that which would cause collapse of the container 60. In some embodiments, the speed at which gas is evacuated from the container may be adjusted. For example, some containers, such as containers having a larger interior volume, may have a greater risk of collapse using a high speed gas evacuation process. In some cases, the vacuum level may be adjusted. For example, a process using a higher vacuum pressure may require a lower flow rate for the gas evacuation process. A process using a lower vacuum pressure may require a higher flow rate for the gas evacuation process. One of skill in the art would understand these variations.

In some embodiments, the gas evacuation process may occur over a period of about 60 msec or less. In other embodiments, the gas evacuation process may occur over a period of about 40 msec to about 50 msec. In some embodiments, the gas evacuation process may occur over a period of about 200 msec or less.

When the side channel pump is triggered, air within the tubes, connector 410, and valve 420 may be suctioned into the side channel pump. Further, air within the channel 430, channel openings 440 and container interior may be suctioned into the side channel pump. Without releasing the pressure between the outer mandrel 210 and the disc 50, the paper disc 50 is then immediately inserted into (or punched into) the container body 60 in a recessed fashion via the inner mandrel 220. The suction and insertion steps may occur simultaneously or nearly simultaneously. That is, the air may be suctioned from the container interior a fraction of a second prior to insertion of the disc 50 into the container body 60.

In some embodiments, insertion of the disc 50 into the container body 60 is accomplished via the inner mandrel 220. In such embodiments, the inner mandrel 220 and the ejector 30 may continue to translate vertically downward toward the disc 50. The inner mandrel 220 and the ejector may then contact the disc 50 and urge the disc 50 downward, through the die opening 98, until the disc 50 becomes deformed such that it has a flat central portion and a deformed sidewall 55 adjacent the interior surface 66 of the container body 60. In one embodiment, pressure may be applied to the disc by the first mandrel surface 222 and/or second mandrel surface 224 of the inner mandrel 220 (e.g., by actuating the inner mandrel 220 along the Y-direction).

The deformed composite closure 51 may then be hermetically sealed to the container body 60. In some embodiments, this occurs without releasing the inner mandrel and die pressures which maintain the underpressure condition within the container interior. Compression and heat may be applied to the deformed composite closure 51 and/or the container body 60 such that their respective sealant layers form a hermetic seal. In some embodiments, heat is provided via at least the sealing members 40. Likewise, the sealing members 40 and the second mandrel surface 224 of the inner mandrel 220 may provide opposing pressure to the exterior surface 64 of the container body 60 and/or or the deformed sidewall 55 of the bottom closure 51.

Hermetic seals, according to the present disclosure, may be formed by sealing members 40 at a temperature greater than about 90° C. such as, for example, 120° C. to about 280° C. or from about 140° C. to about 260° C. Suitable hermetic seals may be formed by keeping the sealing member(s) 40 in contact with the bottom end 62 of the composite body 60 for any dwell time sufficient to heat a sealant layer to a temperature suitable for forming a hermetic seal such as, for example, less than about 5 seconds, from about 0.8 seconds to about 5.0 seconds or from about 1 second to about 4 seconds. The bottom closure 51 and the bottom end 62 of the composite body 60 may be compressed between the sealing members 40 and the inner mandrel 220 with any pressure less than about 30 MPa such as a pressure from about 1 MPa to about 22 MPa.

After compression and/or heat has been applied for a sufficient dwell time, the sealing members 40 may be moved away from the bottom end 62 of the container body 60 such that the sealing members 40 are not in contact with the composite body 10 (e.g., as shown in FIG. 7) after the dwell time expires. The inner mandrel 220 may then be retracted from the closure 51, while the ejector 30 remains in place. Once the inner mandrel 220 at least clears the peripheral edge of the container body 60, the ejector 30 is then retracted, optionally accompanied by a blast of pressurized air to aid in a smoot retraction process. The ejector 30 is then fully retracted into the interior of the inner mandrel 220. The container body 60 is then moved away from the die assembly 300 and mandrel assembly 200, prior to, during, or after the full retraction of the mandrel assembly 200 from the die assembly 300.

In some embodiments, the systems and methods described herein may produce hermetically-sealed container assemblies having a paper-based, composite bottom closure which is inserted into a composite container body and sealed in a recessed position without causing doming of the membrane seal (e.g., the membrane seal on the top end) due to overpressure within the container interior. Because the top seal membrane is not domed, there are no instability issues. The container assembly can stably stand on its membrane end (upside down) as it is being conveyed to a downstream packaging process (e.g., from the sealing machine to the case packer). Further, an overcap will easily fit onto the top end of the container assembly over the top closure (e.g., peelable membrane) because the top closure is not domed.

Further, the hermetically-sealed container assemblies of the present disclosure may be transported worldwide via, for example, shipping, air transport or rail, subjected to varying atmospheric conditions (e.g., caused by variations in temperature, variations in humidity, and variations in altitude), without unacceptable doming of the membrane lid.

In certain embodiments, a plurality of composite container assemblies may be formed by a system or device suitable for processing multiple paper-based discs, bottom closures, and composite container bodies in a synchronized manner. For example, a manufacturing system may include a plurality of mandrel assemblies, a plurality of die assemblies, a plurality of gas evacuation assemblies and a plurality of tube support assemblies operating in a coordinated manner. Specifically, a turreted device with a plurality of sub-assemblies wherein each sub-assembly comprises a mandrel assembly, a die assembly, a gas evacuation assembly and a tube assembly may accept discs and process the discs simultaneously or synchronously. Depending upon the complexity of the turreted device, hundreds of separate composite container assemblies may be manufactured per cycle in a coordinated manner. Thus, any of the processes described herein may be performed contemporaneously. For example, when each sub-assembly operates in a synchronous manner, each of the following may be performed contemporaneously: a first paper-based disc may be positioned above a die opening; a second paper-based disc may be constrained between a mandrel assembly and a die assembly; a third paper-based disc may be formed into a first bottom closure via insertion into a first composite body; and a third bottom closure may be hermetically sealed to a second composite body. Alternatively, any of the operations described herein may be performed simultaneously such as, for example, by a device having a plurality of sub-assemblies.

In some embodiments, the systems and methods of the present disclosure allow sealing system to operate at high speeds (e.g., over 300 container assemblies per minute). In some embodiments, the systems and methods of the present disclosure allow sealing system to operate at a speed of at least 400 container assemblies per minute. In some embodiments, the systems and methods of the present disclosure allow sealing system to operate at a speed of at least 500 container assemblies per minute.

It should be understood that the present disclosure provides for hermetically-sealed container assemblies for packaging humidity-sensitive and/or oxygen-sensitive solid food products such as, for example, crisp carbohydrate-based food products, salted food products, crisp food products, potato chips, processed potato snacks, nuts, and the like. Such hermetically-sealed container assemblies may provide a hermetic closure under widely varying climate conditions of high and low temperature, high and low humidity, and high and low pressure. Moreover, the hermetically-sealed container assemblies can be manufactured according to the methods described herein via processes involving thermo transfer heating technology or conductive heating technology with relatively low environmental pollution. The hermetically-sealed container assemblies described herein may have high structural stability at low weight and be suitable for recycling.

In some embodiments, the systems and methods described herein may produce hermetically sealed container assemblies having a paper-based, composite bottom closure which may be a paper-based disc inserted into the open bottom end of a composite container body and sealed in a recessed position without causing doming of a top closure (e.g., peelable membrane) sealing the top end. In a typical insertion process—in which the paper-based disc is transformed into a recessed bottom closure—increased pressure within the container interior (due to the insertion process itself) causes the top closure to expand outward or "dome." In other words, when the bottom end closure is inserted into the open bottom end of the container body and sealed in place, it pushes the air within the container interior into a smaller space to accommodate the recessed bottom end closure. That increased pressure expands outward into the most flexible component, which is typically the top closure (e.g., membrane lid).

Domed membrane lids are not only aesthetically displeasing, but may also cause certain manufacturing issues. For example, domed membranes may cause instability. In some cases, the container assemblies with doming issues cannot stably stand on their membrane end (top side down) while being conveyed to a downstream packaging process (e.g., from the sealing machine to the case packer). Further, an overcap may not fit onto the container assembly if the top membrane is domed, making the package unacceptable for sale.

Thus, in some embodiments, the systems and methods disclosed herein provide mechanisms for applying a paper-based disc to a paper-based container body to become a recessed paper-based bottom closure without introducing unacceptable levels of doming of the flexible top closure (e.g., peelable membrane). More particularly, the systems and methods of the present disclosure may allow gas evacuation simultaneously with or just before the sealing process occurs. In some embodiments, the present method and systems allow an adjustably defined volume of gas to be evacuated from the container interior. In some embodiments, this defined volume of gas is directly correlated to the desired depth of the recessed bottom closure, thereby avoiding an overpressure situation within the container interior.

EXAMPLES

In the following examples, paper-bottom containers of the invention (composite container, paper bottom, membrane cover, and overcap) were tested for various characteristics. The paper bottom of the tested containers comprised a flexible board (i.e. cup stock) as the paper layer (195 g/m$^2$ (0.3 mm thickness)), a tie layer, aluminum foil (8 μm) as a barrier layer, and an ionomer layer (32 g/m$^2$) as a sealant layer. In some containers, a PET layer was included to protect the aluminum barrier layer. In other embodiments, an aluminum barrier layer was not included. All versions passed the testing, as indicated below.

Example 1

In the high altitude testing, the inventive containers were placed into a sealed chamber and the pressure within the chamber was increased to at least 11 inHg over a period of about 10 minutes. If the containers can withstand up to 10 inHg (simulating the atmospheric pressure as containers travel over the Rocky Mountains) for at least 10 minutes, the containers passed the test. If not, the containers are listed as "missed". As used herein, "Rocker Bottoms Observed" means during the vacuum chamber confinement, the membrane and/or paper bottom domed due to the overpressure conditions, which is normal under such conditions. After removal from the container, the doming returned to neutral. Doming may constitute the membrane or paper bottom moving outwardly from the interior of the container such that it extends beyond the relevant cut edge of the container.

A miss or failure includes a leak, a peeling membrane or paper bottom, a retained distortion after pressure is released, a split or delamination of a seam, a bursting of a membrane or paper bottom, and/or another other failure that would prevent the container from meeting hermeticity standards. If a membrane or paper bottom domes inwardly into the can upon pressure release, this may indicate a leakage failure. The test results are set forth below.

TABLE 1a

High Altitude Testing ("HAT") Results.

| Batch # | Batch Size | HAT (10" Hg/10 min) | Rocker Bottom Observed |
|---|---|---|---|
| 1 | 1027 containers | 0 missed | ~−11 inHg |
| 2 | 558 containers | 0 missed | ~−11 inHg |
| 3 | 435 containers | 0 missed | ~−11 inHg |
| 4 | 550 containers | 0 missed | ~−11 inHg |
| 5 | 232 containers | 7 missed | ~−11 inHg |
| 6 | 258 containers | 1 missed | ~−11 inHg |
| 7 | 1667 containers | 16 missed | ~−11 inHg |
| 8 | 193 containers | 5 missed | ~−11 inHg |

The testing indicated a 99.4% success rate for the paper bottoms as described herein, which is acceptable.

TABLE 1b

High Altitude Testing Results

| Batch # | Batch Size | HAT Failure | Rocker Bottom Observed |
|---|---|---|---|
| | | Standard Laminates | |
| 1 | 20 containers | 0 missed Failure at −15.8 in Hg | ~−13 in Hg |
| 2 | 20 containers | 0 missed Failure at −15.4 in Hg | −13 to −14 in Hg |
| 3 | 25 containers | 1 missed Failure at −14.5 in Hg | n/a |
| 4 | 25 containers | 2 missed Failure at −13.5 in Hg | n/a |
| 5 | 25 containers | 0 missed Failure at −14.8 in Hg | −12 to −13 in Hg |
| 6 | 25 containers | 0 missed Failure at −14.8 in Hg | −13 to −14 in Hg |
| 7 | 10 containers | 0 missed Failure at −14.5 in Hg | −11.6 in Hg AVG |
| 8 | 10 containers | 0 missed Failure at −15.7 in Hg | −11.4 in Hg AVG |
| | | Light Weight Laminates | |
| 11 | 10 containers | 0 missed Failure at −16.2 in Hg | −9.8 in Hg |
| 12 | 10 containers | 0 missed Failure at −16.4 in Hg | −9.5 in Hg |
| 13 | 10 containers | 0 missed Failure at −14.7 in Hg | −9.5 in Hg |
| 14 | 10 containers | 0 missed Failure at −13.8 in Hg | −8.8 in Hg |

The testing indicated a 98% success rate for standard laminates and a 100% success rate for lightweight paper bottoms as described herein, which is acceptable.

Example 2

In this example, inventive containers were subjected to helium leak testing. Helium can be used as a tracer gas to detect leaks because it constitutes only about 5 ppm in the atmosphere, so background levels are very low. Helium has also relatively low mass so that it is mobile and is completely inert/non-reactive. The sealed inventive containers were placed in a sealed vacuum chamber and the vacuum chamber was then flooded with helium at 130 mbar. A sniffer/leak detector was connected to the container so that a sample of gas from within the container could be drawn off and passed through a mass spectrometer to read increases over the background reading of helium levels in the container. In this example, the helium leakage limit was $2.3\times 10^{-4}$ mbar*l/s. A success rate of 99.8% was observed. This result is acceptable.

TABLE 2

Helium Leak Testing ("HLT") Results

| Batch # | Batch Size | HLT (130 mbar); limit: $2.3 * 10^{-4}$ mbar * l/sec | Rocker Bottom Observed |
|---|---|---|---|
| 1 | 1027 containers | 2 missed | None |
| 2 | 558 containers | 2 missed | None |

Example 3

In this example, inventive containers were subjected to container integrity testing. The containers were placed under 200 mbar pressure in a vacuum chamber and vacuum decay was measured over a 20 second period. The method uses a pressure change measurement to indirectly determine the flow from the container into the fixed volume chamber. The mass extraction variant measures the flow required to maintain the vacuum at a fixed level (ASTM F2338 and ASTM F 3287). If the container has a leak, it will reduce the expected vacuum inside the vacuum chamber. The vacuum drop or decay was measured per second. The success/failure threshold was set at 42 Pa/s. A success rate of 98.6% was observed. This result is acceptable.

TABLE 3

Container Integrity Test ("CIT") Results

| Batch # | Batch Size | CIT (200 mbar, 20 sec) | Rocker Bottom Observed | Failure Type |
|---|---|---|---|---|
| 1 | 10 containers | 0 missed | none | none |
| 2 | 10 containers | 0 missed | none | none |
| 3 | 14 containers | 0 missed | none | none |
| 4 | 14 containers | 0 missed | none | none |
| 5 | 60 containers | 2 missed | none | none |
| 6 | 35 containers | 0 missed | none | none |
| 7 | 3247 containers | 44 missed | none | none |

Example 4

In this example, inventive containers were subjected to container Periodic Test Interval ("PTI") testing. The containers were placed under 700 mbar pressure in a vacuum chamber and vacuum decay was measured over a 20 second period. The vacuum drop or decay was measured per second. The success/failure threshold was set at 20 Pa/s. A success rate of 96% was observed. This result is acceptable.

TABLE 4

PTI Testing Results

| Batch # | Batch Size | PTI (700 mbar, 20 sec) | Rocker Bottom Observed | Failure Type |
|---|---|---|---|---|
| 1 | 26 containers | 1 missed | none | none |
| 2 | 25 containers | 1 missed | none | none |

Example 5

In this example, the inventors analyzed simulated shelf life of the inventive containers. The containers were filled, sealed, and stored having a residual oxygen level of 0.0%. The containers were then tested for residual oxygen levels after 6 months and 9 months. The success/failure threshold was set at less than or equal to 2.0% residual oxygen over these time periods (a threshold of 4.0%-4.5% may be acceptable after about 18 months). A success rate of 92% was observed. This result is acceptable.

TABLE 5

Simulated Shelf Life Results

| Container Age | Batch Size | Measured Residual Oxygen in Containers that Passed | Failures |
|---|---|---|---|
| 6 months | 19 containers | Between 0.32% and 0.34% | 3 missed (due to mechanical damage to the container) |
| 6 months | 39 containers | 0.0% | 4 missed |
| 9 months | 39 containers | 0.0% | 1 missed |

Example 6

Figure 37:
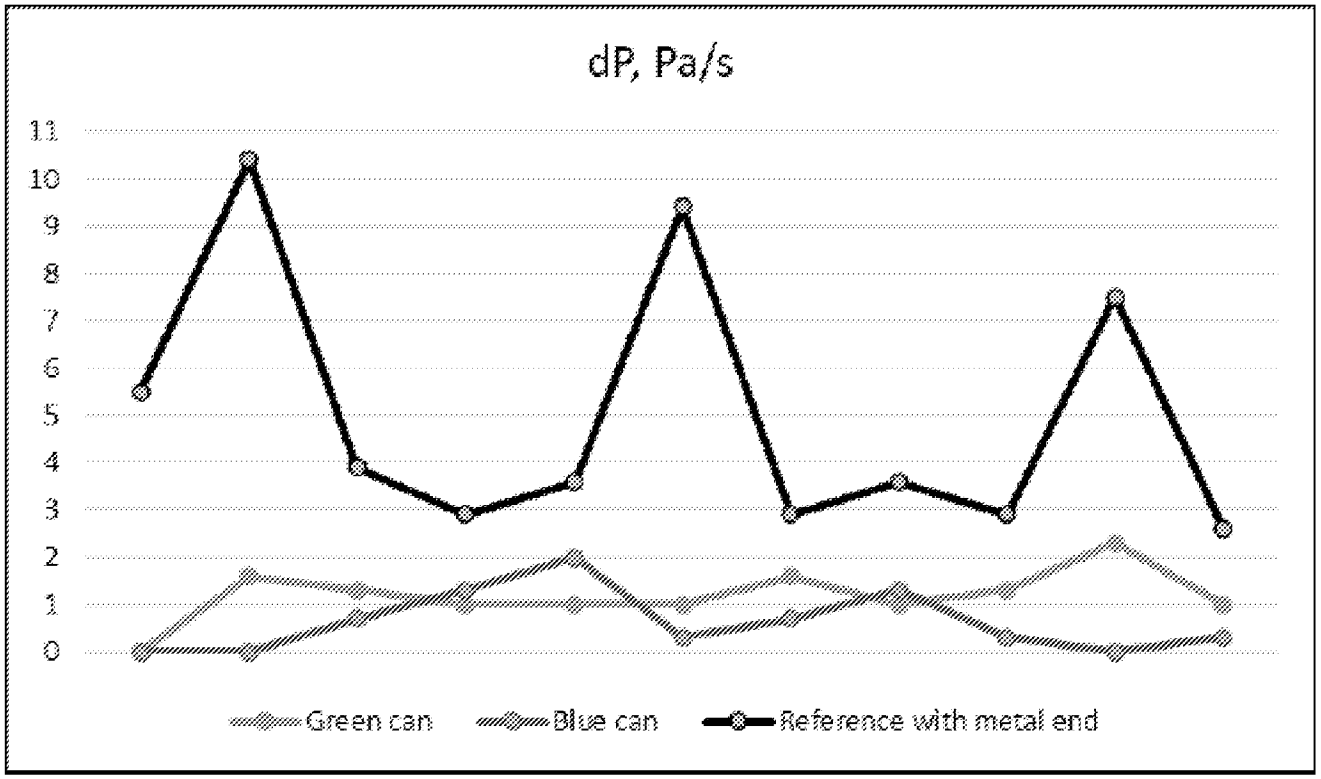
FIG. 37 illustrates a graph comparison of leak detection in inventive paper bottom closures as compared to metal bottom closures.

In this example, the inventors compared the leakage of containers having the inventive paper bottom closures to containers having a metal bottom closure using the vacuum decay methods described herein. The drop in pressure was measured in Pa/s for the cans. The "blue" and "green" cans are paper bottom containers while the "Reference with metal end" comprises metal bottom containers. As can be seen, the paper bottom containers have overall less pressure drop during the vacuum decay than the containers having metal bottom ends. FIG. 37 illustrates a graph of the results. Overall, the paper bottoms of the invention outperformed the metal bottoms in terms of consistency of avoiding leaks.

What is claimed is:

1. A paper-based container assembly comprising:

a paper-based rigid container body comprising:

at least one sidewall defining a container interior, a top rim circumscribing a top end of the at least one sidewall, and a bottom peripheral edge circumscribing a bottom end of the at least one sidewall;

a paper-based top closure affixed to the top rim; and a paper-based bottom closure recessed into the bottom end and forming a seal with an interior surface of the container body;

wherein at least one of the container body and bottom closure comprise a plurality of paper-based layers and one or more barrier layers; and wherein the paper-based container assembly has an oxygen transmission rate of about 0.5 $cm^3/m^2/day$ or less, a water vapor transmission rate of about 0.5 $g/m^2/day$ or less, and can withstand at least 10 inHG for at least 10 minutes.

2. The paper-based container assembly of claim 1, wherein the oxygen transmission rate of the paper-based container assembly is about 0.05 $cm^3/m^2/day$ or less.

3. The paper-based container assembly of claim 1, wherein the water vapor transmission rate of the paper-based container assembly is about 0.05 $g/m^2/day$ or less.

4. The paper-based container assembly of claim 1, wherein:

the plurality of layers includes one or more ionomer layers within at least one of the container body and the bottom closure; and the one or more ionomer layers are of the same grade and, when heated, form a seal between the bottom closure and the interior surface of the container body.

5. The paper-based container assembly of claim 1, wherein each of the container body, top closure, and bottom closure comprise a plurality of layers including one or more barrier layers and one or more paper-based layers.

6. The paper-based container assembly of claim 5, wherein the one or more paper-based layers of the container body, top closure, and bottom closure comprise at least about 95% by mass of the paper-based container assembly.

7. The paper-based container assembly of claim 5, wherein the one or more barrier layers of at least one of the container body, top closure, and bottom closure comprise metalized polyethylene terephthalate (MPET).

8. The paper-based container assembly of claim 5, wherein the one or more barrier layers of at least one of the container body, top closure, and bottom closure comprise aluminum.

9. The paper-based container assembly of claim 5, wherein the one or more barrier layers of at least one of the container body, top closure, and bottom closure comprise metalized polybutylene terephthalate (MPBT).

10. The paper-based container assembly of claim 5, wherein the one or more barrier layers of at least one of the container body, top closure, and bottom closure comprise aluminum oxide (AlOx) coated polyethylene terephthalate (PET).

11. The paper-based container assembly of claim 1, wherein the plurality of layers includes one or more tie layers.

12. The paper-based container assembly of claim 1, wherein the bottom closure is recessed into the bottom end of the container body at a recessed distance within a range of about 0.2-2 cm.

13. The paper-based container assembly of claim 1, wherein the seal between the interior surface of the container body and the bottom closure is hermetic.

14. The paper-based container assembly of claim 1, wherein the container body is cylindrical.

15. The paper-based container assembly of claim 1, wherein the top closure comprises a peelable membrane sealed to the top rim.

16. A paper-based container assembly comprising:
a rigid container body comprising:
at least one sidewall, wherein the at least one sidewall comprises:
one or more paper-based layers adhered to one or more barrier layers; and one or more ionomeric layers adhered to the one or more barrier layers, wherein the one or more ionomeric layers define a container interior;
a top rim circumscribing a top end of the at least one sidewall, and
a bottom peripheral edge circumscribing a bottom end of the sidewall;
a top closure sealed to the top rim, wherein the top closure comprises:
one or more paper-based layers adhered to one or more barrier layers; and
one or more peelable sealant layers adhered to the one or more barrier layers; and
a bottom closure recessed into the bottom end and forming a seal with an interior surface of the cylindrical container body, wherein the bottom closure comprises:
a plurality of cup stock board layers adhered to one or more barrier layers; and
one or more ionomeric layers adhered to the one or more barrier layers,
wherein:
the one or more paper-based layers of the cylindrical container body, top closure, and bottom closure comprise at least about 95% by mass of the paper-based container assembly, and
the paper-based container assembly has an oxygen transmission rate of about 0.5 $cm^3/m^2$/day or less, a water vapor transmission rate of about 0.5 $g/m^2$/day or less, and can withstand at least 10 inHG for at least 10 minutes.

17. The paper-based container assembly of claim 16, wherein the sidewall at least one barrier layer, the top closure at least one barrier layer, and the bottom closure at least one barrier layer each comprise metalized polyethylene terephthalate (MPET).

18. The paper-based container assembly of claim 16, wherein the sidewall at least one barrier layer, the top closure at least one barrier layer, and the bottom closure at least one barrier layer each comprise metalized polybutylene terephthalate (MPBT).

19. The paper-based container assembly of claim 16, wherein the sidewall at least one barrier layer, the top closure at least one barrier layer, and the bottom closure at least one barrier layer each comprise aluminum oxide (AlOx) coated polyethylene terephthalate (PET).

20. The paper-based container assembly of claim 16, wherein the sidewall at least one barrier layer, the top closure at least one barrier layer, and the bottom closure at least one barrier layer each comprise aluminum.

21. A paper-based container assembly comprising:
a rigid container body comprising:
at least one sidewall, wherein the at least one sidewall comprises:
a plurality of paper-based layers adhered to one or more barrier layers, wherein the one or more barrier layers are selected from the group consisting of metalized polyethylene terephthalate (MPET), metalized polybutylene terephthalate (MPBT), aluminum oxide (AlOx) coated polyethylene terephthalate (PET), and aluminum; and
one or more ionomeric layers adhered to the one or more barrier layers, wherein the one or more ionomeric layers define a container interior;
a top rim circumscribing a top end of the at least one sidewall, and
a bottom peripheral edge circumscribing a bottom end of the sidewall;
a top closure sealed to the top rim, wherein the top closure comprises:
one or more paper-based layers adhered to one or more barrier layers, wherein the one or more barrier layer are selected from the group consisting of metalized polyethylene terephthalate (MPET), metalized polybutylene terephthalate (MPBT), aluminum oxide (AlOx) coated polyethylene terephthalate (PET), and aluminum; and
one or more peelable sealant layers adhered to the one or more barrier layers; and
a bottom closure recessed into the bottom end and forming a seal with an interior surface of the cylindrical container body, wherein the bottom closure comprises:
one or more cup stock board layers adhered to one or more barrier layers, wherein the one or more barrier layer are selected from the group consisting of metalized polyethylene terephthalate (MPET), metalized polybutylene terephthalate (MPBT), aluminum oxide (AlOx) coated polyethylene terephthalate (PET), and aluminum; and
one or more ionomeric layers adhered to the one or more barrier layers,
wherein:
the one or more paper-based layers of the cylindrical container body, top closure, and bottom closure comprise at least about 95% by mass of the paper-based container assembly, and
the paper-based container assembly has an oxygen transmission rate of about 0.5 $cm^3/m^2$/day or less, a water vapor transmission rate of about 0.5 $g/m^2$/day or less, and can withstand at least 10 inHG for at least 10 minutes.

22. The paper-based container assembly of claim 21 wherein the paper-based container assembly has an oxygen transmission rate of about 0.05 $cm^3/m^2$/day or less and a water vapor transmission rate of about 0.05 $g/m^2$/day or less.

* * * * *